US011253067B2

(12) United States Patent
Wohlgenannt

(10) Patent No.: US 11,253,067 B2
(45) Date of Patent: Feb. 22, 2022

(54) DRIVE DEVICE FOR A MOVABLE FURNITURE PART

(71) Applicant: Julius Blum GmbH, Hoechst (AT)

(72) Inventor: Daniel Wohlgenannt, Bregenz (AT)

(73) Assignee: Julius Blum GMBH, Hoechst (AT)

( * ) Notice: Subject to any disclaimer, the term of this patent is extended or adjusted under 35 U.S.C. 154(b) by 101 days.

(21) Appl. No.: 16/814,164

(22) Filed: Mar. 10, 2020

(65) Prior Publication Data

US 2020/0205566 A1 Jul. 2, 2020

Related U.S. Application Data

(63) Continuation of application No. PCT/AT2018/060218, filed on Sep. 19, 2018.

(30) Foreign Application Priority Data

Sep. 20, 2017 (AT) ..... A 50796/2017

(51) Int. Cl.
*A47B 88/463* (2017.01)
*A47B 88/477* (2017.01)

(52) U.S. Cl.
CPC ..... *A47B 88/463* (2017.01); *A47B 88/477* (2017.01); *A47B 2210/0091* (2013.01)

(58) Field of Classification Search
CPC . A47B 88/463; A47B 88/0477; A47B 88/477; A47B 88/46; A47B 88/473;
(Continued)

(56) References Cited

U.S. PATENT DOCUMENTS 9,211,007 B2 12/2015 Brunnmayr et al.
9,295,329 B2 3/2016 Brunnmayr et al.
(Continued)

FOREIGN PATENT DOCUMENTS

AT 502 940 6/2007
DE 20 2009 005 256 12/2010
(Continued)

OTHER PUBLICATIONS

International Search Report dated Dec. 17, 2018 in International (PCT) Application No. PCT/AT2018/060218.

*Primary Examiner* — Andrew M Roersma
(74) *Attorney, Agent, or Firm* — Wenderoth, Lind & Ponack, L.L.P.

(57) ABSTRACT

A drive device for a movable furniture part includes a support, an ejection device movable relative to the support to eject the movable furniture part, a locking device for locking the ejection device, and a trigger mechanism for moving the locking device out of the locking position. The trigger mechanism is activatable by overcompression of the movable furniture part into an overcompression position behind the closing position, and the movable furniture part is movable by the ejection device in the opening direction when the unlocking position is reached. A transmission device separate from the movable furniture part transmits the position of the movable furniture part to the trigger mechanism. A coupling device acts or is arranged between the transmission device and the trigger mechanism, and the coupling device can be moved from an uncoupling position into a coupling position. The transmission device can be movably coupled to the trigger mechanism.

53 Claims, 62 Drawing Sheets

(58) Field of Classification Search
CPC .... A47B 2210/0091; A47B 2210/0078; A47B 2210/0081
See application file for complete search history.

(56) References Cited

U.S. PATENT DOCUMENTS

| | | | | |
|---|---|---|---|---|
| 9,532,648 | B2 | 1/2017 | Gasser et al. | |
| 9,622,578 | B2 | 4/2017 | Goetz et al. | |
| 9,655,447 | B2 | 5/2017 | Brunnmayr et al. | |
| 9,820,573 | B2 | 11/2017 | Brunnmayr | |
| 10,070,721 | B2 | 9/2018 | Brunnmayr et al. | |
| 2014/0210329 | A1 | 7/2014 | Brunnmayr | |
| 2015/0097473 | A1 | 4/2015 | Brunnmayr et al. | |
| 2015/0098667 | A1 | 4/2015 | Brunnmayr et al. | |
| 2015/0374123 | A1 | 12/2015 | Goetz et al. | |
| 2015/0374124 | A1 | 12/2015 | Brunnmayr et al. | |
| 2016/0007748 | A1 | 1/2016 | Gasser et al. | |
| 2016/0206093 | A1 | 7/2016 | Brunnmayr et al. | |
| 2017/0020285 | A1 | 1/2017 | Schallert et al. | |
| 2018/0160808 | A1 | 6/2018 | Wohlgenannt | |
| 2020/0190882 | A1* | 6/2020 | Bantle | E05F 5/003 |

FOREIGN PATENT DOCUMENTS

| | | | | |
|---|---|---|---|---|
| DE | 10 2010 036 903 | | 9/2011 | |
| DE | 10 2013 100 652 | | 7/2014 | |
| DE | 20 2015 001 186 | | 4/2015 | |
| EP | 2 983 554 | | 2/2016 | |
| JP | 2007-9507 | | 1/2007 | |
| JP | 2013-500806 | | 1/2013 | |
| JP | 2014-530688 | | 11/2014 | |
| JP | 2016-514576 | | 5/2016 | |
| JP | 2017-511189 | | 4/2017 | |
| WO | 2013/059847 | | 5/2013 | |
| WO | 2013/096981 | | 7/2013 | |
| WO | 2014/008519 | | 1/2014 | |
| WO | 2014/008521 | | 1/2014 | |
| WO | 2014/165873 | | 10/2014 | |
| WO | 2014/165877 | | 10/2014 | |
| WO | 2014/165878 | | 10/2014 | |
| WO | 2015/051386 | | 4/2015 | |
| WO | 2017/004638 | | 1/2017 | |
| WO | WO-2018077930 | A1 * | 5/2018 | A47B 88/463 |

* cited by examiner

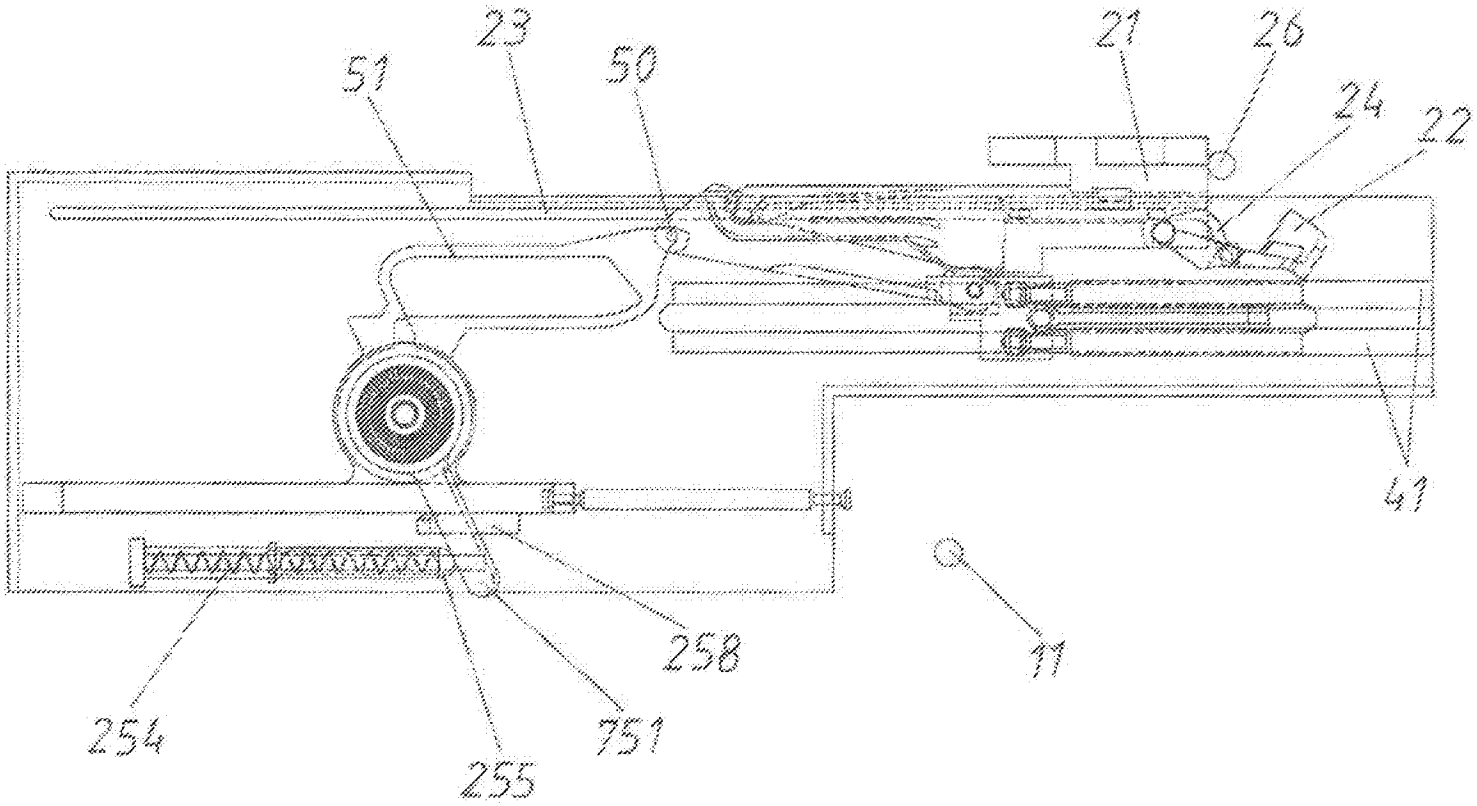
Fig. 25 OS + EK

DRIVE DEVICE FOR A MOVABLE FURNITURE PART

BACKGROUND OF THE INVENTION

A first aspect of the invention concerns a movable furniture part, in particular for a drawer, comprising a carrier and an ejection device for ejecting the movable furniture part from a closed position into an open position, with the ejection device being movable relative to the carrier. A locking device is provided for locking the ejection device in a locking position, and a triggering mechanism is provided for moving the locking device out of the locking position into an unlocking position. The triggering mechanism can be activated by overpressing the movable furniture part into an overpressing position situated beyond the closed position, and the movable furniture part can be moved by the ejection device into opening direction when the unlocking position is reached. A transmission device is provided for transmitting the position of the movable furniture part to the triggering mechanism, and the transmission device is separate from the movable furniture part, and a movement of the movable furniture part can be transmitted to the triggering mechanism by the transmission device. Moreover, the invention concerns an arrangement comprising such a drive device and a front buffer as well as an arrangement comprising two such drive devices and a synchronizing device. Furthermore, the invention concerns an item of furniture comprising such a drive device.

For many years, there have been various drive devices in the industrial sector of furniture fittings to assist movements of movable furniture parts—which in the past had to be affected only by the manual force of a user—by mechanical devices nowadays. In the meantime, a popular type of such drive devices are the so-called touch-latch mechanisms for which an ejection mechanism is initiated by pressing onto the movable furniture part situated in a closed position, whereby the movable furniture part is ejected. This is particularly helpful in the case of heavy drawers, but such devices are also used in the case of easier movable furniture doors or furniture flaps.

An example for such a drive device which is used for a furniture door is disclosed in the non-generic AT 502 940 B1. For this lockable drive device, an ejection element as well as a triggering element for unlocking the drive device are, and the triggering element is operable directly by the movable furniture part. The triggering element is part of a triggering mechanism. When the drive device is locked, the triggering element is movable in the direction of the movable furniture part situated in the closed position. Thereby, a distance between the triggering element and the movable furniture part is overcome, whereby the triggering element abuts the movable furniture part in the closed position in a backlash-free manner. In this way, it is always guaranteed that by overpressing a direct triggering is possible independent of the exact position of the furniture door relative to the drive device in the closed position. This document, however, is a non-generic prior art as there is no transmission device for transmitting the position of the movable furniture part onto the triggering element of the triggering mechanism, which transmission device is separate from the furniture part. It is particularly disadvantageous that such a drive device is only used for furniture doors as in the case of furniture items with furniture doors the drive devices are mostly arranged in the region of the hinges and, thus, directly adjacent the movable furniture parts. For that reason, among others, it is disadvantageous that such drive devices are not suitable for being used with drawers. In particular, there is not enough space for such mechanisms in the confined installation conditions of drawers. Here, it is also disadvantageous that the same closed position of the furniture door relative to the furniture carcass cannot always be guaranteed. Thus, it is possible that—in the case of several furniture parts arranged above each other or side by side—there are different closed positions, which results in a non-uniform picture of the furniture parts.

A generic prior art, in contrast, is disclosed in the EP 2 983 554 B1. This device includes an ejection device and a retraction device. Moreover, a coupling device is provided for coupling the drive device with the movable furniture part or with the furniture carcass. The coupling device corresponds to the transmission device of the present application.

A similar drive device is disclosed in WO 2015/051386 A2. This document teaches that the overpressing movement starts free from a movement transmission between the first drive device and the synchronizing device. In addition, the construction of the latch recess of this document is different to that of the aforementioned document, as the latch recess is two-part and one part thereof—in particular the locking element—is movable. Thus, it is not always necessary that the latch element is released from the latch recess by overpressing; rather, also one part of the latch recess (the locking element) is released or unlocked by the opposite drive device and a movement transmission onto the synchronizing device. Thereby, the latch element is moved directly from the latch recess into the ejection section.

The two last-mentioned documents each provide a depth adjusting wheel. With this depth adjusting wheel the position of the latch recess can be modified. This adjustment is enabling that—when the drive device is situated in the locking position—the movable furniture part takes a position which is desired by the user. Thereby, it is possible that a uniform panel picture is reached. Moreover, it can be adjusted that a sufficient overpressing travel or stroke is given between the front panel of the movable furniture part and the furniture carcass. In the industrial sector of furniture fittings, an overpressing stroke or panel gap of about 2.5 mm is generally accepted.

Now it is the case that—because of tolerances between all of the components of the drive device and because of not exactly mounted drive devices on the item of furniture—relative large differences can occur between individual movable furniture parts in the form of drawers implemented in an item of furniture. In extreme cases differences of up to 5 mm can occur. Therefore, if the position of several drawers to each other is different up to 5 mm in the closed position, this is not desired because auf esthetical reasons on the one hand and on the other hand it can even occur that the unlocking can no longer be guaranteed when the overpressing stroke is too small. Therefore, simply these depth adjusting wheels are provided in the case of the last-mentioned documents in order to create a correspondingly uniform front panel picture during or after the implementation of the drive devices together with the movable furniture parts and in order to configure a sufficiently large overpressing stroke for each drawer.

However, these depth adjusting wheels have several disadvantageous points. First, additional components must be provided in the drive device. Second, the adjustments have to be carried out with each implementation of a movable furniture part. Third, the position of the depth adjusting wheel or other parts can change with the time because of the tolerances and the frequent movements, whereby the panel picture can become less exact or whereby in an extreme case the panel gap can become even so small that a reliable triggering can no longer be guaranteed.

SUMMARY OF THE INVENTION

The object of the first aspect of the present invention, thus, is to provide an improved drive device compared to the prior art. In particular, it shall be possible to spare a depth adjusting wheel. Still, it shall be guaranteed that a sufficient triggering stroke is always available. In addition, it shall be possible that a uniform panel picture can be achieved in a relative simple manner.

According to the invention, therefore, a coupling device is provided being effective and being arranged between the transmission device and the triggering mechanism, wherein the coupling device can be moved from an uncoupling position into a coupling position when the ejection device is in the locking position and wherein in the coupling position the transmission device is motion-coupled with the triggering mechanism by means of the coupling device. Put in other words, thus, the uncoupling position is still given when reaching the locking position. Only then the coupling device is moved from this uncoupling position into a coupling position. The force transmission path between the transmission device being connected to the movable furniture part and the triggering mechanism is completed by a movement in the drive device which movement is at the latest triggered in the closed position of the movable furniture part. Hence, in the coupling position a movement transmission between the transmission device and the triggering device is established and guaranteed. Put again in other words, thus, by the movement of the coupling device from the uncoupling position into the coupling position, a distance is overcome between the transmission device and the triggering device. This distance can be between 0 mm and 5 mm which approximately corresponds to the whole tolerance and to the desires of the industrial sector of furniture items. Only after the locking position is reached and the movable furniture part is in its closed position, this distance—no matter how small or large it is—is closed by the coupling device. In this way, the system (the drive device) is readjusted with each locking. Said distance, thus, is not closed directly between the movable furniture part and a corresponding limit stop of the drive device; rather, this distance is closed in the drive device itself when reaching or shortly after reaching the closed position.

According to a preferred embodiment, the coupling dive comprises a first coupling element and a second coupling element, wherein the two coupling element are movable relative to each other. In principle, it is possible that this movement of the coupling element to each other is triggered by gravity. Preferably, however, it is provided that the coupling device comprises a coupling force storage member. One of the two coupling elements is force-actuated by this coupling force storage member. In particular, the second coupling element is movable in the direction towards the first coupling element by the coupling force storage member. Preferably it is provided that the two coupling element are distanced from each other and in the coupling position the two coupling elements are in direct contact to each other. The distance between the two coupling elements from each other in the uncoupling position can be between 0 mm and 5 mm. When both coupling elements are directly contacting each other, the motion-coupling between the transmission device and the triggering device is guaranteed.

It is possible, per se, that the coupling device is moved from the uncoupling position into the coupling position immediately after reaching the locking position of the locking device. Thereby, a direct triggering of the triggering mechanism and, thus, an ejection of the movable furniture part would be possible. This, however, is disadvantageous when a user is directly through-pressing the movable furniture part during closing, as thereby an immediate opening would be initiated. In order to prevent this disadvantage, thus, a retardation device is provided for delaying or braking the coupling movement. This retardation device can be formed as a damping device by which the coupling elements are movable from the uncoupling position into the coupling position in a braked manner. This means, the force of the damping device is counteracting the force of the coupling force storage member. The damping device can also be designated as a timing element. The time retardation, for example, can be between 0.3 seconds and 5 seconds. This means, if a user during the closing of the movable furniture part is directly through-pressing the movable furniture part beyond the closed position, there is not yet a motion-coupling because of the uncoupling position. Thus, the locking device cannot be unlocked (yet). For details of the function of such a "through-pressing protection" it can be referred to the WO 2014/165877 A1.

The carrier can be formed as a plate to be mounted to the movable furniture part or to the furniture carcass. Preferably, the carrier is formed as a housing, preferably being arranged or arrangeable on the movable furniture part. This housing is preferably in two-part form, wherein a housing base plate and a housing cover is provided which can be connected to each other for example by snap couplings or similar solutions. Preferably, the housing consists of injection molded plastic material.

According to a preferred embodiment, the ejection device comprises an ejection slider being movable relative to the carrier and an ejection force storage member, preferably formed as a tension spring. The ejection force storage member is attached to the carrier by means of a first force storage member base and to the ejection slider by a second force storage member base. In principle, the ejection slider can also be formed as a swiveling lever. Preferably, however, the ejection slider is movable linearly in an ejection path being formed correspondingly in the carrier or in the housing respectively. The ejection force storage member can be formed magnetically. Preferably, the ejection force storage member is formed as a spring, in particular as a tension spring. The ejection force storage member can also be provided as a spring assembly. Further, the ejection slider comprises a slider base and a control lever being rotatably supported on the slider base.

The transmission device preferably comprises a transmission element being movable relative to the carrier and a limit stop—preferably formed on the transmission element—for an entrainment member, preferably arranged on a furniture carcass. The transmission element is slidably supported in a transmission element guide track which is formed in the carrier. In addition, preferably the transmission device comprises a catching lever for an entrainment member, preferably arranged on a furniture carcass, the catching lever being movably, preferably rotatably, supported on the transmission element. Thereby, it is possible to transmit a movement in opening direction as well as a movement in closing direction from the movable furniture part onto the transmission element and vice versa. Preferably, this catching lever is also movably supported in the transmission element guide track, wherein this guide track comprises an angled end section in order to swivel the catching lever relative to the remaining transmission element and to thereby enable the disengaging of the entrainment member from the transmission device.

In principle, it is possible that during ejecting the ejection device directly contacts the movable furniture part or the furniture carcass respectively. Preferably, however, the transmission device, preferably its transmission element, during ejecting can be contacted by the ejection device, preferably by its control lever, and is movable relative to the carrier.

In order to enable the locking and unlocking of the ejection device in a simply manner, preferably the locking device comprises a locking pin arranged on the ejection device, preferably on its control lever, and a guide track—preferably at least partly formed in the carrier—for the locking pin, wherein in the locking position the locking pin is locked in a latch recess of the guide track. It is possible that this latch recess is part of a cardioid-shaped locking guide track in which the locking pin is movable out of the latch recess by overpressing and the locking pin is reaching the ejection section via a deflection slant. Preferably, however, the latch recess is at least partly formed by a locking element which is movable relative to the carrier, wherein in the locking position the locking pin is held on the locking element. In this case, the unlocking, thus, is not directly triggered by a movement of the locking pin relative to the latch recess; rather, the locking element—which is jointly forming the latch recess—is moved away so that the locking pin is no longer held in the recess but is moved relative to the carrier by the force of the ejection force storage member.

Further, preferably the triggering mechanism comprises at least one triggering element which is supported movably on the carrier and a triggering lever which is movably, preferably rotatably, supported on the carrier, preferably the triggering element being formed separate from the triggering lever. For the three different design variants of the present invention which are still described in more detail later, the triggering lever is formed separate from the triggering element in the first and third variant, whereas in the second variant the triggering element and the triggering lever are formed as one component.

The triggering element is that part of the triggering mechanism which eventually causes the unlocking. This means, this triggering element is arranged nearest to the locking device or even jointly forms this locking device. Preferably it is provided that the locking element is connected to the triggering element, preferably the locking element is integrally formed with the triggering element.

For the coupling device per se it can be provided that the two coupling elements are formed as completely autonomous components. For a simple construction and for preventing too many parts, it is preferably provided that the coupling elements are in part formed jointly by other devices. Accordingly, it is provided that the first coupling element is connected to or is formed integrally with the transmission element of the transmission device. In addition, it is preferably provided that the second coupling element is connected to or is formed integrally with the triggering lever of the triggering mechanism. The triggering lever, thus, is that part of the triggering mechanism which is located next to the transmission device.

Preferably, the drive device also comprises a, preferably damped, retraction device for retracting the movable furniture part from an open position into the closed position.

As already mentioned, there are three concrete embodiments, in particular for the triggering mechanism and for the coupling device.

For the first variant, the first coupling element is formed as an abutting surface on the transmission element and the second coupling element is formed as a compensating chock. This compensating chock is formed in such a way that—during the movement from the uncoupling position into the coupling position—the compensation chock is moving into the distance between the transmission device and the triggering mechanism and is moved so far till the motion-coupling and, thereby, the coupling position is given. The detailed design of the compensating chock per see is random as long as there exists a tapering and a corresponding movability. Preferably, the compensating chock comprises a bent surface, wherein in the coupling position the bent surface contacts the abutting surface on the transmission element. The advantage of such a compensating chock is that a stepless adjustment or a stepless compensation of the distance between the transmission device and the triggering mechanism is provided.

For the second and third variant, there is another kind of coupling. In each variant, the first coupling element is formed by latching recesses which are formed in the transmission element and the second coupling element comprises at least one latching tooth which can be latched in the latching recesses. Thus, the latching tooth can latch in different latching recesses depending on the position of the transmission device relative to the carrier. For manufacturing reasons, the latching recesses preferably comprise a distance of about 0.7 mm to each other.

For the third variant only a single latching tooth is provided, whereas for the second variant the first coupling element is formed as a crown gear which is rotatable around a rotary axis, wherein on said crown gear a plurality of radially oriented latching recesses are formed around the rotary axis, and that the second coupling element is formed as a crown gear which is rotatable around the rotary axis, wherein on said crown gear a plurality of radially oriented latching teeth—which correspond with the latching recesses—are formed around the rotary axis, wherein the latching teeth—in the coupling position during a rotary movement of the crown gears to each other in at least one rotary direction—abut the latching recesses. For the relative movement of the crown gears to each other between the uncoupling position and the coupling position it is preferably provided that the two crown gears are movable relative to each other along the rotary axis. This means, no coupling is possible when the crown gears are distanced from each other along the rotary axis. However, as soon as the crown gears are no longer distanced from each other, a coupling is given at least in one rotary direction.

Protection is sought for an arrangement comprising a drive device according to the invention and a front buffer for determining the closed position of the movable furniture part relative to the furniture carcass. This front buffer can be attached to the furniture carcass.

In particular for smaller drawers it is per se sufficient when only a single drive device is provided. For larger drawers or also for heavy loaded drawers it is advantageously when two drive devices arranged on opposing sides and a synchronizing device is provided. For that purpose, protection is also sought for an arrangement comprising two drive devices according to the invention and a synchronizing device, wherein the drive devices—especially the movements of the triggering elements—are motion-coupled by means of the synchronizing device. Preferably, the two drive devices are formed mirror-symmetrically.

Protection is also sought for an item of furniture comprising a furniture carcass, a furniture part, preferably in the form of a drawer, which is movable relative to the furniture carcass, and a drive device according to the invention. This movable furniture part can be in the form of a drawer, a furniture door, or a furniture flap.

It is per se possible that the drive device is mounted to the furniture carcass and is acting onto an entrainment member arranged on the movable furniture part or directly onto the movable furniture part. Preferably, however, the drive device is mounted to the movable furniture part and at least one entrainment member—which corresponds with the drive device—is attached to the furniture carcass. Hence, the drive device pushes itself together with the movable furniture part directly from the furniture carcass or from an entrainment member attached to the furniture carcass.

In order to guarantee a uniform front panel picture, a, preferably elastic, front buffer can be arranged on a front side of the furniture carcass, wherein in the closed position the movable furniture part, preferably a front panel of the movable furniture part, abuts the front buffer. During the overpressing of the movable furniture part in closing direction, the front buffer can be pushed in by the movable furniture part. If an identical front buffer is associated with each movable furniture part on a furniture carcass, each movable furniture part (drawer) can have the exactly same relative position to the furniture carcass. This results necessarily in a constant panel picture. In addition, it is guaranteed by the front buffers that always a sufficient triggering stroke or overpressing stroke is given, as these front buffers can be pushed in by manual force onto the movable furniture part and, thereby, the overpressing movement and the unlocking is carried out. Preferably, in an unloaded state, the front buffer protrudes from the furniture carcass between 1.5 mm and 3.5 mm, preferably between 2.3 mm and 2.7 mm. In particular, the front buffer—preferably its piston—protrudes by 2.5 mm from the furniture carcass. After the pushing-in and the ejecting of the movable furniture part, the front buffer again protrudes by about 2.5 mm because of the elasticity or because of the spring force.

A second aspect of the invention concerns a drive device for a movable furniture part, in particular for a drawer, comprising a carrier, an ejection device for ejecting the movable furniture part from a closed position into an open position, and the ejection device is movable relative to the carrier. The ejection device can be unlocked from a locking position by an overpressing movement of the movable furniture part into an overpressing position situated beyond the closed position, and a locking device for locking the ejection device in the locking position. The locking device comprises a locking pin arranged on the ejection device, and a guide track—preferably at least partly formed in or on the carrier—for the locking pin. In the locking position, the locking pin is locked in a latch recess of the guide track, and the latch recess is at least partly formed by a locking element which is movable relative to the carrier and wherein in the locking position the locking pin is held on the locking element.

Such a drive device is known from the WO 2015/051386 A2. In particular, according to this known drive device, the locking element is rotatably supported on the housing. The relative large necessity of space is disadvantageous, as in the case of the rotary movement the coupling element connected to the locking element is protruding quite far in lateral direction.

Also in the JP 2007-009507 A the locking element jointly forming the latch recess is only supported rotatably or swiveling.

In contrast, according to the embodiment shown in FIGS. 11 and 12 of the DE 20 2009 005 256 U1, a component which jointly forms the latch recess is movable linearly. This linear movement of the component denoted as guiding element is carried out, however, only during an opening by pulling on the movable furniture part. In particular, this movement of the guiding element is carried out in that direction in which also the end section (locking pin) is moved during the overpressing movement. In an overpressing movement and subsequent ejection movement there is no relative movement between the two components jointly forming the latch recess, as the end section (locking pin) is simply sliding along the loop-shaped section (cardioid-shaped guide track). Hence, this document indeed shows a linear movement of the guiding element; however, this movement is not carried out in the case of an unlocking and opening by means of an overpressing movement.

The object of this second aspect of the present invention, thus, is to provide an alternative drive device compared to the prior art. In particular, the mentioned disadvantages shall be eliminated.

Accordingly, the locking element is supported in a linearly movable manner on the carrier, wherein the locking element is—starting from its position when being in the locking position—linearly movable contrary to that direction in which the locking pin is moved during the overpressing movement. Thus, a drive device is created which provides a space-saving movement of the locking element during opening by overpressing.

According to a preferred embodiment, the guide track is cardioid-shaped.

In order to enable a transmission of the unlocking movement to a second drive device arranged on the opposing side of the furniture part, the locking element is connected to a synchronizing element for synchronizing the movement of the locking element with a locking element of a second locking device. Particularly preferable, the locking element is formed integrally with the synchronizing element.

For example, the synchronizing element can be formed as a transmission lever. Preferably, however, the synchronizing element is formed as a toothed rack.

According to a preferred embodiment, the locking element is movably supported in a limited manner and is guided linearly slidable on the carrier, preferably in a recess of a housing base plate of the carrier. Particularly preferable, it is possible that guiding elements are formed on the locking element and in the carrier, wherein the guiding elements correspond with each other.

Further, it is provided that the locking element—starting from its position when the locking position is given—is movable linearly in the direction of an ejection section of the guide track.

In a preferred embodiment, the locking element is force-actuated by a force storage member, preferably by a spring.

According to a preferred embodiment, after the unlocking (and during a relative movement of the locking pin in ejection direction) the locking pin is abutting the locking element and the locking element is movable by the locking pin against the force of the force storage member in the direction of the ejection section of the guide track.

Preferably, the locking element—as soon as the locking pin is disengaged from the locking element—is movable by the force storage member in that direction in which the locking pin is moved during the overpressing movement. The locking element, thus, is already moved back during ejecting so that the locking element together with the guide track again forms the latch recess.

Further, by the movement of the locking element initiated by the locking pin, a gap is released between the locking element and a limit stop of the guide track. In addition, the locking pin is movable through the gap further into the ejection section of the guide track and the locking pin is being disengaged from the locking element.

In a specific embodiment, by a surface formed on the locking element, which surface is oriented transverse to the linear movement direction of the locking element, the locking pin is deflected into the gap and the locking pin is released from the surface.

Protection is also sought for an arrangement comprising two drive devices according to the second aspect of the invention, and a synchronizing device for synchronizing the locking elements of both drive devices.

According to a preferred embodiment of the arrangement, the overpressing movement begins free from a movement transmission between the first drive device and the synchronizing device, and the synchronizing device is movable upon a movement of the movable furniture part in opening direction by the first drive device. In particular, a movement transmission from the first drive device to the synchronizing device is carried out only after the unlocking.

Further, the synchronizing device comprises synchronizing elements—preferably formed as toothed racks—each arranged on one of the drive devices.

Particularly, the synchronizing device can comprise a, preferably rotatable, synchronizing rod, wherein synchronizing elements, preferably toothed wheels, are arranged on both ends of the synchronizing rod.

The depending claims and the preferred embodiments of the second aspect of the invention apply—as long as technically possible and useful—also for the first aspect of the invention. Vice versa applies the same.

BRIEF DESCRIPTION OF THE DRAWINGS

Further details and advantages of the present invention are described more fully hereinafter by means of the specific description with reference to the examples illustrated in the drawings, in which:

FIGS. 25-32 are top views onto the drive devices according to the second variant in different positions during the movement of the movable furniture part.

DETAILED DESCRIPTION OF THE INVENTION

Figure 1:
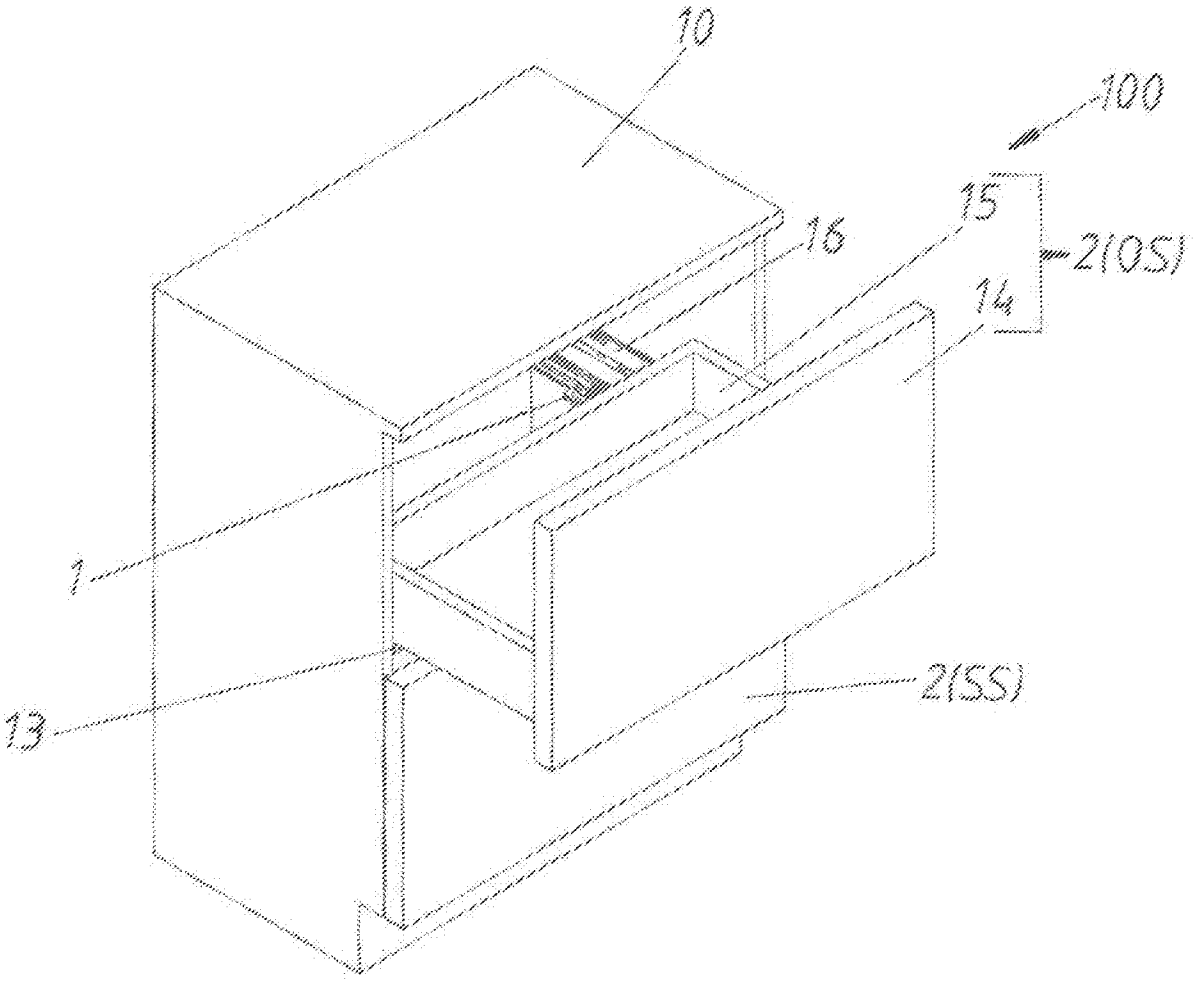
FIG. 1 is a perspective view of an item of furniture with two drawers.

FIG. 1 shows in a perspective view an item of furniture 100. This item of furniture 100 comprises a furniture carcass 10 and movable furniture parts 2 which are—in this case—arranged above each other. These two movable furniture parts 2 are formed as drawers. The drawer comprises at least one drawer container 15 and the front panel 14. The upper drawer is situated in an open position OS, while the lower drawer is situated in the closed position SS. The movable furniture parts 2 are each movably supported on extension guides 16 arranged on opposing sides of the furniture carcass 10. The extension guides 16 are visible only to some extent. Also a drive device 1 for the movable furniture part 2 is visible to some extent. A front buffer 13 is attached to at least one side of the front of the furniture carcass 10. This front buffer 13 has a thickness of about 2.5 mm and in the closed position SS defines the front panel gap between the front panel 14 and the furniture carcass 10.

Figure 2:
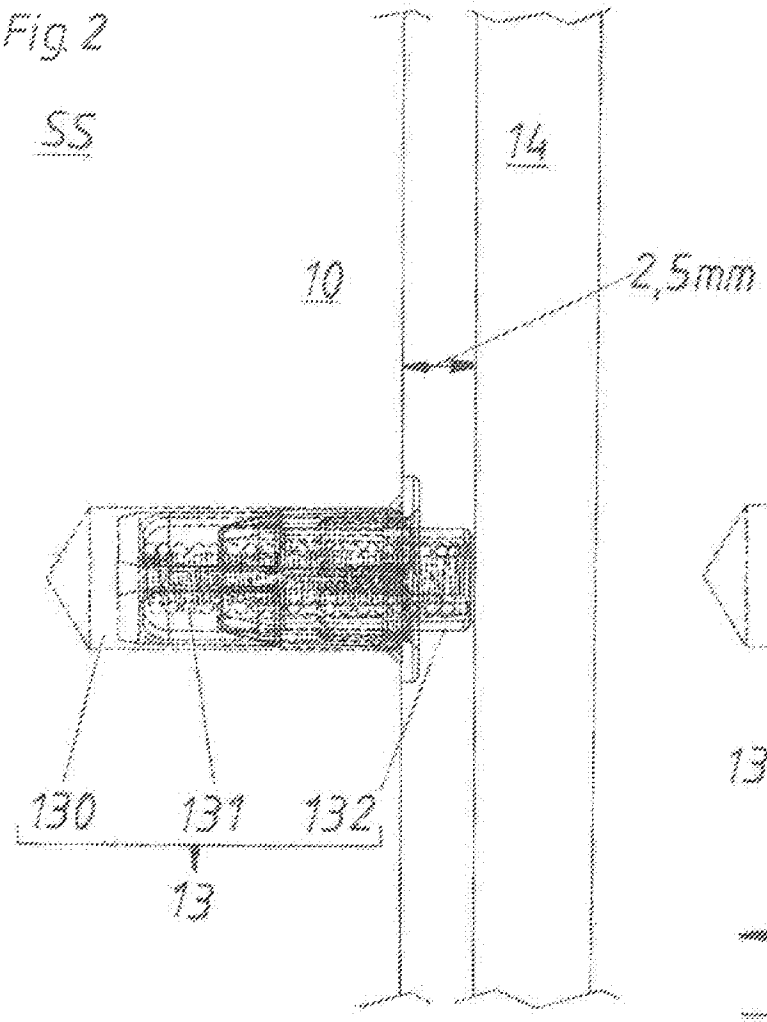
FIG. 2 is a lateral view of the front buffer in a non-pushed-in state for defining the closed position.

Correspondingly, FIG. 2 shows in detail the front buffer 13 attached to the furniture carcass 10. The front buffer 13 comprises a buffer sleeve 130, a buffer force storage member 131 (preferably in form of a pressure spring) and a plunger 132 actuated by the buffer force storage member 131. The front panel 14 abuts this front buffer 13. This FIG. 2, thus, shows the closed position SS of the movable furniture part 2. The distance between the furniture carcass 10 and the front panel 14 is 2.5 mm in the shown example.

Figure 3:
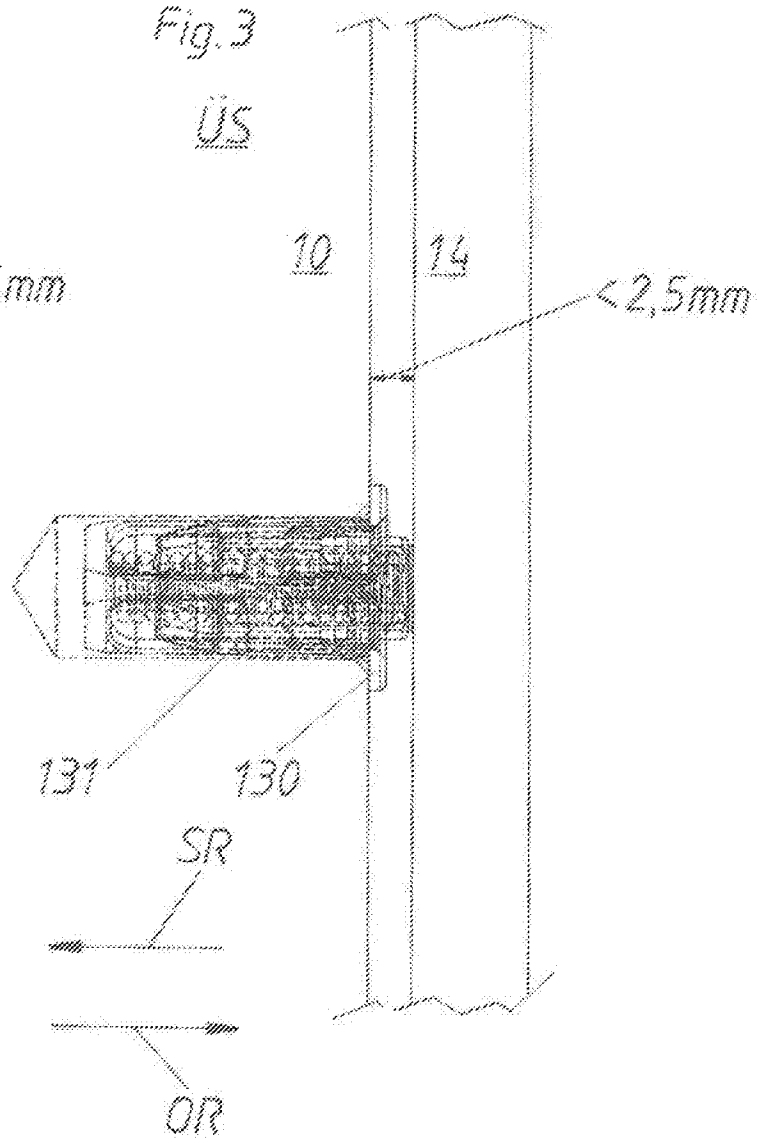
FIG. 3 is a lateral view of the pushed-in front buffer during overpressing.

In contrary, in FIG. 3 the overpressing position ÜS is illustrated. This means, a user has—starting from the closed position SS—pushed the movable furniture part 2 (in particular its front panel 14) in closing direction SR. Thereby, the resilient front buffer 13—in particular its buffer force storage member—is compressed. As a result, the front panel gap has become smaller than 2.5 mm. For example, already an overpressing movement of about 0.3 mm to 0.5 mm is sufficient in order to unlock the locking device 5 (which is still described in more detail later), whereby the ejection device 4 is activated and, thus, the drive device 1 ejects the movable furniture part 2 again in opening direction OR. As a consequence, also the buffer force storage member 131 of the front buffer 13 can relax again or can move into the original form again, so that the closed position SS can be reached again as shown in FIG. 2. Alternatively, the front buffer 13 can also be made of a resilient plastic material (without a pressure spring).

Figure 4:
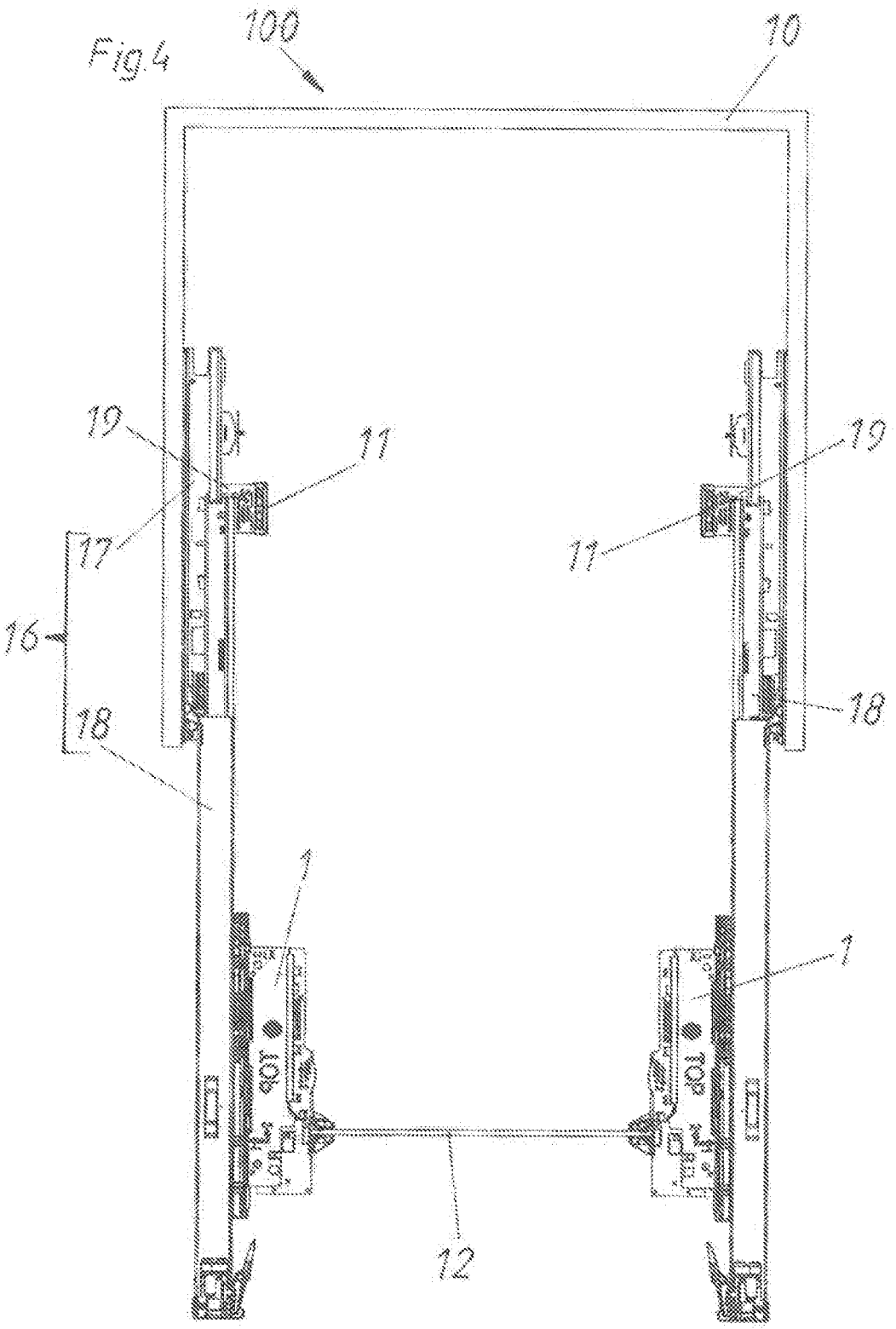
FIG. 4 is a top view onto the item of furniture with two opposing drive devices together with a synchronizing device and an extension guide.

In the top view according to FIG. 4 the components of the extension guide 16 as well as the parts of the two drive devices 1 and the synchronizing device 12 are better illustrated. Accordingly, a carcass rail 16 is attached to the furniture carcass 10. The drawer rail 18 is movably supported on this carcass rail 17. If applicable, also an additional central rail and/or a container rail can be provided. The carcass rail 17 and the drawer rail 18 together form the extension guide 16. The drive device 1 is mounted to the drawer rail 18 or to an underside of the drawer container 15. The synchronizing device 12 and the two drive devices 1 on the opposing sides together form a claimed arrangement. The entrainment member 11 is mounted to the carcass rail 17 (or also directly to the furniture carcass 10), preferably by means of an appropriate mounting plate 19. The movable furniture part 2 is not illustrated in FIG. 4.

A first variant of a drive device 1 is illustrated in the FIGS. 5 to 22.

Figure 5:
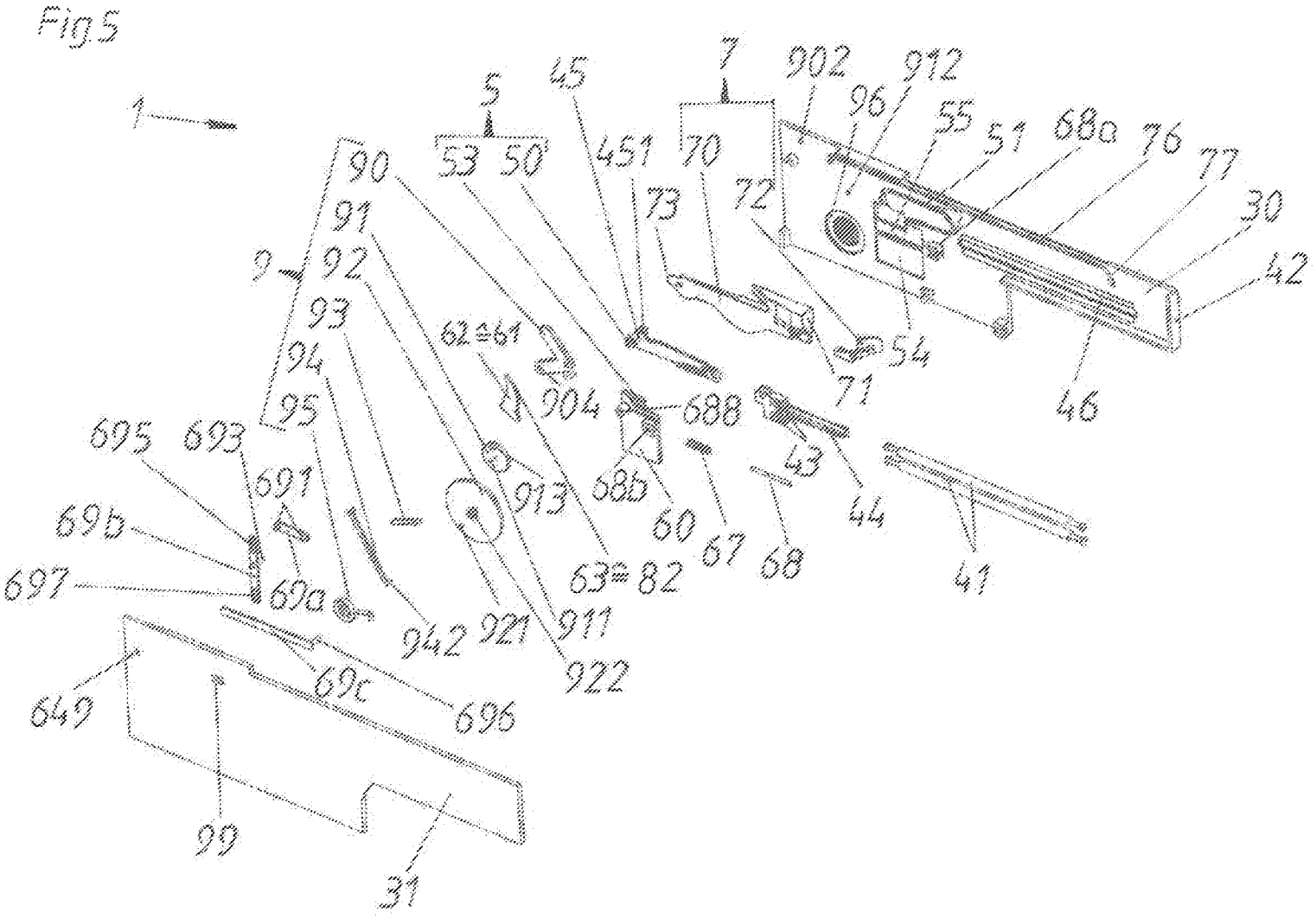
FIGS. 5 & 6 are exploded views of a first variant of the drive device.
Figure 6:
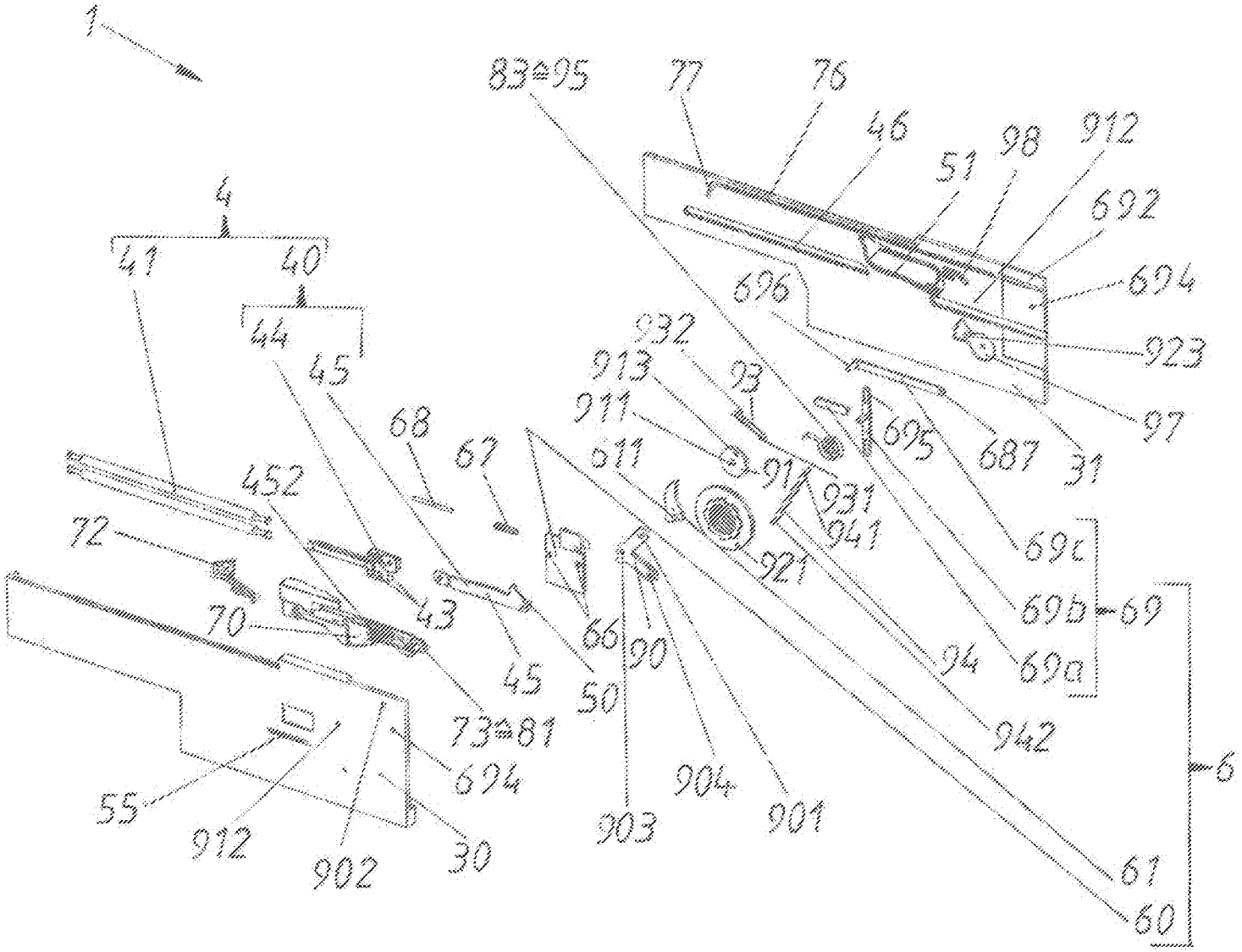

FIGS. 5 and 6 each show an exploded view of the drive device 1 according to the first embodiment, once seen from the front and one seen from the back. The carrier 3 comprises the housing base plate 30 and the housing cover 31. In each of the two parts of this carrier 3, the guide track 51 for the locking pin 50 is formed. The locking pin 50 is formed on or is attached to the control lever 45. The locking pin 50 is guided in this guide track 51. Also a guide track 76 (transmission element guide track) for the transmission element 70 and for the catching lever 72 is formed in both parts of the carrier 3. This guide track 76 comprises an angled end section 77, wherein—when the catching lever 72 is moved in this angled end section 77—the catching lever 72 is swiveling relative to the transmission element 70. An entrainment member 11 (not shown here) attached to the furniture carcass can be held between this catching lever 72 and the limit stop 71 facing towards the catching lever 72. The transmission device 7, thus, transmits the position of the entrainment member 11—which corresponds to the position of the furniture carcass 10 relative to the movable furniture part 2—to the drive device 1. Also the guide track 46 for the ejection slider 40 of the ejection device 4 is formed in both parts of the carrier 3.

The ejection slider 40 of the ejection device 4 comprises the control lever 45 and the slider base 44. The control lever 45 is pivotally supported on the slider base 44. In addition, also an ejection force storage member 41 is provided which—together with the ejection slider 40—forms the ejection device 4. In this case, this ejection force storage member 41 is formed by two tension springs. One end of the ejection force storage member 41 is held on the second force storage member base 43 formed in the slider base 44. With the other end the ejection force storage member 41 is held on the first force storage member base 42 formed in or on the carrier 3.

In the housing base plate 30 a recess 54 is formed too. In this recess 54, in turn, an elongated guiding groove 55 is formed. The triggering element 60 of the triggering mechanism 6 is guided linearly movable by means of the guiding protrusions 66 in the guiding groove 55. A part of the guide track 51 is formed on the triggering element 60. In addition, the locking element 53 is formed on this triggering element 60. The triggering element 60 is force-actuated by the spring 67 formed as a pressure spring. This spring 67 surrounds the guiding mandrel 68, wherein this guiding mandrel 68 on the one hand is held on the mandrel support 68*a* formed on the carrier 4 and on the other hand is held on the mandrel support 68*b* formed on the triggering element 60. When the spring 67 is relaxed, the triggering element 60 abuts the left edge of the recess 54 (as shown in FIG. 5). In this position the locking element 53 (together with a section of the guide track 51) forms the latch recess 52 (details follow in FIG. 21). The locking device 5, thus, is mainly formed by the locking element 53 and the locking pin 50.

The most important components of the triggering mechanism 6 are formed by the triggering lever 61 on the one hand and by the already described triggering element 60 on the other hand. In this embodiment, the triggering leverage 69 also forms a substantial part of the triggering mechanism 6. The first leverage part 69*a* comprises two protrusions 691. The first leverage part 69*a* is supported linearly movable in the elongated guide track 692 formed in the housing cover 31 by means of these protrusions 691. The first leverage part 69*a* abuts the triggering lever 61 with one end. This triggering lever 61 is—by means of a bearing element 611 formed thereon—rotatably supported in the bearing recess 903 in the compensating bracket 90. The second leverage part 69*b* is—by means of the bearing element 693—rotatably supported in a corresponding recess 694 formed in the housing cover 31. A respective recess 694 is also correspondingly formed in the housing base plate 30. The elongated hole 695 is formed in the upper end of the second leverage part 69*b*. One of the protrusions 691 of the first leverage part 69*a* engages with this elongated hole 695. On one end the third leverage part 69*c* comprises a bearing protrusion 687. The third leverage part 69*c* is held or guided by means of this bearing protrusion 687 in the lower elongated hole 697 of the second leverage part 69*b*. A holding pin 696 is arranged on an end of the third leverage part 69*c*, said end being remote from the bearing protrusion 687. This holding pin 696 engages into a corresponding holding pin recess 688 in the triggering element 60. Thus, especially the triggering element 60, the triggering leverage 69 and the triggering lever 61 are forming the triggering mechanism 6.

The coupling device 8 is a further important component of the drive device 1. In this first embodiment the first coupling element 81 is formed by an abutting surface 73 formed on the transmission element 70. The corresponding second coupling element 82 is formed by the compensating chock 62 or by its bent surface 63. In this case, the compensating chock 62 equates with the triggering lever 61. The bent surface 63 is equivalent to the second coupling element 82. In the uncoupling position EK this second coupling element 82 is distanced from the first coupling element 81, whereas in the coupling position KS these elements 81 and 82 contact each other. The coupling movement of the coupling device 8 is triggered by the coupling force storage member 83. In particular, the second coupling element 82 is indirectly actuated by the coupling force storage member 83.

Finally, the drive device 1 also comprises a retardation device 9 by means of which the coupling elements 81 and 82 are movable in a time-delayed manner to each other from the uncoupling position EK into the coupling position KS. In this first variant the retardation device 9 comprises the compensating bracket 90, the toothed wheel 91, the tension washer 92, the first tensioning lever 93, the second tensioning lever 94 as well as the return spring 95 which forms the coupling force storage member 83. The bearing element 901 is arranged on the compensating bracket 90. The compensating bracket 90 is rotatably supported in the recess 902 formed in the housing base plate 30 by means of the bearing element 901. In addition, a bearing recess 903 is formed in the compensating bracket 90. The triggering lever 61 (compensating chock 62) is rotatably supported via its bearing element 611 in this bearing recess 903. A further bearing recess 904 is formed in the compensating bracket 90 too. The second tensioning lever 94 is rotatably supported via an upper protrusion 941 in the bearing recess 904. Moreover, this second tensioning lever 94 comprises a lower protrusion 942. The second tensioning lever 94 is rotatably supported in the corresponding recess 921 in the tension washer 92 by means of this lower protrusion 942. The tension washer 92, in turn, together with the circular recess 96 formed in the housing base plate 30 forms a rotational damper. The rotary damping can unfold its function in the form of corresponding grooves. The return spring 95 formed as spiral spring is held on the spring protrusion 922 of the tension washer 92 on the one hand and on the spring protrusion 923 formed on the housing cover 31 on the other hand. The return spring 95 is generally located in a recess 97 formed in the housing cover 31. The return spring 95 actuates the tension washer 92 in such a way that according to FIG. 5 the tension washer 92 should be rotated in clockwise direction relative to the carrier 3. The damping effect between the tension washer 92 and the recess 96 is counteracting this rotary movement—which corresponds to the coupling movement of the coupling device 8—triggered by the return spring 95 in a damped manner. The toothed wheel 91 is rotatably supported via its central bearing element 911 in the corresponding recess 912 of the carrier 3. The toothed wheel 91 meshes via circumferentially arranged teeth with the teeth circumferentially arranged on the tension washer 92 (not shown in detail). On the toothed wheel 91, in turn, a holding recess 913 is formed. A protrusion 931 of the first tensioning lever 93 engages with this holding recess 913. The protrusion 932 formed on the other end of the tension lever 93, in turn, is guided in the guide track 98 which is formed in the housing cover 31. A resilient element 99, in turn, abuts this guide track 98. During the passing of the transmission element 70 the protrusion 932 is pressed by the transmission element 70 against the resilient element 99 and bends this resilient element 99 downward.

In the following drawings the functional process of the closing and opening of the drive device 1 is described according the first variant as an operating sequence.

Figure 7:
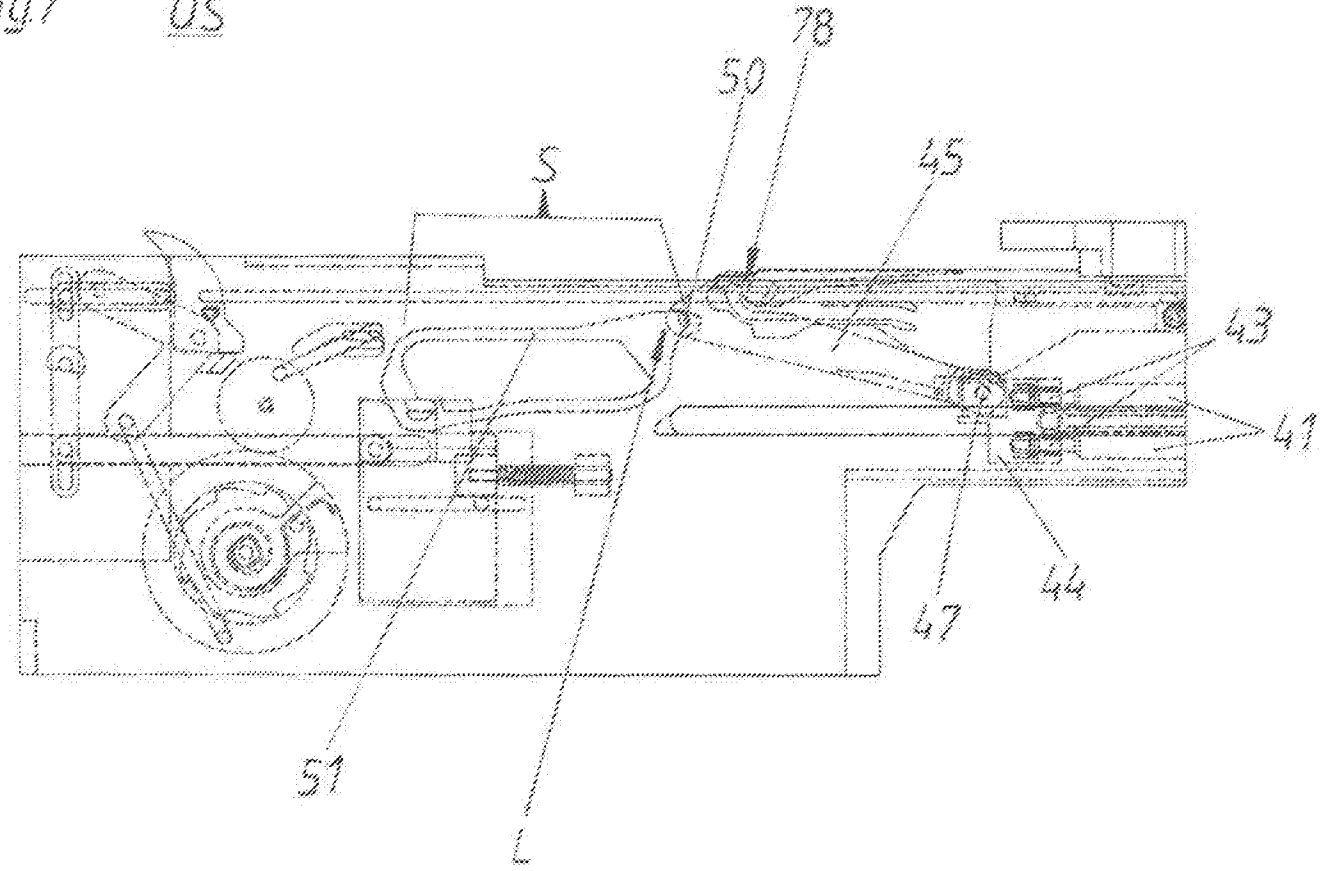
FIGS. 7-17 are top views onto the drive device according to the first variant in different position during the movement of the movable furniture part.

FIG. 7 shows in a top view a drive device 1 according to the first variant in an assembled state. In the illustrated state the movable furniture part 2 is situated in an open position OS. The movable furniture 2 is not illustrated in this figure and in the following figures; however, the carrier 3 of the drive device 1 is attached to the movable furniture part 2. In the following figures the relative position between the furniture part 2 and the furniture carcass 10 follows from the entrainment member 11 which is fixed to the furniture carcass 10. In FIG. 7, anyway, the movable furniture part 2 is situated in a relative wide open position OS. Accordingly, the locking pin 50 formed on the control lever 45 is positioned at the beginning of the tensioning section S in a bearing section L of the locking guide track 51. The control lever 45 is pivotally supported about the control lever axis 47 on the slider base 44, wherein in FIG. 7 the control lever 45 is located in the most upward pivoted position in clockwise direction. The ejection force storage member 41—which is held on the slider base 44 of the ejection slider 40 by means of the second force storage member base 43—is located in a relaxed position.

Figure 8:
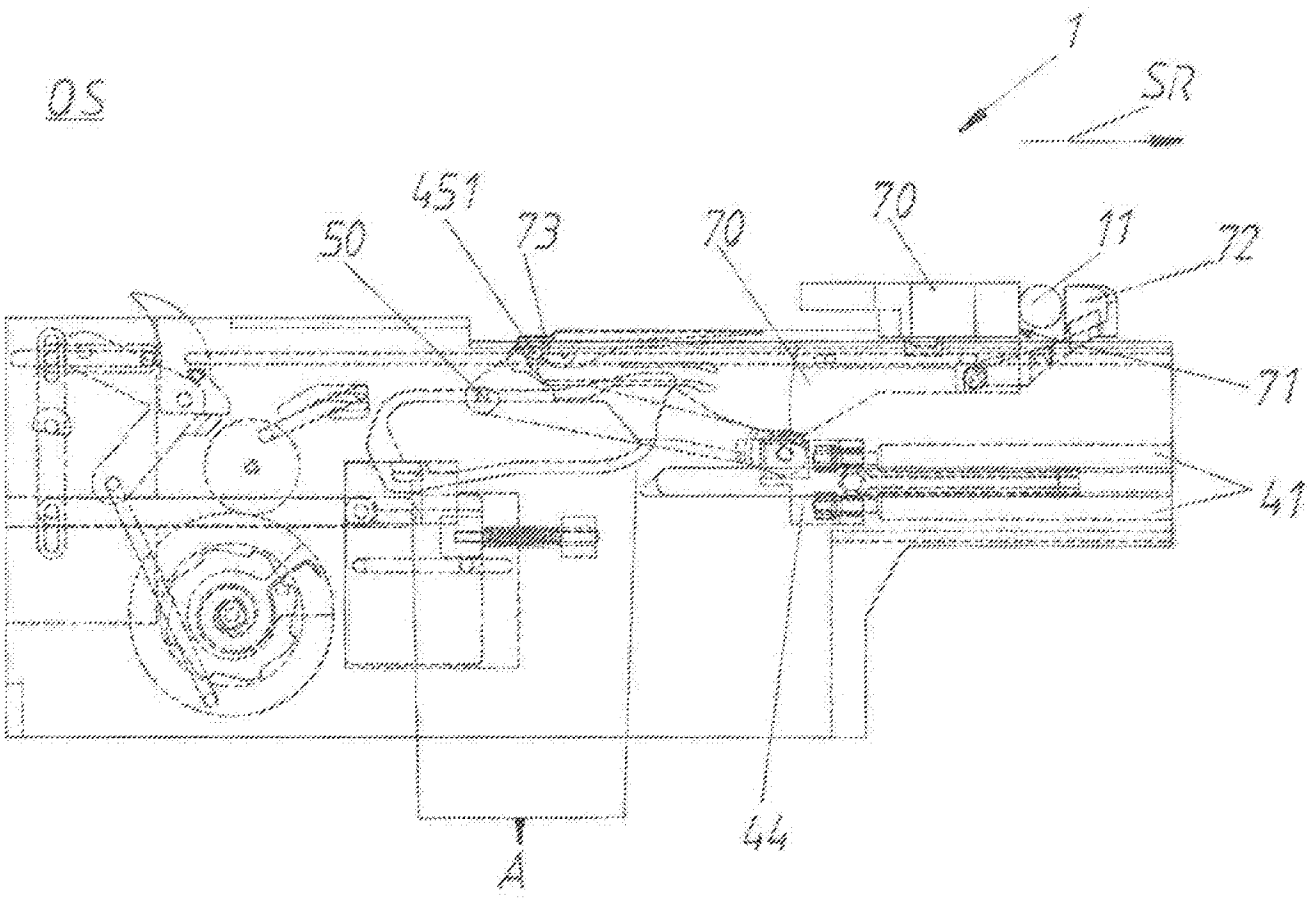

In FIG. 8 the movable furniture part 2 has moved in closing direction SR compared to FIG. 7. This can be seen because the entrainment member 11 abuts the limit stop 71 of the transmission element 70. The entrainment member 11 has moved the transmission element 70 relative to the remaining components of the drive device 1 because of the relative movement between the furniture carcass 10 and the movable furniture part 2 in closing direction SR. In particular, in this position the entrainment member 11 is held between the catching lever 72 and the limit stop 71 of the transmission element 70. By way of the tensioning limit stop (abutting surface 73) formed on the transmission element 70, which tensioning limit stop abuts the contact element 451 of the control lever 45, the control lever 45—guided by the locking pin 50—is moved along the guide track 51. The slider base 44 is also moving together with this control lever 45, whereby the ejection force storage member 41 attached to the slider base 44 is tensioned.

Figure 9:
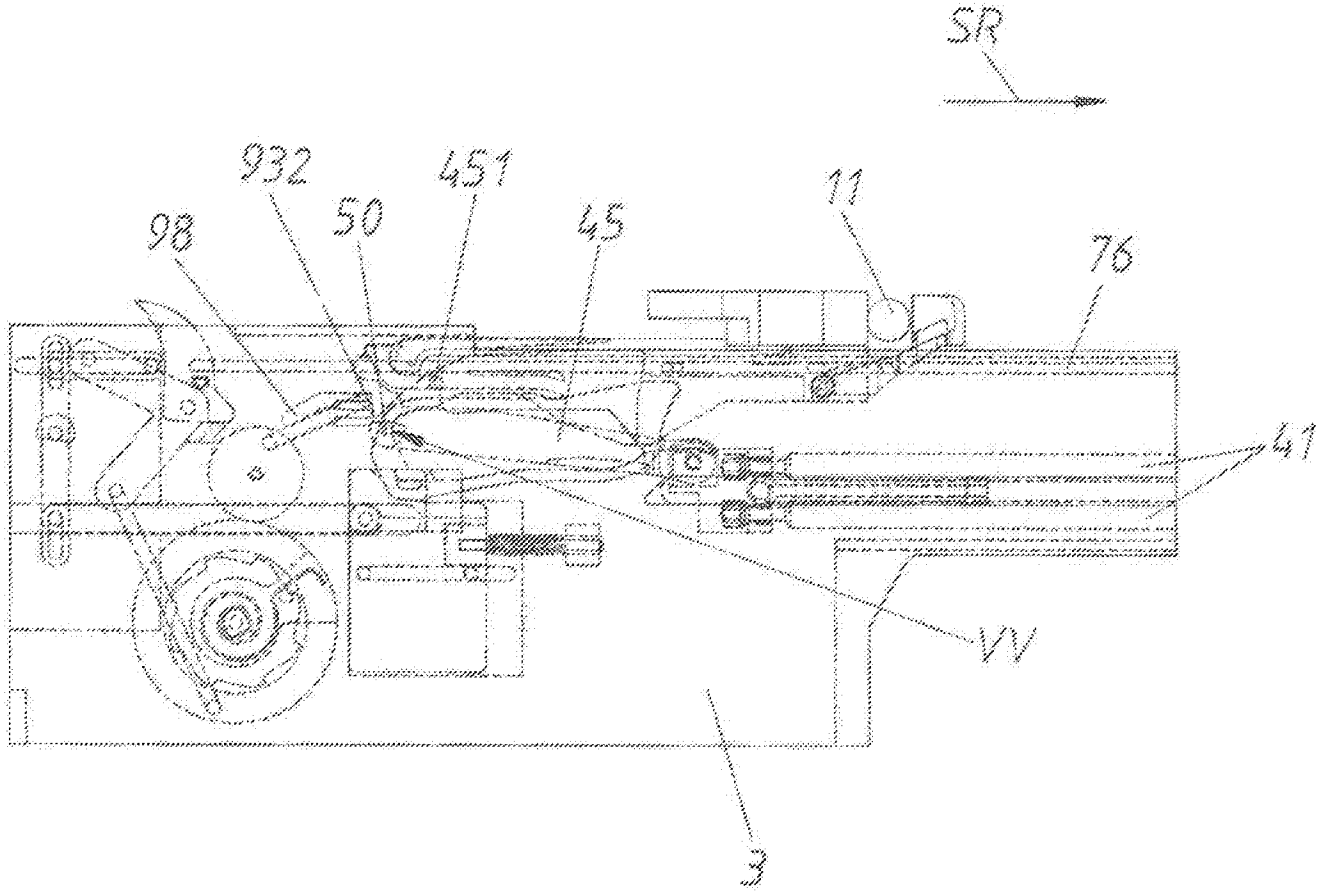

According to FIG. 9 the movement of the locking pin 50 through the tensioning section S has ended. The locking pin 50 has reached the pre-locking position VV in the guide track 51. The control lever 45 has been slightly pivoted downward by the guide track 51 so that the contact element 451 of the control lever 45 no longer contacts the abutting surface 73 of the transmission element 70. This means, during closing the whole transmission device 7 can be further moved relative to the carrier 3 without the necessity of further tensioning the ejection force storage member 41. In this position according to FIG. 9, thus, the ejection force storage member 41 is fully tensioned. Ejecting is not possible as the ejection slider 40 is (pre-)locked by means of the locking pin 50 in the pre-locking position VV of the guide track 51. In this position according to FIG. 9 the transmission device 7 is still movable relative to the carrier 3 along the guide track 76. A retraction device (not shown here) can be used for a further movement in closing direction. For the specific operating principle of such a retraction device it can be referred to the EP 2 983 554 B1 already mentioned in the description intro.

Figure 10:
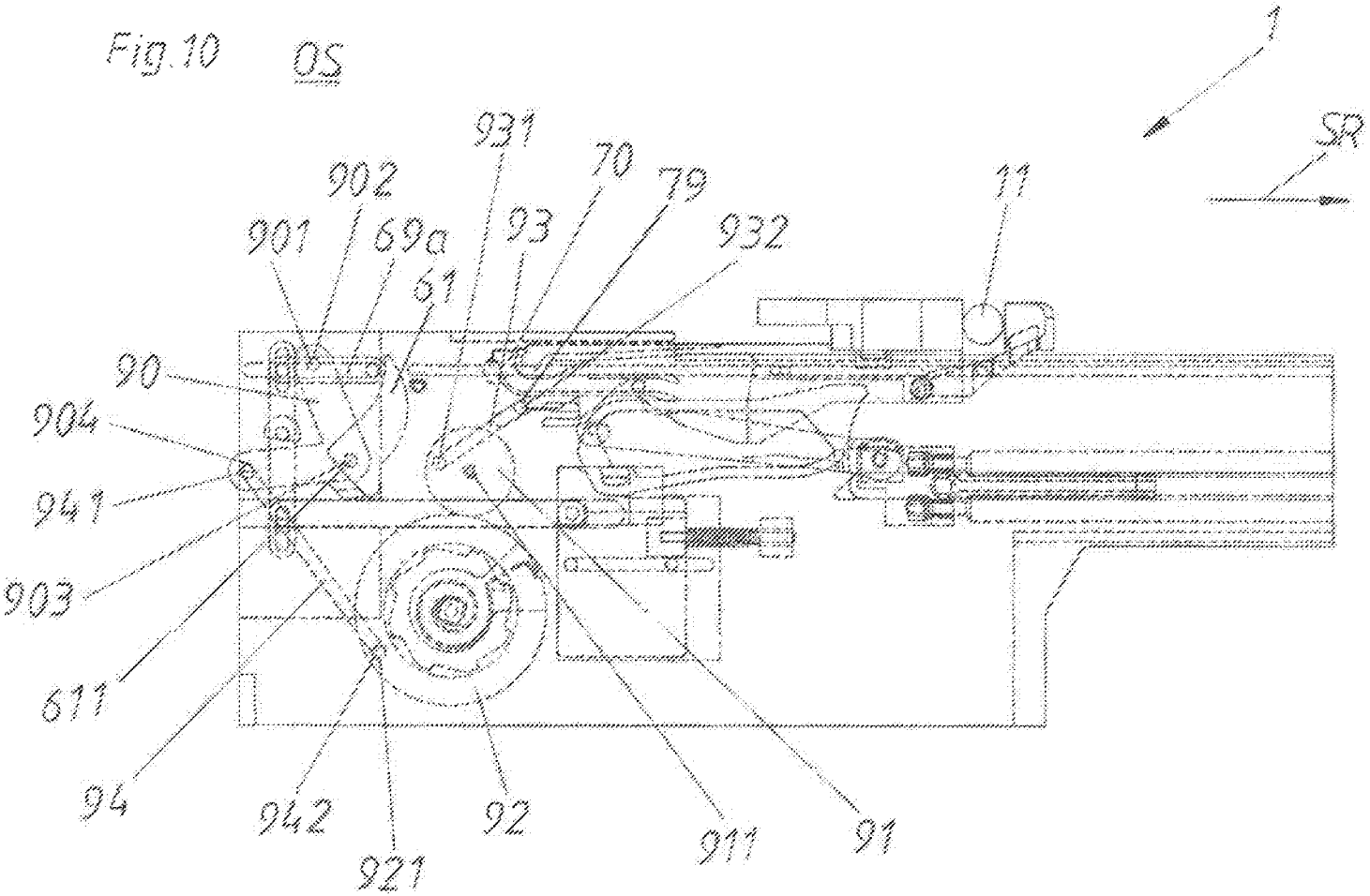

In FIG. 10 the movable furniture part 2 has been moved further in closing direction SR, preferably due to the retraction device. During this movement the damper limit stop 79 formed on the transmission element 70 contacts the protrusion 932 formed on the first tensioning lever 93 of the retardation device 9. As a consequence, the first tensioning lever 93 is shifted to the left. The smaller toothed wheel 91 is rotated counterclockwise by means of the protrusion 931 of the first tensioning lever 93, as the protrusion 931 engages in the eccentric holding recess 913 of the toothed wheel 91. This toothed wheel 91, thus, rotates by means of the bearing element 911 relative to the recess 912 formed in the housing base plate 30. As the toothed wheel 91 meshes with the tension washer 92, the tension washer 92 is rotated clockwise. The second tensioning lever 94 is rotatably supported via the lower protrusion 942 in the eccentric recess 921 of this tension washer 92. The second tensioning lever 94 is jointly moved with the tension washer 92. A movement of the compensating bracket 90 is also triggered by this movement of the second tensioning lever 94. In particular, the upper protrusion 941 of the second tensioning lever 94 engages in the bearing recess 904 of the compensating bracket 90. As the compensation bracket 90, in turn, is rotatably supported directly in the recess 902 in the carrier 3 via the bearing element 901, the compensating bracket 90 is rotated clockwise about the bearing element 901. The bearing element 611 of the triggering lever 61 is rotatably supported in the bearing recess 903 in the central region of the compensating bracket 90. The triggering lever 61 in the form of the compensating chock 62 is moved downward by the swiveling movement of the compensating bracket 90. Thereby, only the relatively small tip of this compensating chock 62 is situated between the first leverage part **69*a* and the transmission element 70**.

Figure 11:
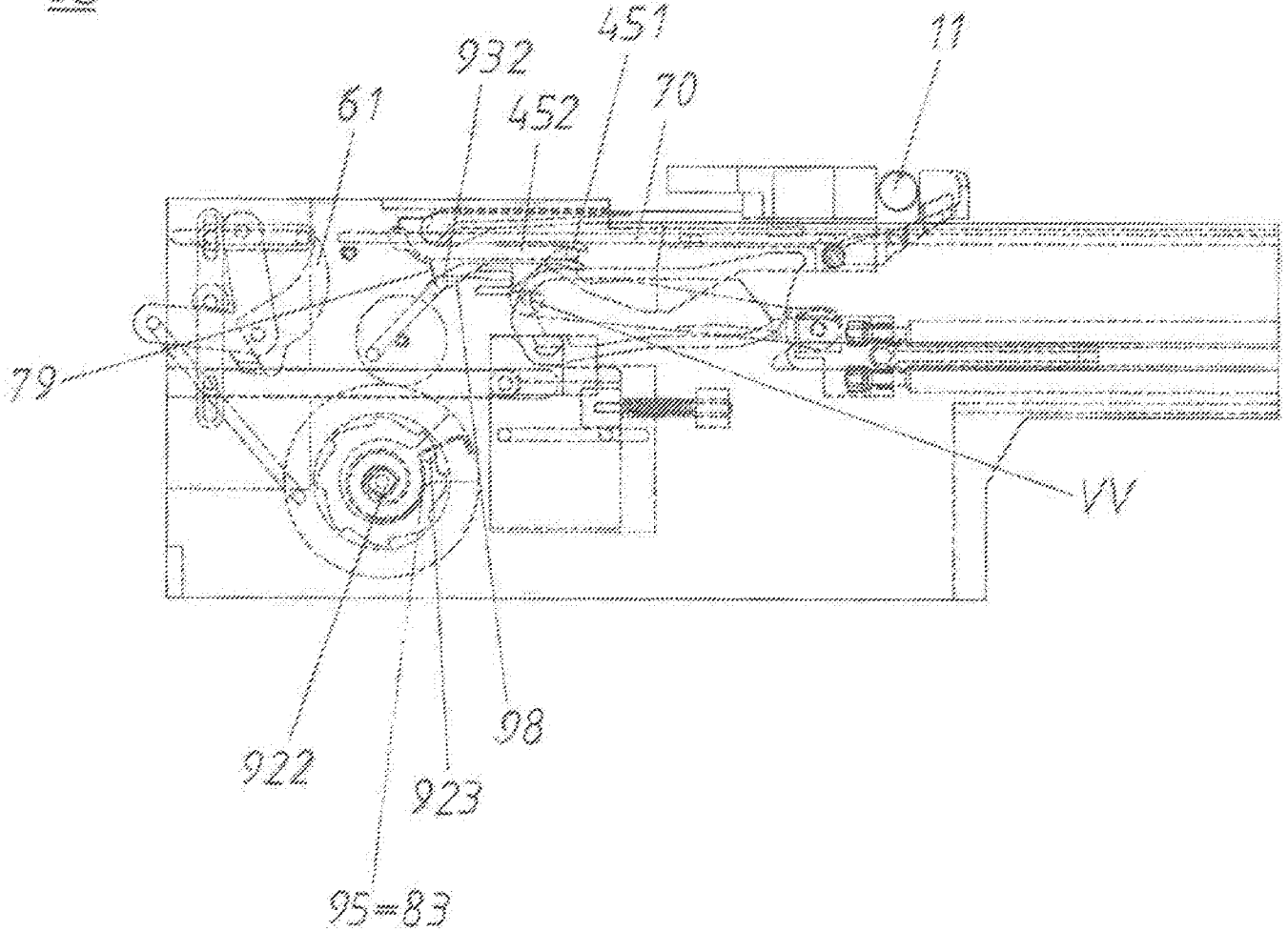

In FIG. 11 the closing movement of the movable furniture part 2 has continued even further. The triggering lever 61 of the triggering mechanism 6 has lowered even further by means of the transmission element 70 and the retardation device 9. The protrusion 932 of the first tensioning lever 93 has been moved so far along the guide track 98 that the protrusion 932 has been disengaged from the damping limit stop 79. This means, there is no longer a contact between the damping limit stop 79 and the protrusion 932. Thus, no more movement is transmitted from the transmission device 7 to the retardation device 9. In this position the return spring 95 forming the coupling force storage member 83 is tensioned as one end of this return spring 95 is held on the spring protrusion 923, while the other end of the return spring 95 has been jointly rotating with the spring protrusion 922 of the tension washer 95. This means, the tension washer 92 is now force-actuated counterclockwise by the return spring 95. A rotation, however, is not possible as the protrusion 932 abuts the transmission element 70 and is not movable along the guide track 98. In addition, it is illustrated in FIG. 11 that the contact element 451 of the control lever 45 is located in a control lever track 452 formed in the transmission element 70. The contact element 451 has already reached a slightly bend end section of this control lever track 452. In this position according to FIG. 11, however, the deflection of the contact element 451 caused by this bent section of the control lever track 452 is not quite sufficient to release the control lever 45 and its locking pin 50 from the pre-locking position VV of the guide track 51.

Figure 12:
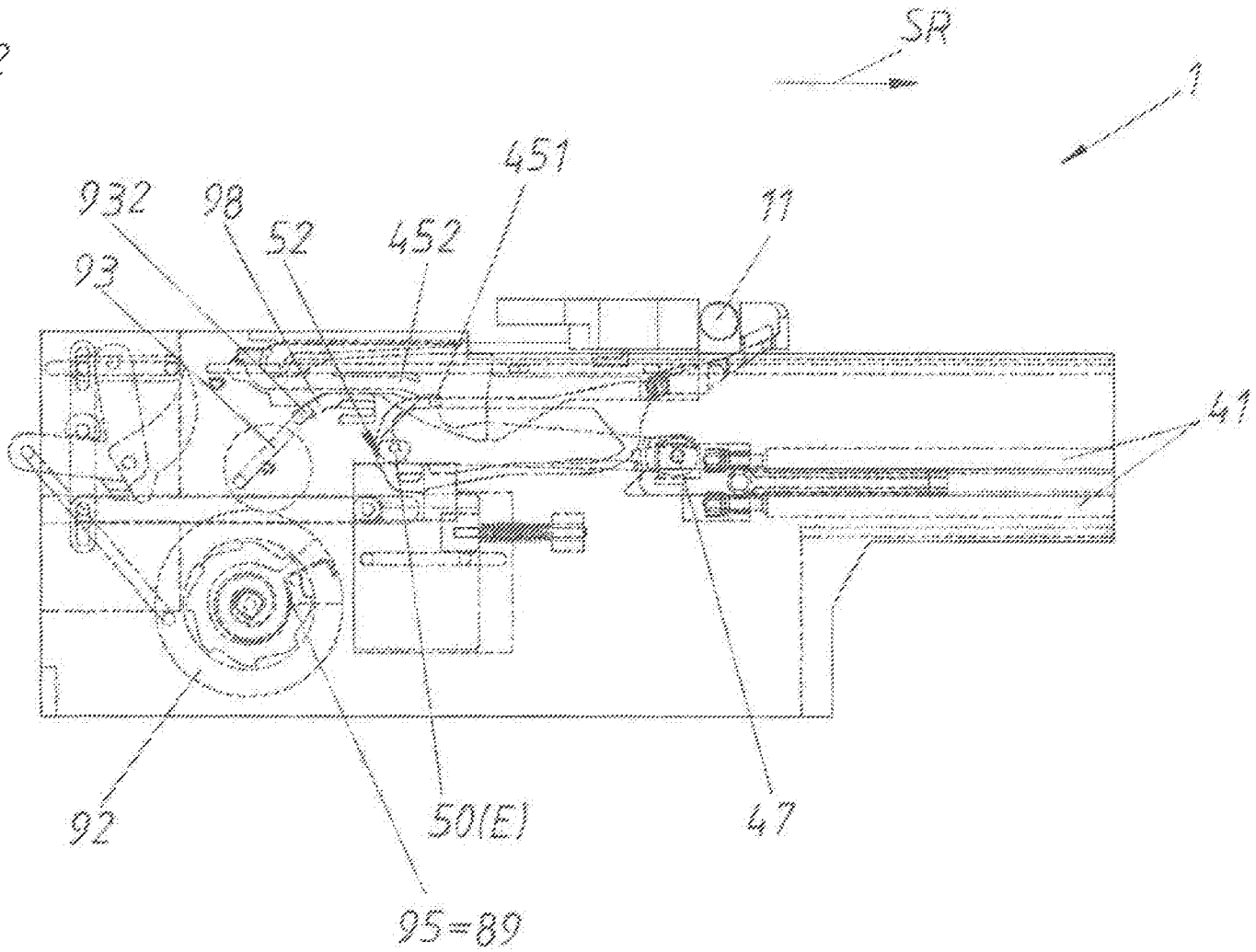

In FIG. 12 the movable furniture part 2 has been moving even further in closing direction SR. During this movement the contact element 451 has moved further relative to the control lever track 452 in the transmission element 70. The control lever 45 has also swiveled still further about its control lever axis 47 counterclockwise by means of the bent section of the control lever track 452, so that the locking pin 50 is released from the pre-locking position VV and the locking pin 50 is now located in the latching movement section E of the guide track 51. As soon as the locking pin 50 is located in this latching movement section E, the force of the ejection force storage member 41 is again acting onto the locking pin 50 in such a way that the locking pin 50 is moved towards the latch recess 52. In FIG. 12 it is also illustrated that the protrusion 932 of the first tensioning lever 93 does no longer contact the underside of the transmission element 70, but the path into the guide track 98 is free. As a consequence, also the locking or movement prevention of the coupling force storage member 83 (return spring 95) is terminated. This means, the return spring 95 is able to relax and moves the tension washer 92 counterclockwise. This rotary movement, however, is damped or braked by the damping mechanism (retardation device 9) which is taking effect between the tension washer 92 and the recess 96.

Figure 13:
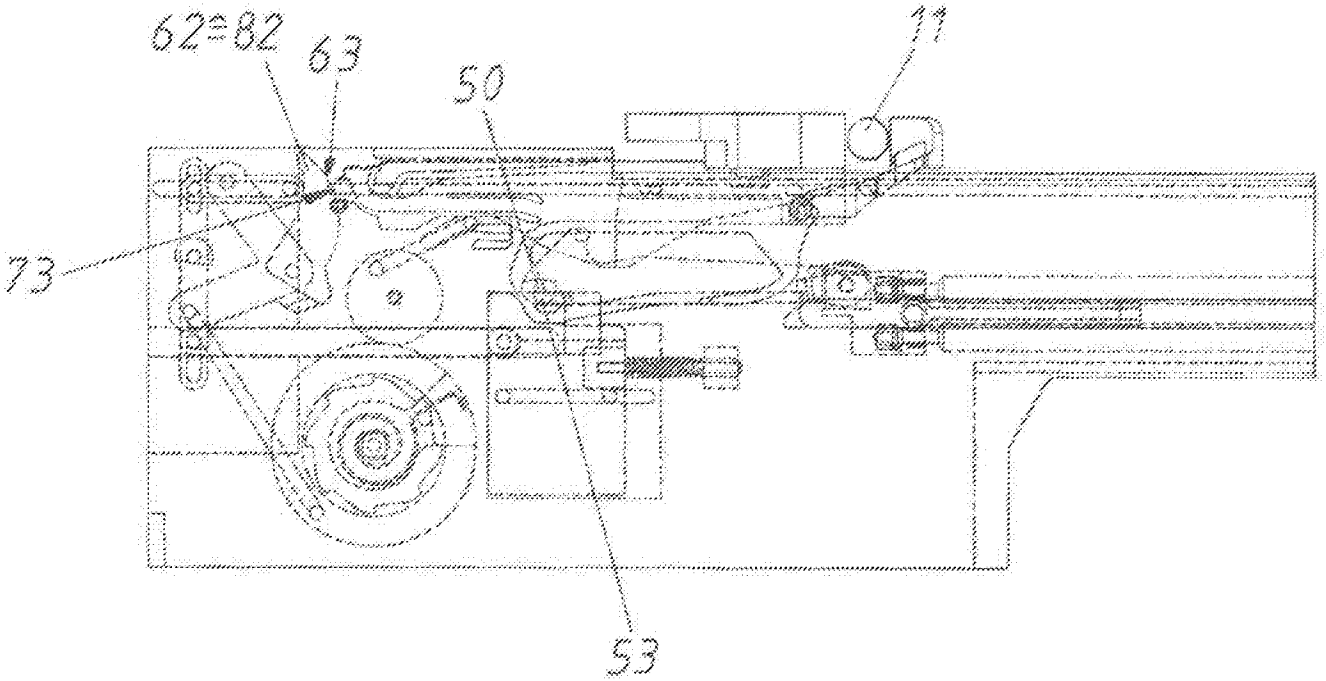

In FIG. 13 the locking device 5 is situated in the locking position VS. In addition, the movable furniture part is situated in the closed position SS. The coupling device 8 is already situated in the coupling position KS. In particular, the closed position SS of the movable furniture part 2 is reached because the movable furniture part 2 (or its front panel 14 respectively) abuts the front buffer 13 of the furniture carcass 10. Depending on the front buffer 13, the transmission device 7 has a certain position relative to the carrier 3. This relative position can vary about 5 mm. This variation is especially depending on tolerances, on clearances between the individual movable components and on the accuracy of the attachment of the entrainment member 11 on the furniture carcass 10 or on the carrier 3 of the movable furniture part 2 respectively. With reaching this closed position SS, anyway, quasi simultaneous the movement of the locking pin 50 into the latch recess 52 is finalized. As a consequence, in FIG. 13 the locking pin 50 abuts the locking element 53. Thus, the locking device 5 is situated in the locking position VS. When the ejection device 4 is situated in the locking position VS the coupling device 8 is movable from the uncoupling position EK into the coupling position KS. In this case, the second coupling element 82 is formed by the compensating chock 62 and its bent surface 63. The first coupling element 81 of the coupling element 8 is formed by the abutting surface 73 formed on the transmission element 70. This abutting surface 73, thus, defines the closed position SS of the movable furniture part 2. The compensating chock 62 (triggering lever 61) is backed towards the abutting surface 73 by the movement of the compensating chock 62 which movement is damped by the retardation device 9. In FIG. 13 the coupling position KS is already illustrated in which the bent surface 63 contact the abutting surface 73. In this coupling position KS the transmission device 7 is motion-coupled with the triggering mechanism 6 by way of the coupling device 8. Depending on the depth of the relative position between the transmission element 70 and the carrier 3, the chock-formed triggering lever 61 can compensate the respective distance. Because of the time delay of the retardation device 9, this compensating movement lasts about 1 to 10 seconds. This time delay is sufficient to have through-pressing protection. This means, in the case of a direct overpressing or through-pressing of the movable furniture part 2 during closing by a user, no direct triggering can take place; rather a user simply has to wait till the coupling device 8 motion-couples the triggering mechanism 6 with the transmission device 7.

Figure 14:
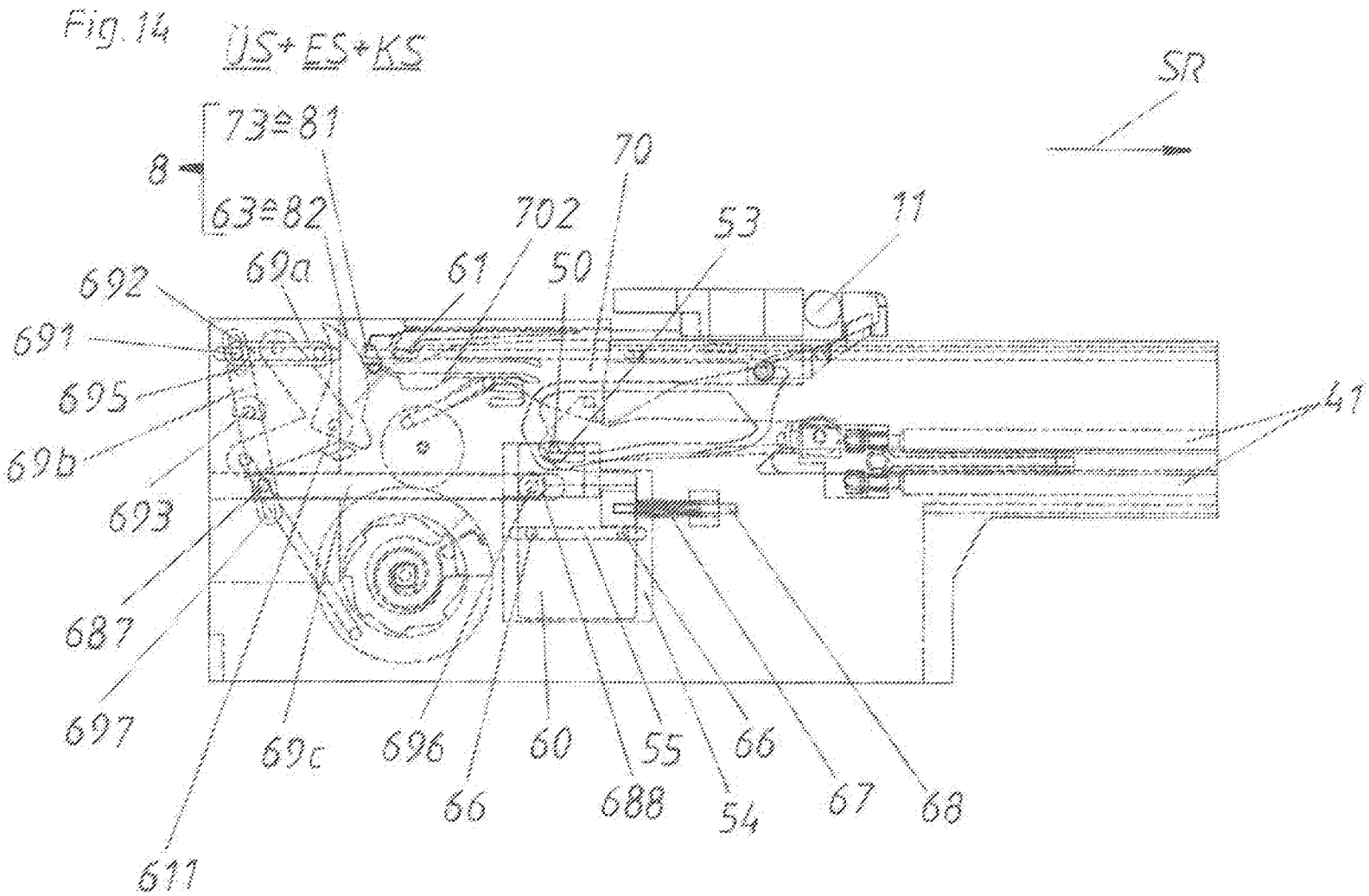

The overpressing position ÜS of the movable furniture part 2 is illustrated in FIG. 14. Moreover, FIG. 14 shows the unlocking position ES of the locking device 5. The coupling device 8 is situated in the coupling position KS. By the movement of the movable furniture part 2 in closing direction SR (in right direction relative to the entrainment member 11), the transmission element 70 of the transmission device 7 is moved almost to the end of the guide track 76. By way of this relative movement of the transmission element 70 to the carrier 3, the abutting surface 73 of the transmission element 70 moves—via the coupling device 8—the triggering lever 61 of the triggering mechanism 6. As the compensating bracket 90 is fixed because of the given coupling position KS, the triggering lever 61 is swiveled counterclockwise about the bearing element 611. The first leverage part 69*a* abuts this triggering lever 61, which is why this first leverage part 69*a* is shifted along the linear guide track 692. One of the protrusions 691 of the first leverage part 69*a* engages in the elongated hole 695 of the second leverage part 69*b*. The second leverage part 69*b* is swiveled counterclockwise about the bearing element 693 by this movement of the first leverage part 69*a*. The third leverage part 69*c* engages via the bearing protrusion 687 into the elongated hole 697 of the second leverage part 69*b*. By the swiveling of the second leverage part 69*b*, thus, the third leverage part 69*c* is shifted. This third leverage part 69*c*, in turn, is connected to the holding pin recess 688 of the triggering element 60 via the holding pin 696. The movement of the transmission element 70, thus, causes—via the triggering mechanism 6—a movement of the triggering element 60 in the recess 54. This movement is guided by the guiding protrusions 66 engaging into the guiding groove 55. The movement of the triggering element 60 is carried out against the force of the spring 67 guided on the guiding mandrel 68. The locking element 53 is arranged or formed on the triggering element 60. By the movement of the triggering element 60 also this locking element 53 is moved. In FIG. 14 this locking element 53 has moved this far that it is no longer possible to hold the locking pin 50 on the locking element 53. Thus, the locking surface 531 formed on the locking element 53 (see also FIG. 21) is—so to speak—pulled away. The locking pin 50, thus, is moved into the ejection section A of the guide track 51 by the force of the ejection force storage member 41. In this position according to FIG. 14 the locking pin 50 abuts a surface 532 of the locking element 53 which is oriented transversely to the locking surface 531 of the locking element 53. As a consequence, the ejection force storage member 41 can further unfold its ejection force and moves—via this surface 532—the locking element 53 and with this locking element 53 also the triggering element 60 against the force of the spring 67 in the recess 54 to the right. The triggering element 60 is moved thus far by the force of the ejection force storage member 41 till the triggering element 60 abuts the end of the recess 54. The locking element 53 has been jointly moved thus far till a small gap between the locking element 53 and the limit stop 56 occurs or is given. Because of the inclined position of the surface 532, the locking pin 50 is able to be released from this surface 532 and moves through the gap between the limit stop 56 of the guide track 51 and the locking element 53 further into the ejection section A of the guide track 51. For details it can be referred to the FIG. 21.

Figure 15:
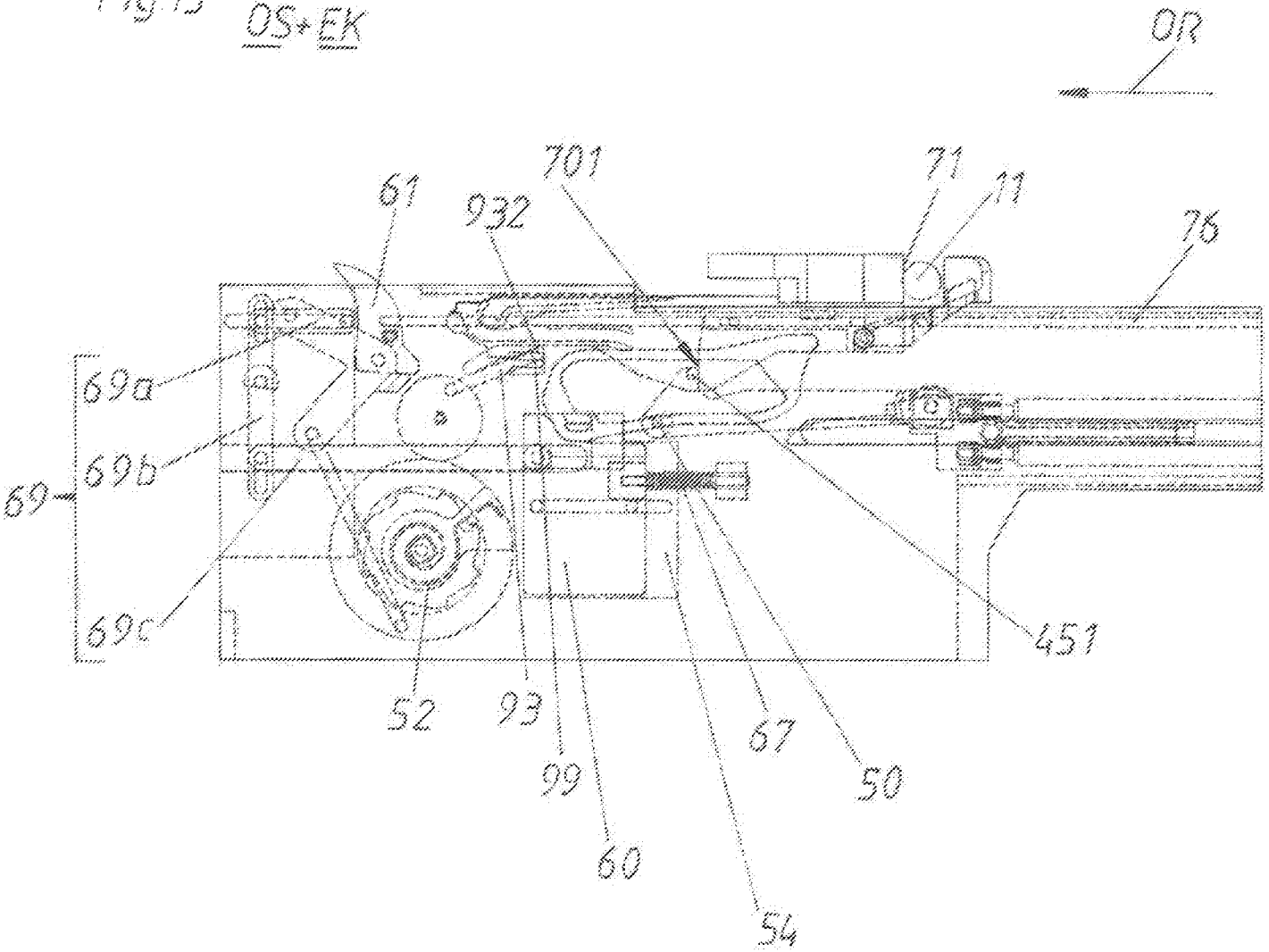

In FIG. 15, then, the open position OS of the movable furniture part 2 is reached. The locking pin 50 has already moved about halfway through the ejection section A of the guide track 51. The contact element 451 of the control lever 45 abuts the ejection limit stop 701 of the transmission element 70. As a consequence, the control lever 45 of the ejection slider 40 takes along the transmission element 70 of the transmission device 7 and, thus, moves the transmission device 7 relative to the carrier 3. As the transmission element 70 contacts the entrainment member 11 via the limit stop 71, a relative movement between the movable furniture part 2 and the furniture carcass 10 is triggered 10. Concretely, the drive device 1 or its ejection device 4 repels from the entrainment member 11 and thereby takes along the movable furniture part 2 in opening direction OR. In this position according to FIG. 15 there is no contact between the locking pin 50 and the locking element 53. Therefore, also the spring 67 can relax and moves the triggering element 60 thus far till this triggering element 60 abuts the left-sided edge of the recess 54. As a consequence, also the whole triggering leverage 69 is again moved correspondingly so that finally also the triggering lever 61 is again moved in the direction of the transmission element 70. The triggering lever 61 is—by the movement of the transmission element 70 heading away—again distanced from the abutting surface, wherefore the uncoupling position EK of the coupling device 8 is given. In order to prevent that the protrusion 932 of the first tensioning lever 93 blocks a movement of the transmission element 70 along the guide track 76, the resilient element 99 is formed in the region of the guide track 98. Thus, when the transmission element 70 passes the protrusion 932, the protrusion 932 abutting a deflection slant 702 is swiveled—together with the first tensioning lever 393—by the corresponding deflection slant 702. The resilient element 99 is pushed downward during this swiveling, whereby the transmission element 70 can pass the protrusion 932. In FIG. 15 the retardation device 9 has returned to its starting position because the return spring 52 has relaxed thus far till the protrusion 932 abuts the end of the guide track 98.

Figure 16:
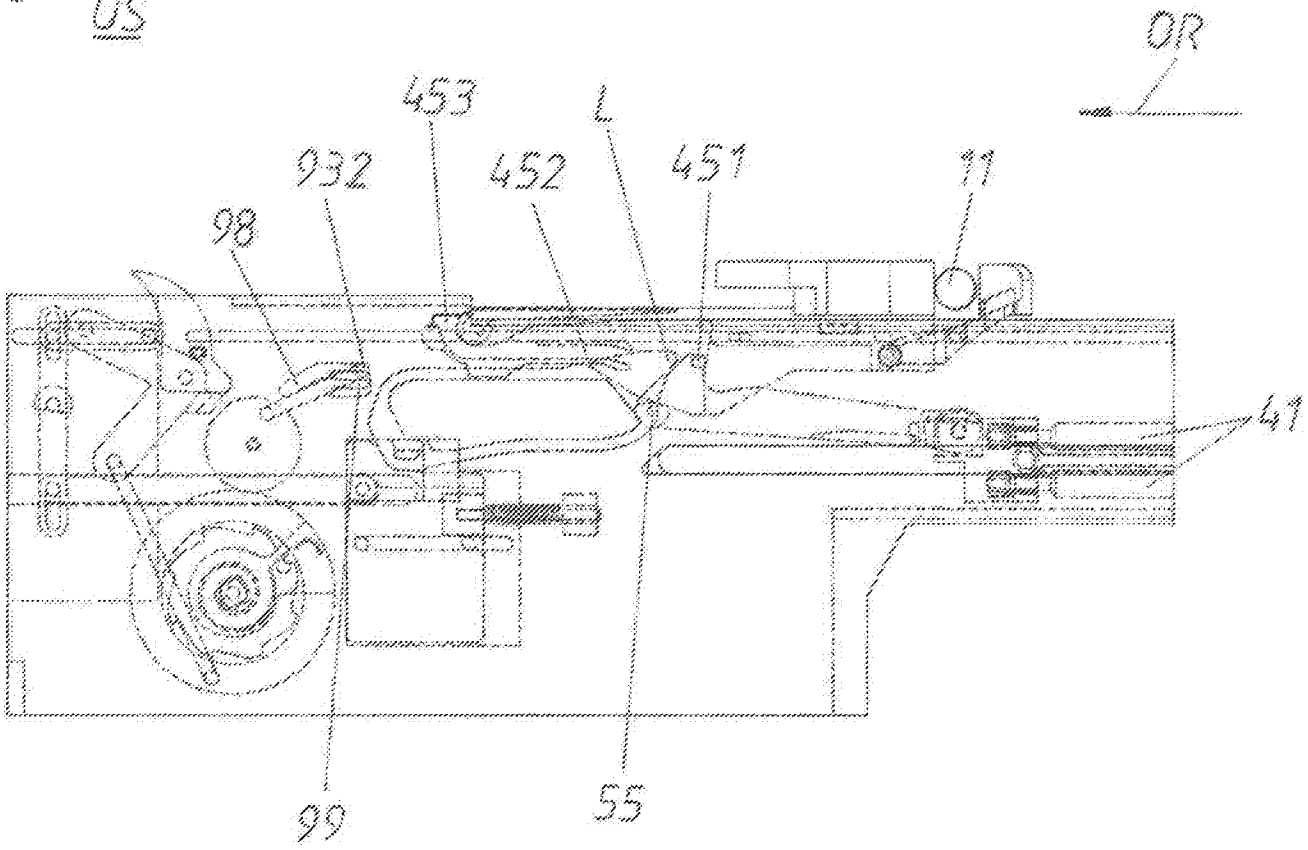
Figure 17:
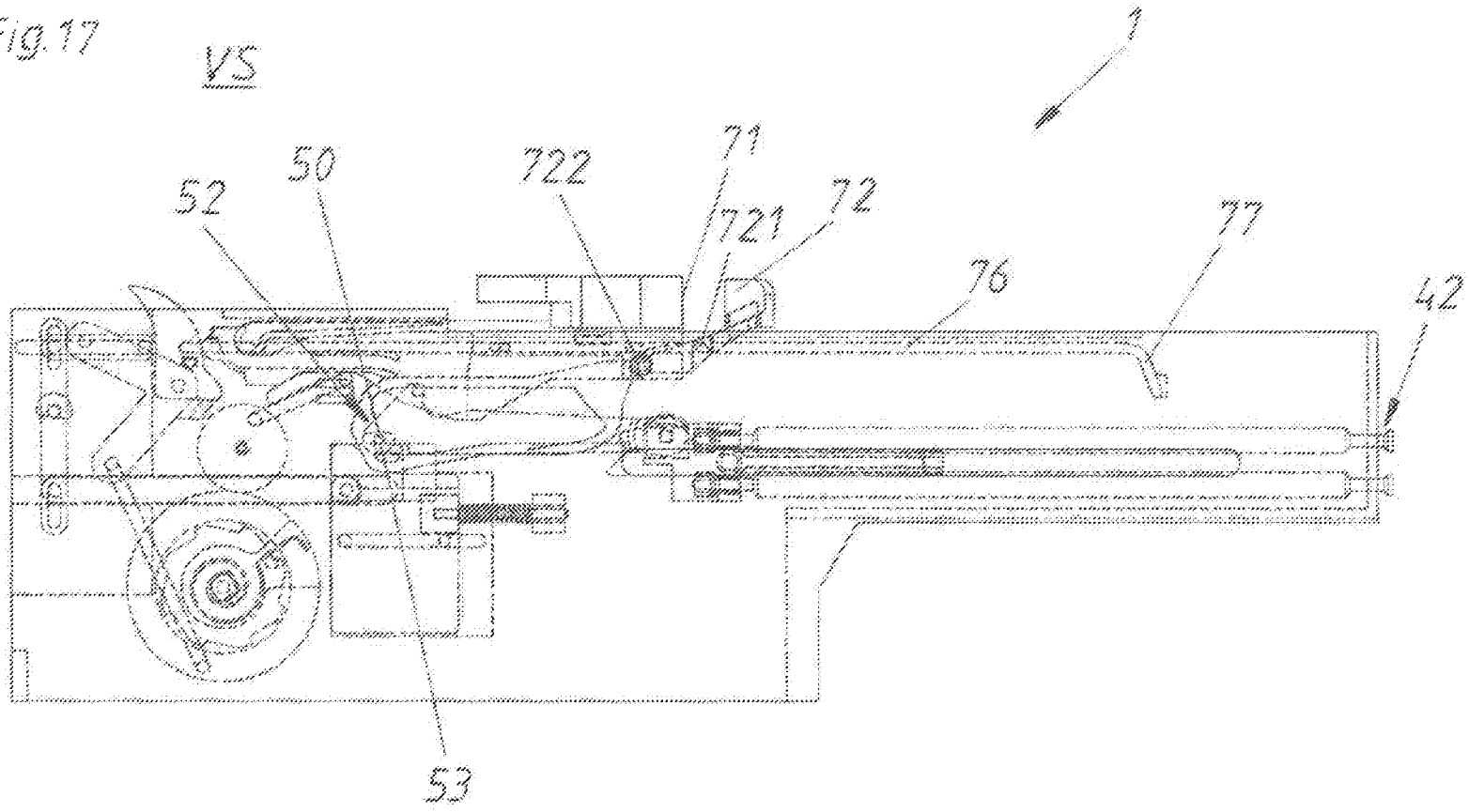

In FIG. 16 the movable furniture part 2 has been moved even further in opening direction OR, wherein this movement has been triggered by the ejection device 4. The ejection force storage member 41 is again relaxed in this position. The protrusion 932 has been moved upwardly by the resilient element 99. When the movable furniture part 2 is then manually pulled further in opening direction OR starting from this position, the contact element 451 of the control lever 45 again arrives in the control lever track 452. An angled section 453 is located on the left-sided end of this control lever track 453. As soon as the contact element 451 arrives in this angled section 453 during a further opening, the control lever 45 is swiveled clockwise so that the locking pin 50 is moved into the bearing section L of the guide track 51. Finally, the starting position according to FIG. 7 is reached again.

FIG. 17 once again shows a drive device 1 in the locking position VS. Here, the whole carrier 3 is shown so that also the first force storage member base 42 as well as the angled end section 77 of the guide track 76 is visible. The catching lever 72 is swiveled about the rotary bearing 722 by the movement of the protrusion 721 into the angled end section 77, said protrusion 721 being formed on the catching lever 72. This leads to the consequence that an entrainment member 11 held between the catching lever 72 and the abutting surface 73 is being released.

Figure 18:
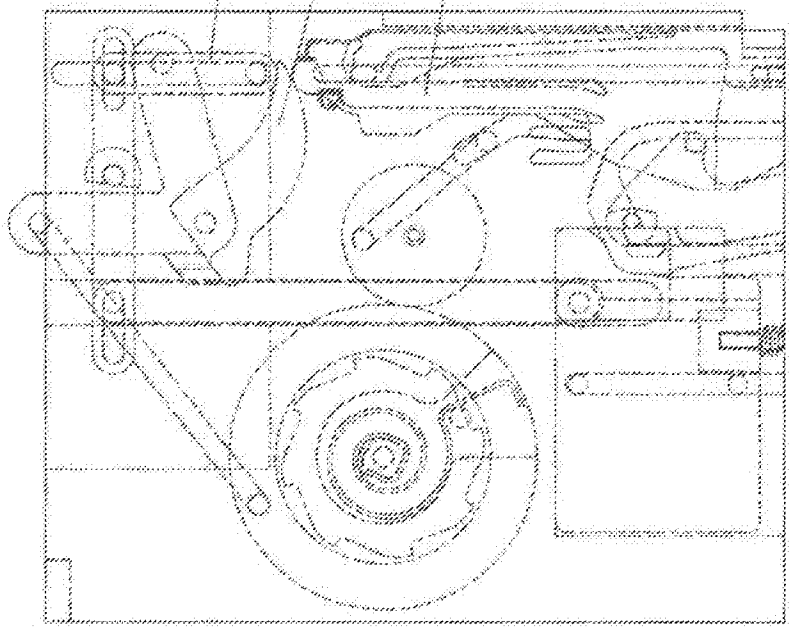
FIGS. 18-20 are top views onto different (extreme) positions of the coupling device according to the first variant.
Figure 19:
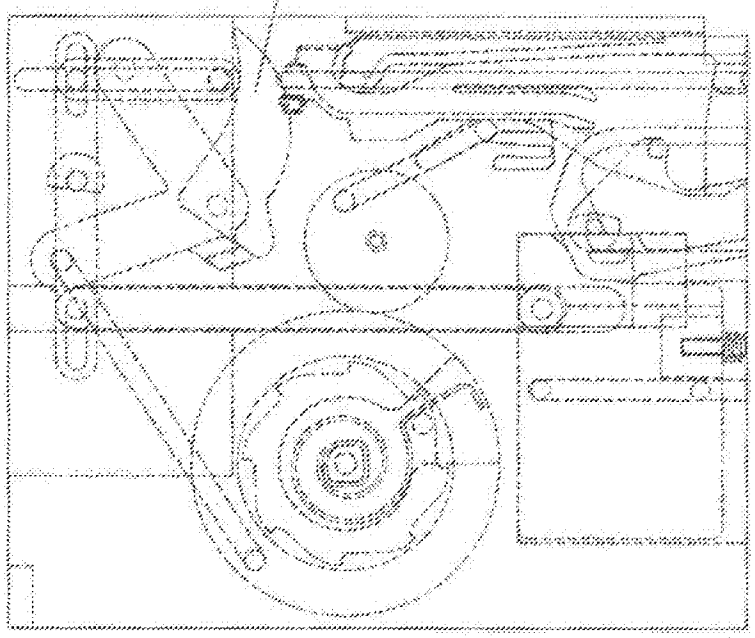
Figure 20:
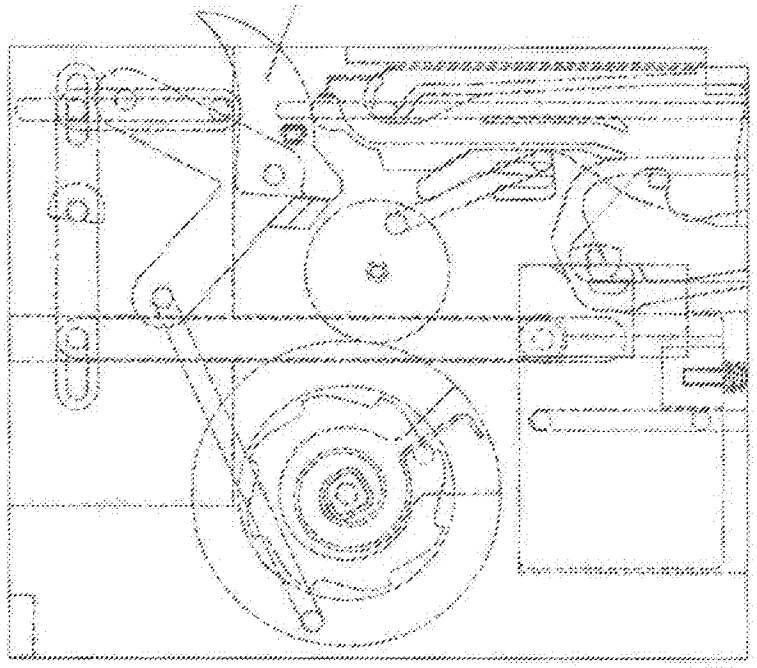

In each of the FIGS. 18 to 20 a closed position SS of the movable furniture part 2 is illustrated, wherein in this closed position SS, however, the relative position between the transmission device 7 and the carrier 3 is different.

FIG. 18 shows the minimum position for a triggering stroke. Here, only the foremost tip of the compensating chock 62 bypasses the distance between the triggering leverage 69 and the abutting surface 73 of the transmission element 70.

In FIG. 19 an approximately central position of the closed position SS is shown. Here, a somewhat broader region of the compensating chock 62 bypasses the distance between the triggering leverage 69 and the transmission device 7.

FIG. 20 shows an extreme position in which the front panel gap and, thus, the triggering stroke have a maximum size. Here, the broadest region of the compensating chock 62 is arranged between the triggering leverage 69 of the triggering mechanism 6 and the abutting surface 73 of the transmission device 7.

Figure 21:
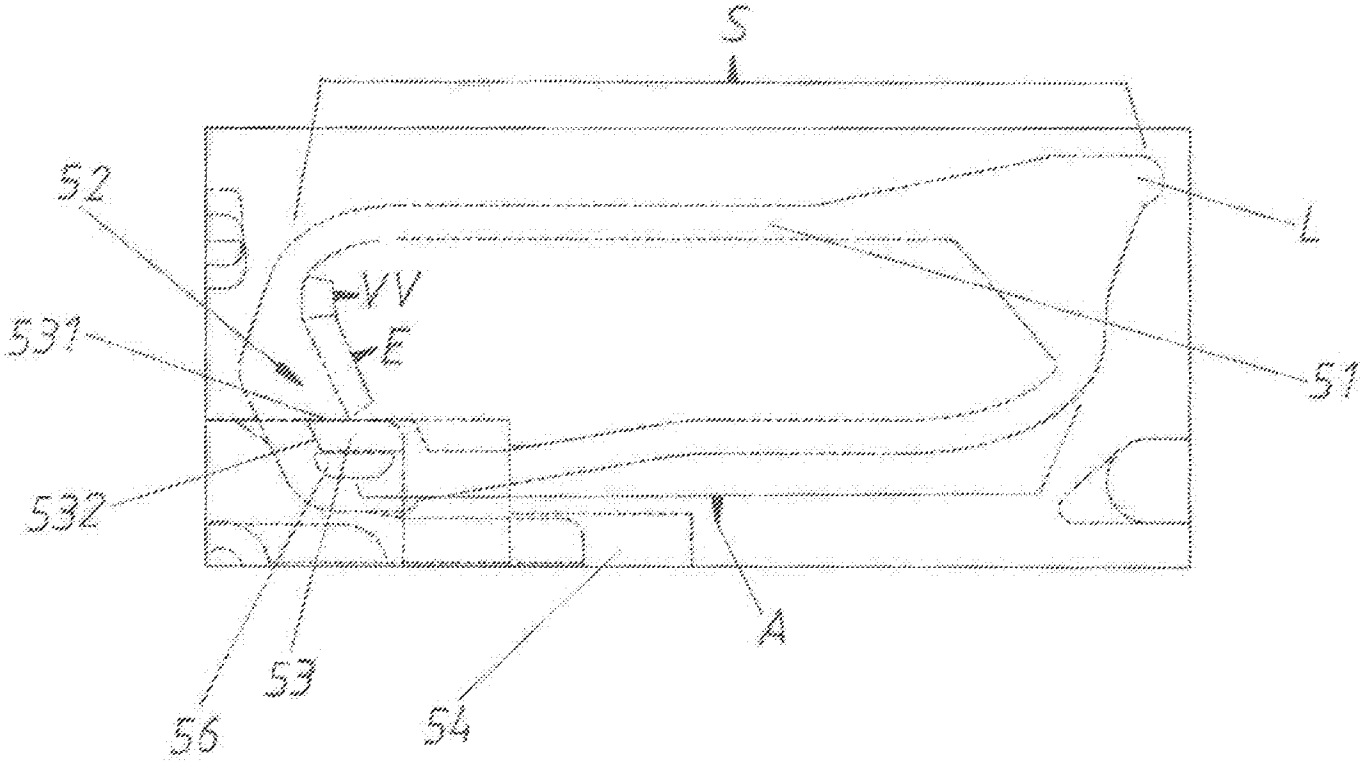
FIG. 21 shows details of the guide track.

In FIG. 21 a detail concerning the guide track 51 of the drive device 1 is illustrated. Accordingly, the most important components are the tensioning section S, the pre-locking position VV, the subsequent latching movement section E and the ejection section A as well as the bearing section L. In addition, also the locking element 53 and its locking surface 531 as well as the surface 532 are apparent. The limit stop 56 is illustrated too. When the locking element 53 has been moved in its maximum right position, the locking pin 50 (not shown here) can pass through between the surface 532 of the locking element 53 and the limit stop 56.

Figure 22:
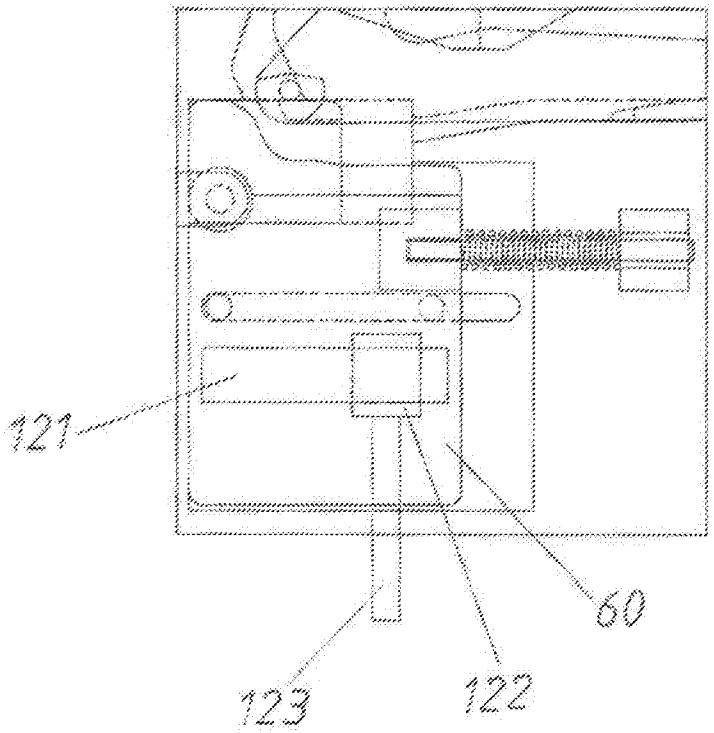
FIG. 22 shows details of the locking and the synchronizing.

FIG. 22 goes into a detail which is important when a drive device 1 is synchronized with an opposing drive device 1 by means of a synchronizing device 12. For that purpose, a toothed rack 121 (here only shown schematically) is arranged on the triggering element 60. This toothed rack 121 meshes with the toothed wheel 122 which, in turn, is connected to the synchronizing rod 123. Thus, this synchronizing rod 123 together with the two toothed racks 121 and the two toothed wheels 122 provided on each of the drive devices 1 forms the synchronizing device 12.

Figure 23:
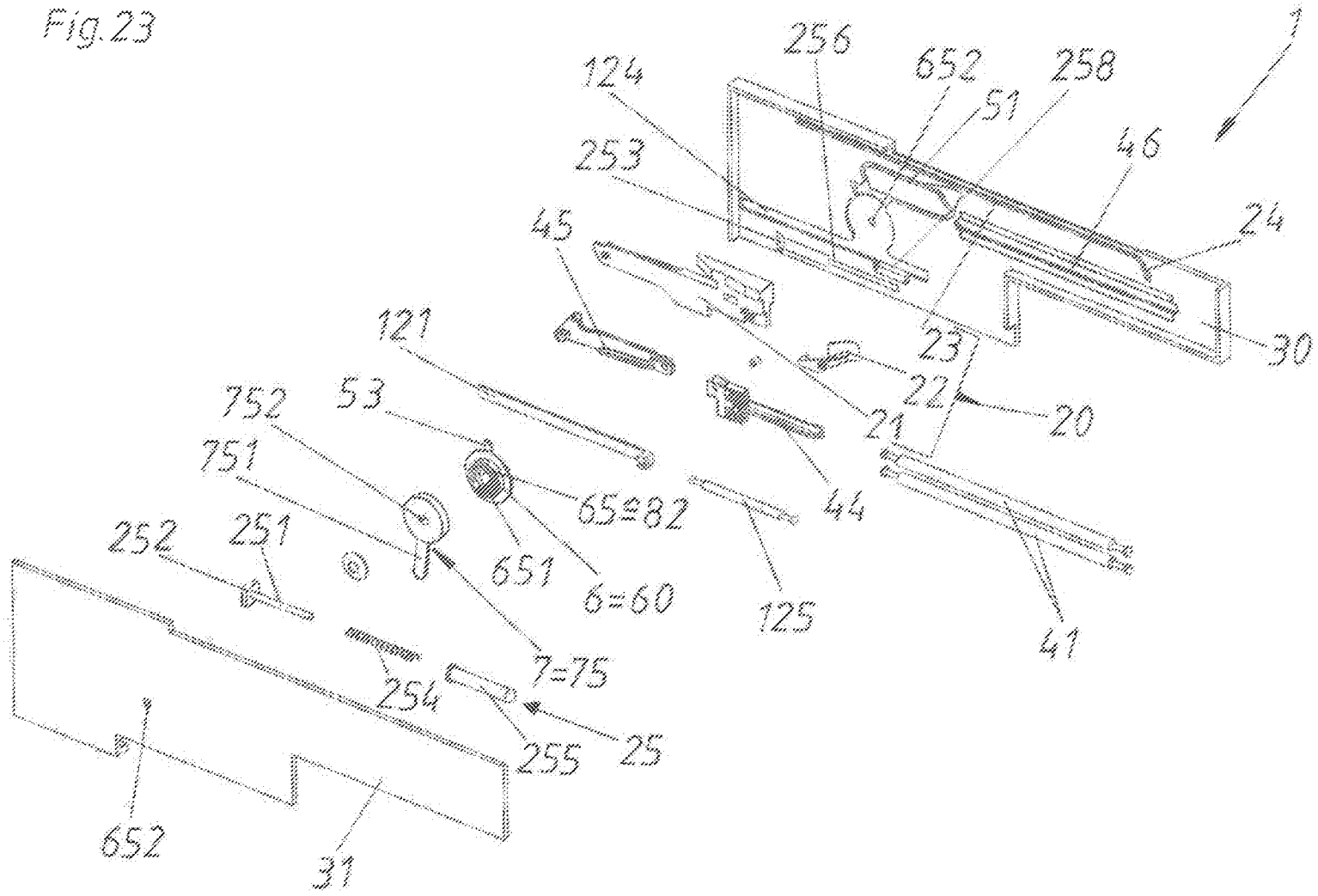
FIGS. 23 & 24 are exploded views of a second variant of the drive device.
Figure 24:
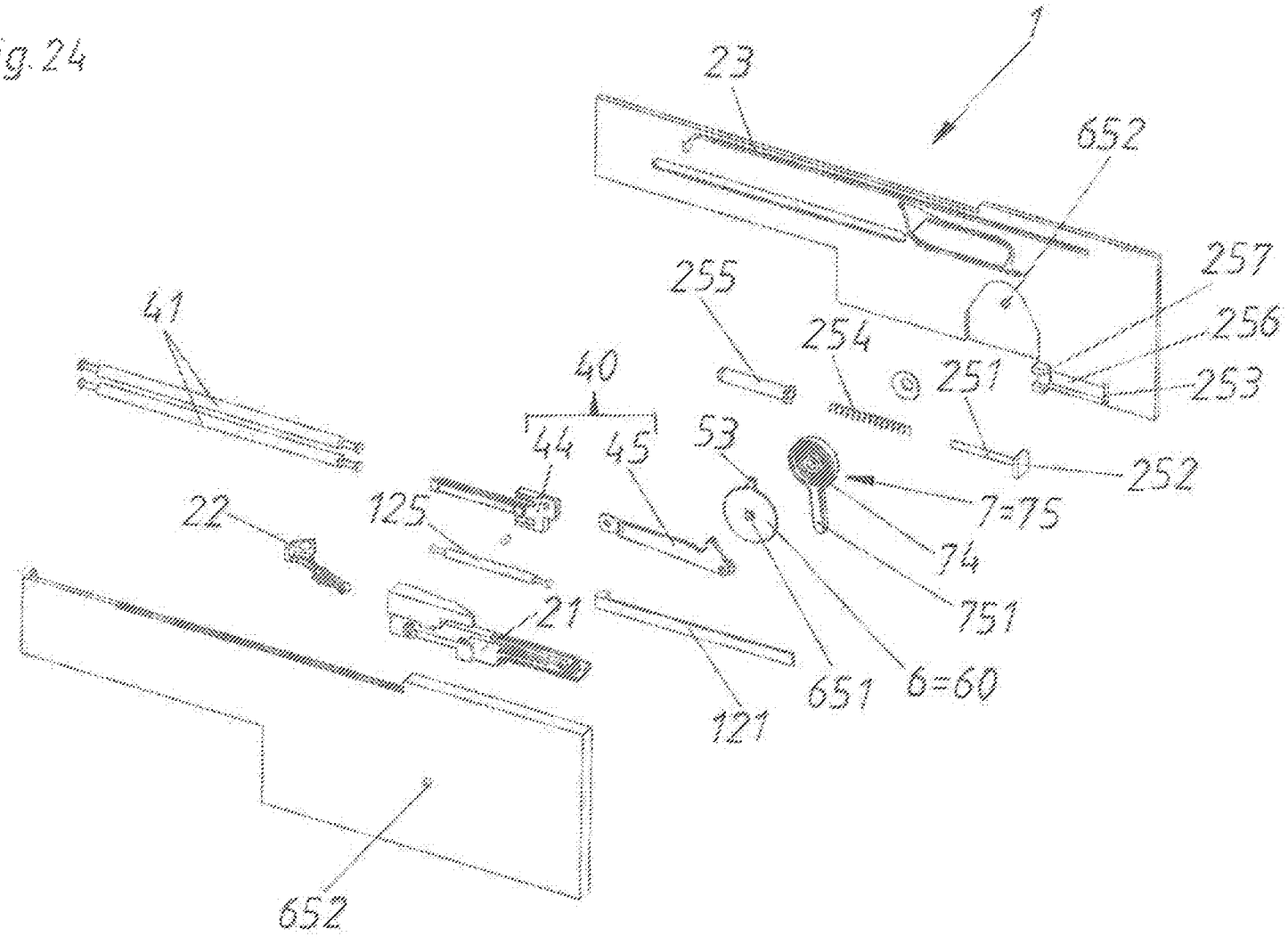

In the FIGS. 23 to 35 a second variant of the drive device 1 according to the present invention is illustrated. Each of the FIGS. 23 and 24 again shows the drive device 1 in an exploded view as seen from different sides. The basic structure of this drive device 1 is again the same as in the first variant. This concerns especially all large parts of the carrier 3 in form of the housing base plate 30 and the housing cover 30, the ejection device 4 with the substantial components ejection force storage member 41, slider base 44 and control lever 45 and the components for coupling the drive device 1 with the entrainment member 11 arranged on the movable furniture part 2. Also the associated guide tracks 51 and 61 are constructively again formed virtually identically. Therefore, especially concerning the operating mode of the ejection device 4 and the associated guide track 51 together with the locking device 5 it can be referred to the description of the first variant.

In the FIGS. 23 and 24 again all components of the drive device 1 according to the second variant are illustrated in an exploded view. Basically, a substantial difference to the first variant is that two different entrainment members are provided (more about this in the following figures). This means that the structural elements which form the transmission device in the first variant are indeed constructively formed in the same way in the second variant; however, they do not function for transmitting the drawer position during overpressing. For other functions, however, these structural components are still important. In this case, thus, the slider is denoted as coupling slider 21, the lever is denoted as coupling lever 22 and the track is denoted as coupling track 23 with the angled end section 24. All parts together form the coupling mechanism 20.

Also in this second variant a triggering mechanism 6 is provided. In this case this triggering mechanism 6 only comprises one structural element. This element corresponds to the triggering element 60 which in this second variant also has the function of the triggering lever 61. The locking element 53 is integrally formed with the triggering element 60. In this second variant, the triggering element 60 is rotatably supported via the bearing element 651 in the corresponding recess 652. The triggering element 60 is partially formed as crown gear 65. This means, the triggering element 60 comprises radially oriented latching teeth 64 on an upper side. These latching teeth 64 of the crown gear 65 form the second coupling element 82 of the coupling device 8.

Also the transmission device 7 only formed as one structural element in this second variant. This transmission device 7 is formed as a rotatable crown gear 75. The transmission lever 751 is integrally formed with this crown gear 75. The crown gear 75 is rotatably supported via the central recess 752 on the bearing element 651 of the triggering element 60. The radially oriented latching recesses 74 are formed on the side of the crown gear 75 which is facing towards the triggering element 60. These latching recesses 74 correspond with the latching teeth 64 of the triggering mechanism 6 and form the first coupling element 81.

For this second variant also a repositioning device 25 for moving the transmission device 7 into the starting position is provided. This repositioning device 25 comprises a holding mandrel 251 which is held via the base 252 in the recess 253 in the carrier 3. In addition, a pressure spring 254 is provided which surrounds the holding mandrel 251 and is guided by this holding mandrel 251. A repositioning sleeve 255—which is closed on one side—is put over the pressure spring 254. This repositioning sleeve 255 is linearly movable supported in the guide track 256 of the carrier 3 and cannot move further away from the recess 253 than until the sleeve limit stop 257. In addition, also a repositioning protrusion 258 is formed on the housing base plate 30. This repositioning protrusion 258 enables that the rotatable crown gear 75—by a contact with the transmission lever 751—is moved axially along the bearing element 651 relative to the triggering element 60 and its crown gear 65.

Also in this second variant there is a possibility for a synchronization with a drive device 1 arranged on the opposite side. For that purpose, the toothed rack 121 of the synchronizing device 12 is slidably guided in the guide track 124. This toothed rack 121 comprises teeth (not shown here) on the side facing towards the triggering element 60, which teeth mesh with teeth (also not shown) circumferentially formed on the triggering element 60. As a consequence, the rotary movement of the triggering element 60 is converted into a linear movement of the toothed rack 121. The toothed rack 121 is force-actuated by the tension spring 125. The tension spring 125 on the one hand is held on the toothed rack 121 and on the other hand is held on the carrier 3.

In this second variant the retardation device 9 is formed as a linear damper with a spring repositioning in the rotary region between the two crown gears 65 and 75.

Figure 24A:
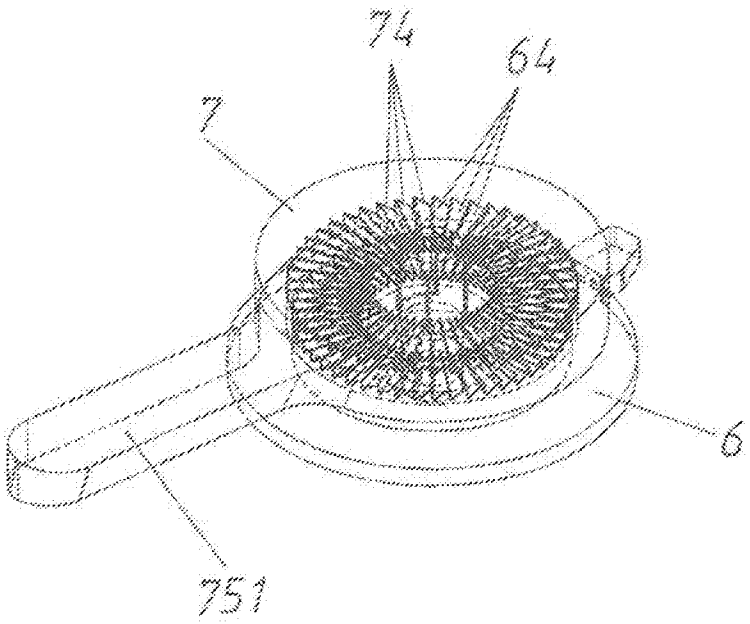
FIG. 24*a* is a perspective view of the details of two crown gears.

The triggering mechanism 6 and the transmission device 7 are illustrated in FIG. 24*a*. The triggering mechanism 6 comprises the crown gear 65 and the transmission device 7 comprises the crown gear 75. The latching teeth 64 are formed on the crown gear 65 of the triggering mechanism 6. Each latching tooth 64 comprises a substantially axially oriented edge and a transversely oriented edge. The transmission device 7 and its crown gear 75 comprise corresponding latching recesses 74. In the illustration according to FIG. 24*a* the latching recesses 74 are exactly abutting the latching teeth 64. If in this position the transmission device 7 is rotated clockwise, also the triggering mechanism 6 is jointly rotated as the axially oriented edges each abut one another. If the transmission device 7 is rotated counterclockwise, the triggering mechanism is not jointly moved. Rather, the transmission device 7 is slightly lifted by the correspondingly formed transverse edges of the latching teeth 64 and latching recesses 74 and is moved according to the ratchet principle along the surface of the crown gear 65 without transmitting a rotary movement onto this crown gear 65 and the triggering mechanism 6.

In FIG. 25 the same starting position of the drive device 1 is shown as in FIG. 7 of the first variant. The movable furniture part 2 is situated in the open position OS. The coupling entrainment member 26 connected to the furniture carcass 10 abuts the coupling slider 21 of the coupling mechanism 20. The coupling lever 22 is still situated in the swiveled position because of the angled end section 24 of the coupling track 23. A further entrainment member is connected to the furniture carcass 10 in this second variant. In this case this entrainment member forms the entrainment member 11 (which will later still contact the transmission device 7). Also this entrainment member 11 is only indicated as a circle. The ejection force storage member is still relaxed. The locking pin 50 is located in the bearing section L of the guide track 51. The lever 751 of the transmission device 7 is located virtually in the maximum right swiveled position. In this position the transmission lever 751 is supported on the repositioning protrusion 258. As a consequence, the crown gear 75 is axially distanced from the crown gear 65. As the crown gear 75 forms the first coupling element 81 and the crown gear 65 forms the second coupling element 82, the coupling device 8 is situated in the uncoupling position EK. The pressure spring is situated in a relatively relaxed position and presses the repositioning sleeve 255 against the transmission lever 751.

Figure 26:
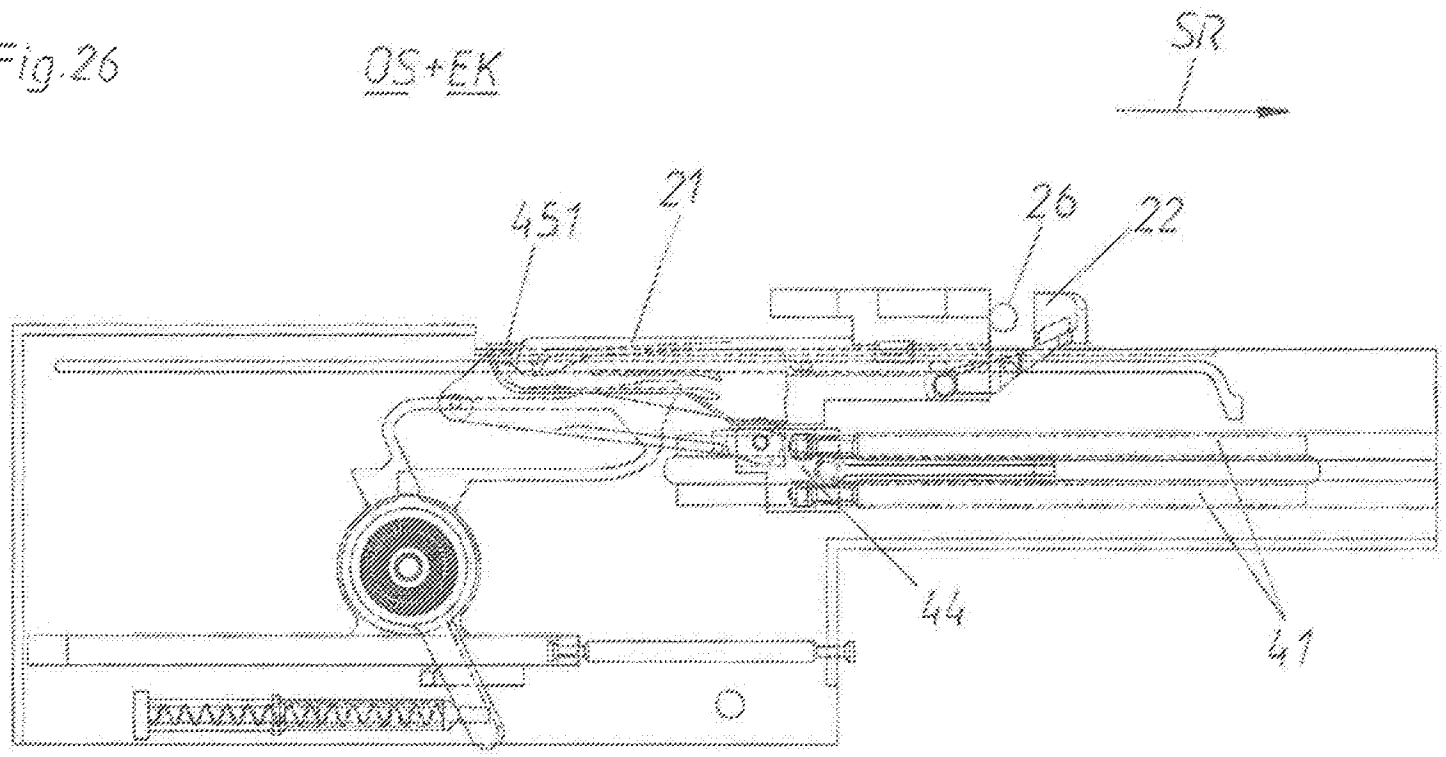

In FIG. 26 the movable furniture part 2 has been moved by pushing further in closing direction SR. As the coupling slider 21 abuts the contact element 451 of the control lever 45, the ejection force storage member 41 is tensioned via the control lever 45 and the slider base 44. The coupling lever 22 has been moved away from the angled end section 24. As a consequence, the coupling entrainment member 26 is now located between the coupling lever 22 and the coupling slider 21.

Figure 27:
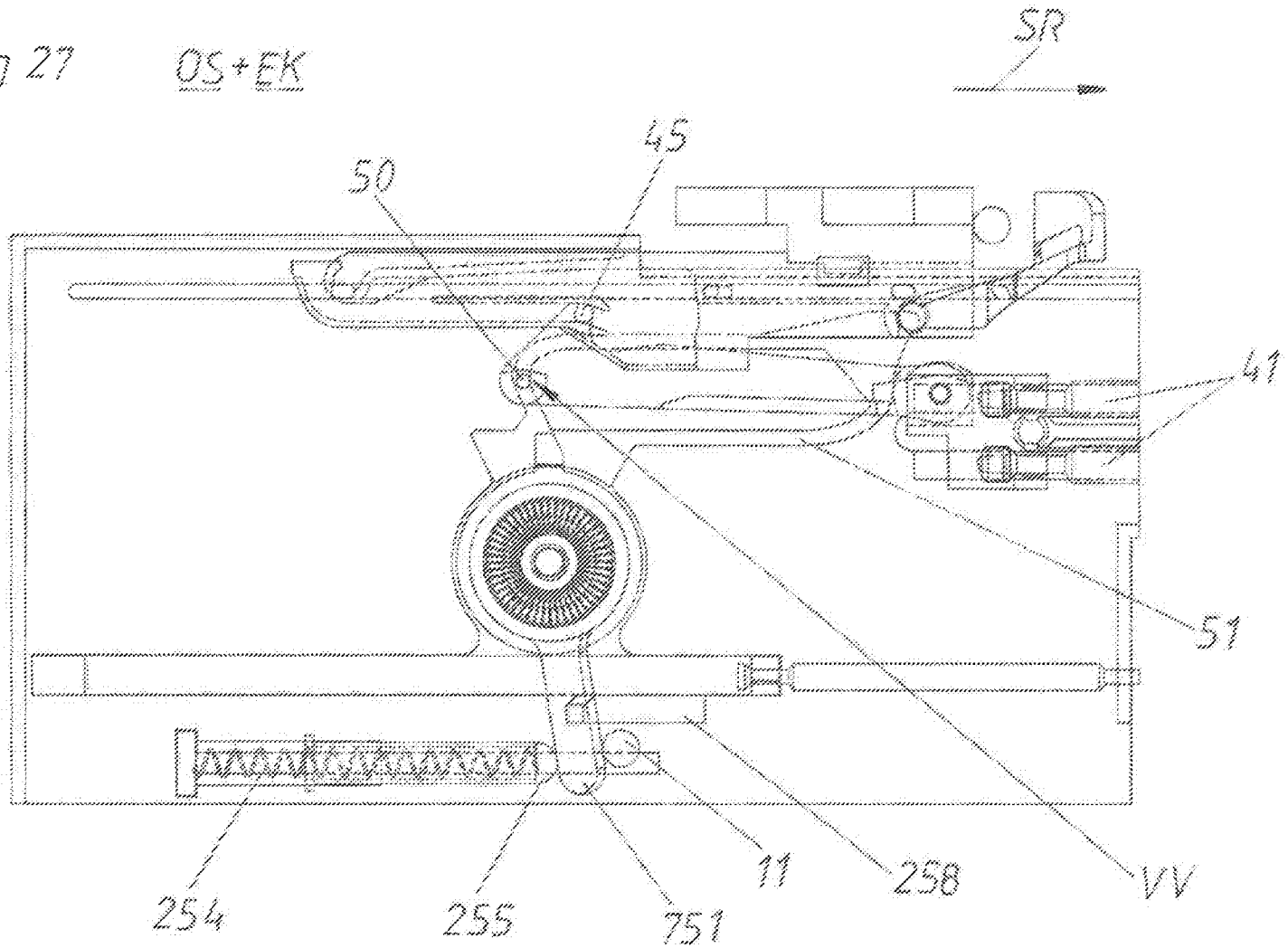

In FIG. 27 the movable furniture part 2 has been moved further in closing direction SR. In the meantime, the contact element 451 of the control lever 45 has been deflected because of the track formed in the coupling slider 21, whereby the locking pin 50 is located in the pre-locking section VV of the guide track 51. The ejection force storage member 41 is now fully tensioned. The entrainment member 11 has already contacted the transmission lever 751 of the transmission device 7 and has already swiveled the transmission device 7 clockwise. As the transmission device 7 is still lifted because of the repositioning protrusion 258, this rotary movement of the transmission device 7 is not (yet) transmitted to the triggering mechanism 6. A transmission, however, takes place—namely the transmission of the swiveling movement of the transmission device 7 onto the repositioning sleeve 255. As a consequence, the pressure spring 24 is already partially loaded.

Figure 28:
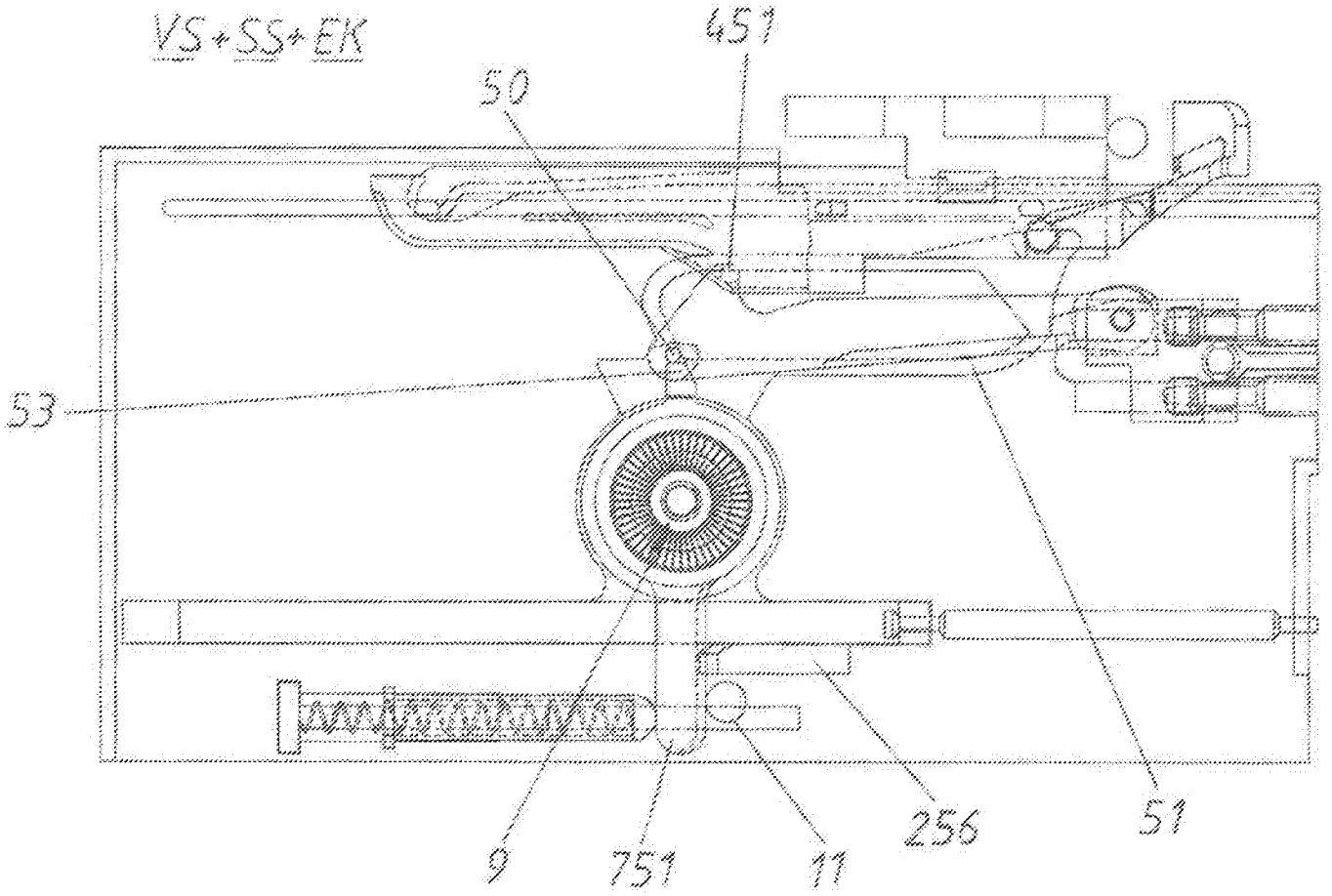

In FIG. 28 the movable furniture part 2 has been moved thus far in closing direction SR that also the contact element 451 has been released from the track of the coupling slider 21, whereby now also the locking pin 50 is located in the latch recess 52 of the guide track 51. This means, the locking position VS of the locking device 5 is reached. The locking pin 50 abuts the locking element 53 jointly forming the latch recess 52, the locking element 53 being integrally formed with the triggering element 60 of the triggering mechanism 6. As now also the movable furniture part abuts the front buffer 13 (not illustrated here) in a flush manner, the closed position SS of the movable furniture part 2 is given. The entrainment member 11 has further swiveled the transmission lever 751 thus far that the transmission lever 751 is no longer located above the repositioning protrusion 258. As a consequence, the transmission device 7 together with the first coupling element 81 can move towards the triggering mechanism 6 together with the second coupling element 82. This movement along the axis formed by the bearing element 651 can be braked or damped respectively by the retardation device 9 (here only generally indicated). This damped movement can last several seconds. Thus, a through-pressing protection is reached by the retardation device 9. This means, when a user is directly through-pressing the movable furniture part 2 instead of leaving the movable furniture part 2 in the closed position SS, an unlocking is not immediately carried out; rather, this unlocking is only possible upon expiry of a certain time defined by the retardation device 9. However, the coupling position KS is reached as soon as this time is expired or the corresponding path is travelled.

Figure 29:
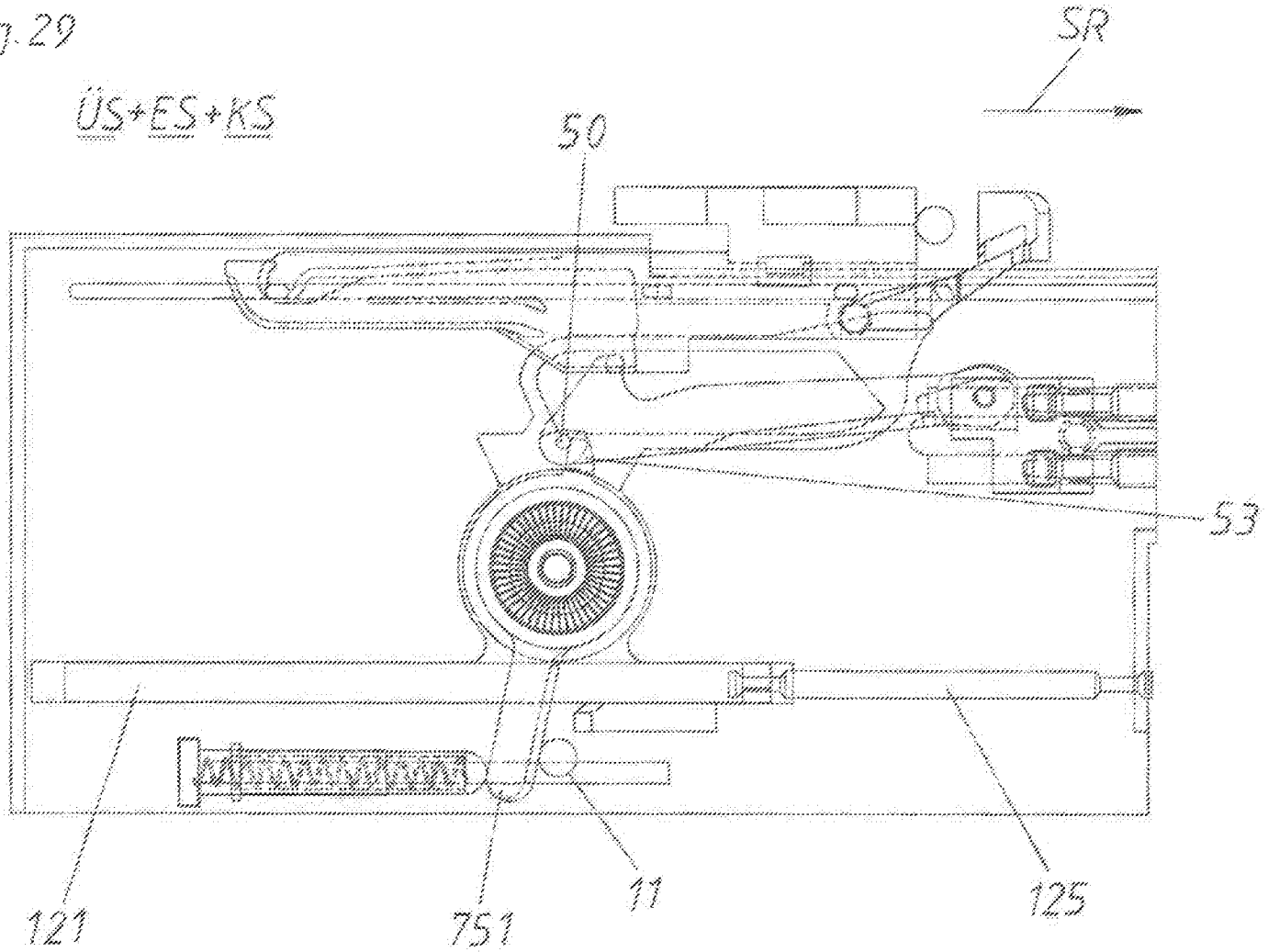

The overpressing position ÜS of the movable furniture part 2 is illustrated in FIG. 29. When the movable furniture part 2 is pushed in closing direction SR—if the coupling position KS has been reached previously—the transmission device 7 is further rotated clockwise via the entrainment member 11 and by the transmission lever 751. As the coupling position KS of the coupling device 8 is given, also the triggering mechanism 6 is jointly rotated clockwise. As a consequence, also the locking lever 53 is swiveled and is disengaged from the locking pin 50. Thus, the locking pin 50 is no longer locked by the locking element 53. The ejection force storage member 41 can unfold its force and moves the locking pin 50 into the ejection section A. Also the toothed rack 121 has been moved linearly (via the teeth which are not illustrated) because of the rotation of the triggering mechanism 6. This linear movement can be transmitted by means of a synchronizing device 12 (not shown here) onto an opposing drive device 1 which is preferably formed mirror-symmetrically. The tension spring 125 is tensioned during this movement.

Figure 30:
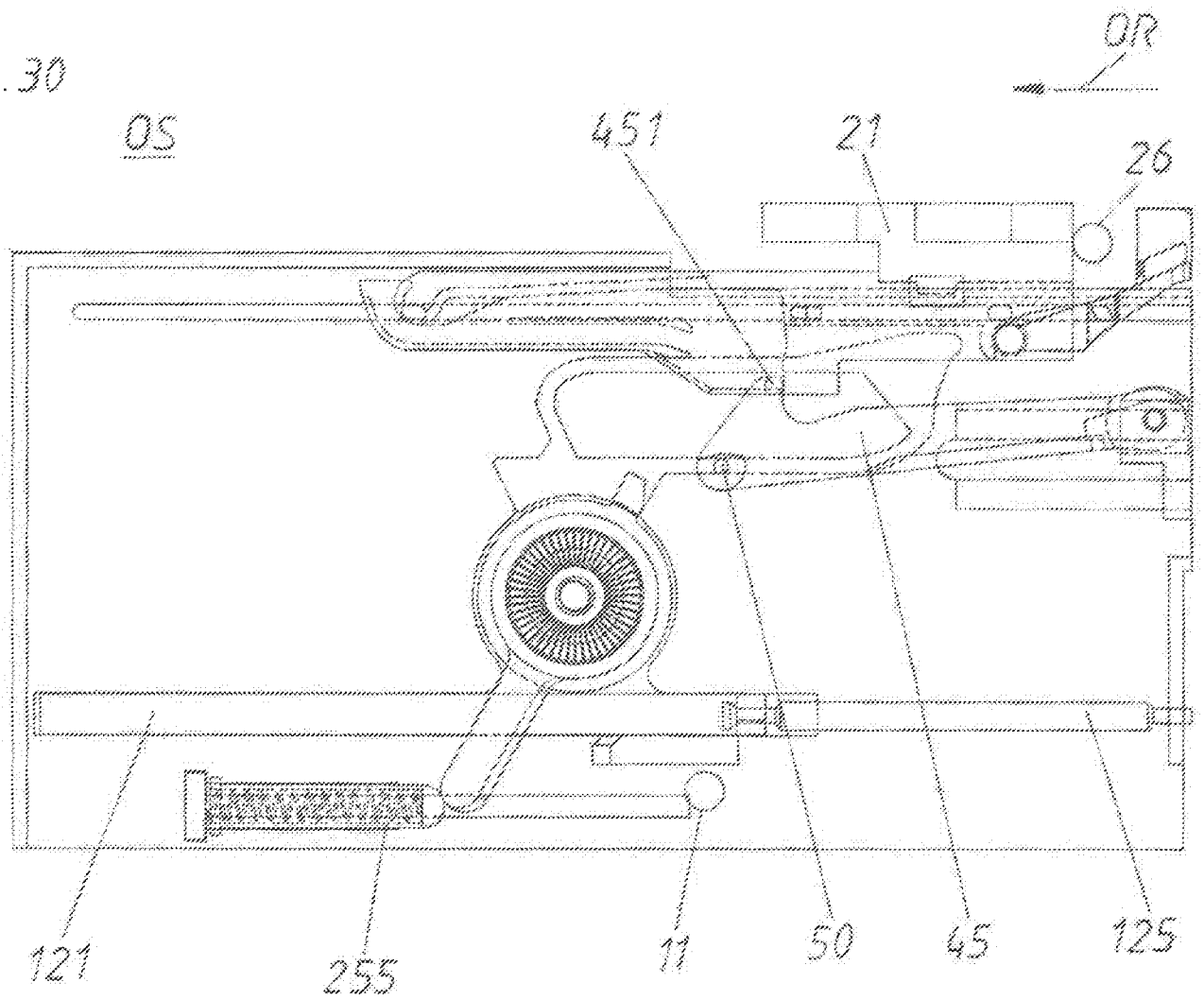

In FIG. 30 the open position OS is reached. In fact, if a user releases the movable furniture part 2 in the overpressing position ÜS according to FIG. 29, the ejection force storage member 41 can unfold its force and moves—via the control lever 45 and its contact element 451—the coupling slider 21. As this coupling slider 21 abuts the coupling entrainment member 26 arranged on the furniture carcass 10, the drive device 1, so to speak, pushes itself away from this coupling entrainment member 26 into opening direction OR. The triggering element 60 has been further rotated clockwise by the locking pin 50 moving through the ejection section A, whereby the toothed rack 121 and also the repositioning sleeve 255 reach the leftmost position. As soon as there is no more contact between the locking pin 50 and the locking element 53, the tension spring 125 and the pressure spring 254 can relax.

Figure 31:
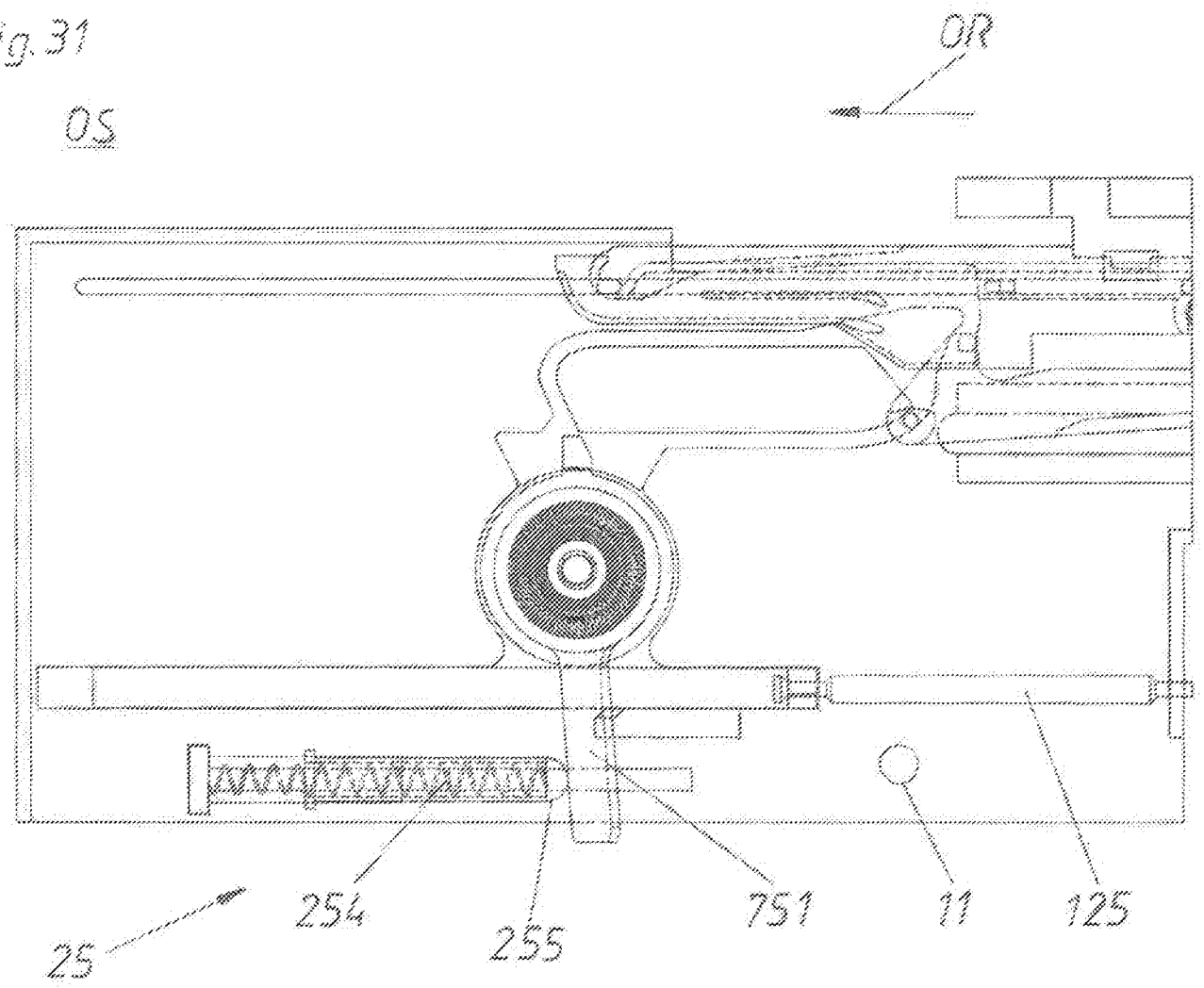

As a consequence—as illustrated in FIG. 31—the transmission lever 751 is again moved counterclockwise by means of the pressure spring 254 and the repositioning sleeve 255 of the repositioning device 25. In this case, however, the triggering element 60 is not jointly moved. This triggering element 60 is moved into its starting position because of the relaxation of the tension spring 125. The repositioning movement of the repositioning device 25 can also be used for loading the retardation device 9.

Figure 32:
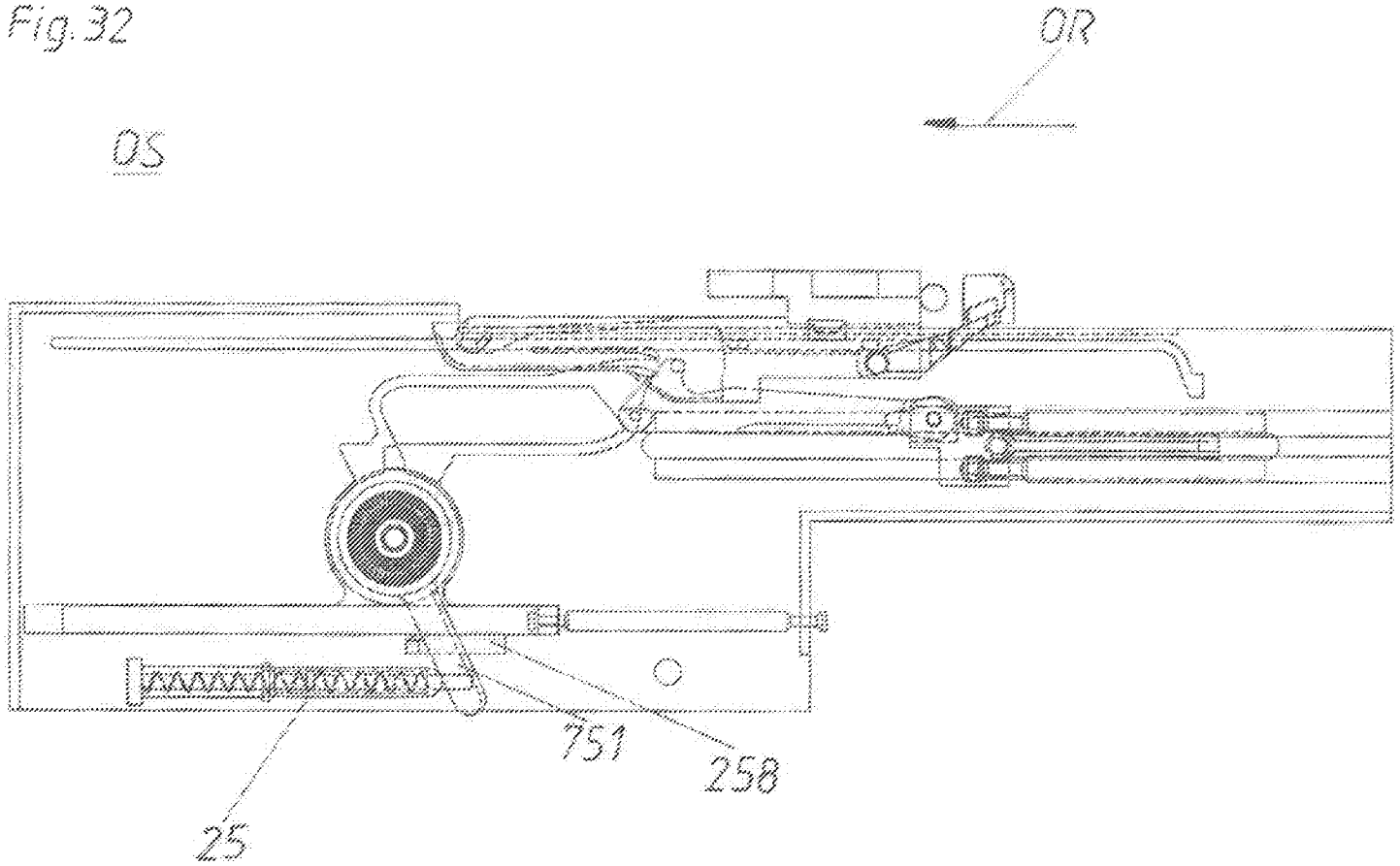

In FIG. 32 the repositioning device 25 has swiveled the transmission lever 751 again to the rightmost position. As a consequence, the transmission device 7 has been lifted again by the repositioning protrusion 258. The two coupling elements 81 and 82, thus, are again distanced from each other. In FIG. 32 also the ejection force storage member 41 is again relaxed.

By a further manual pulling of the movable furniture part 2 in opening direction OR, the contact element 451 is further swiveled clockwise by the track formed in the coupling slider 21, so that finally the locking pin 50 again reaches the starting position in the bearing section L according to FIG. 26.

Figure 33:
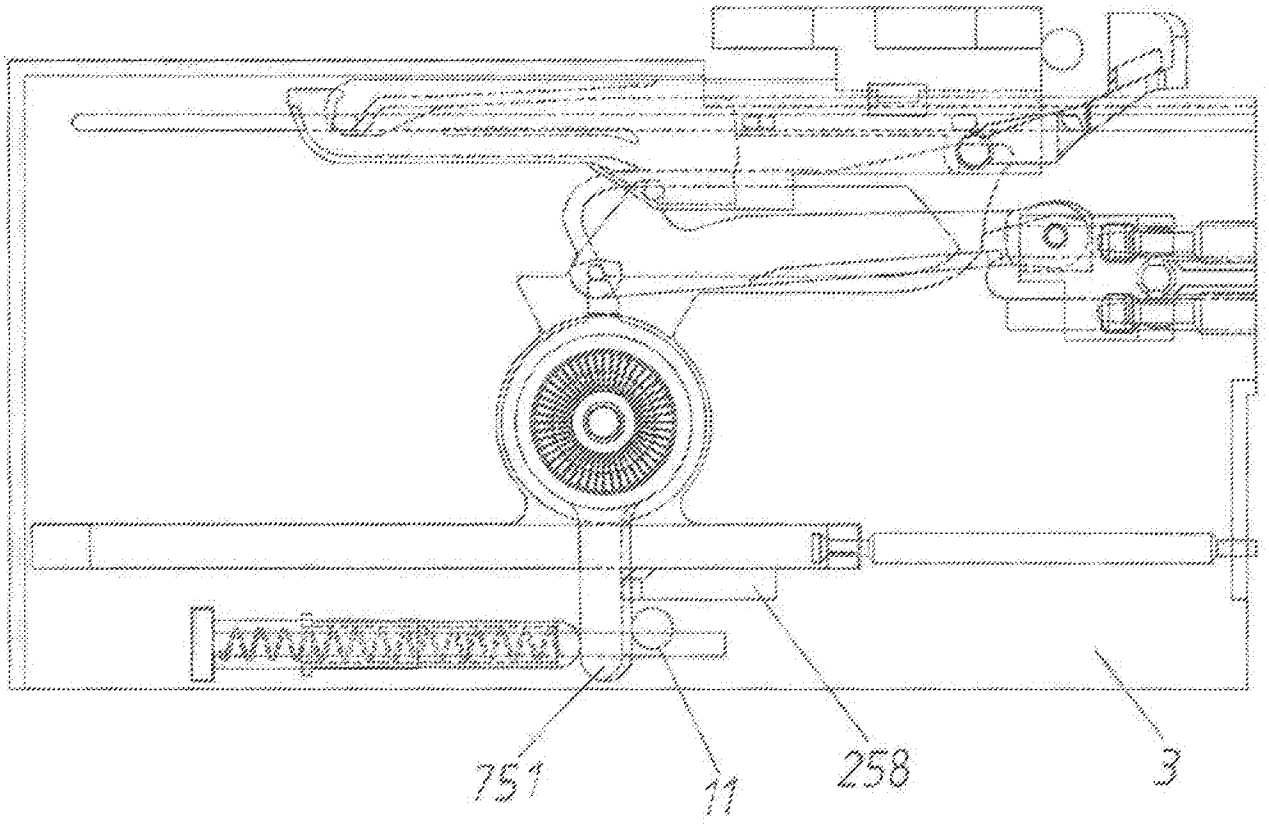
FIGS. 33-35 are top views onto different (extreme) positions of the coupling device according to the second variant.
Figure 34:
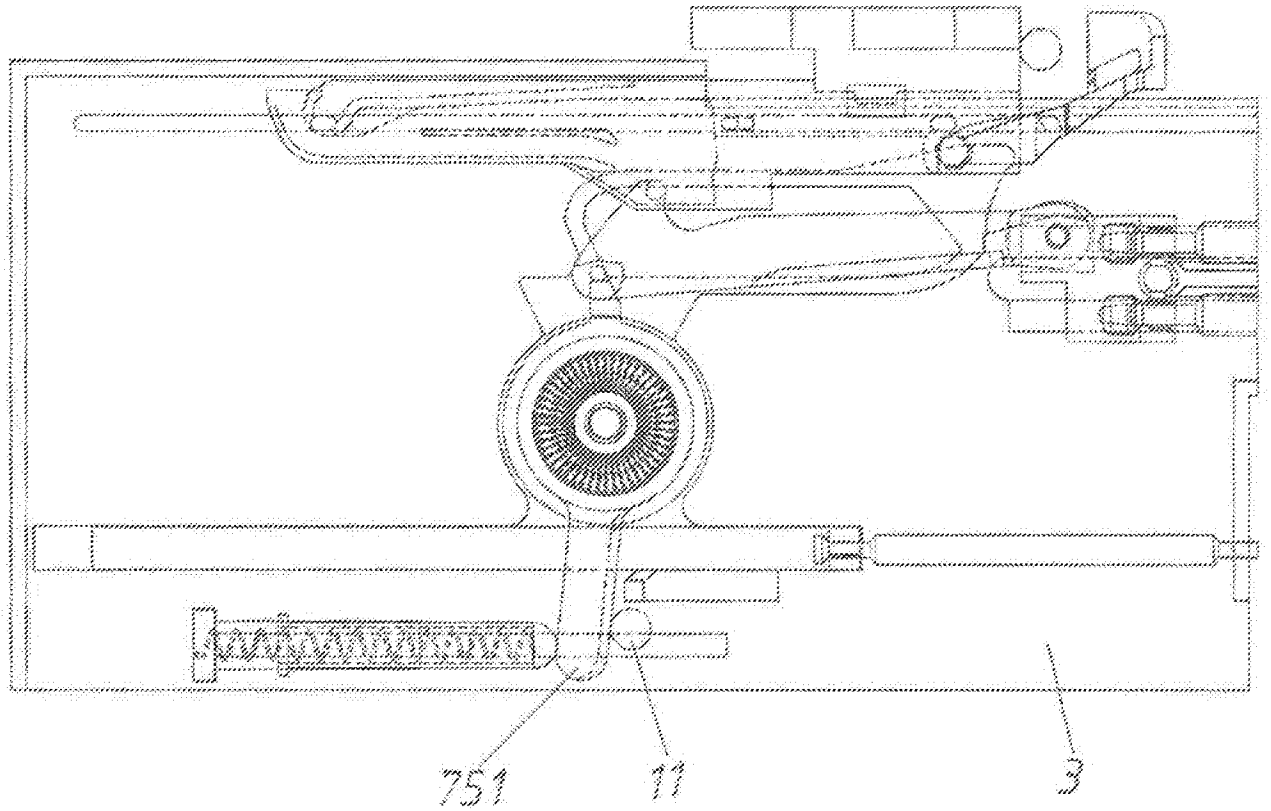
Figure 35:
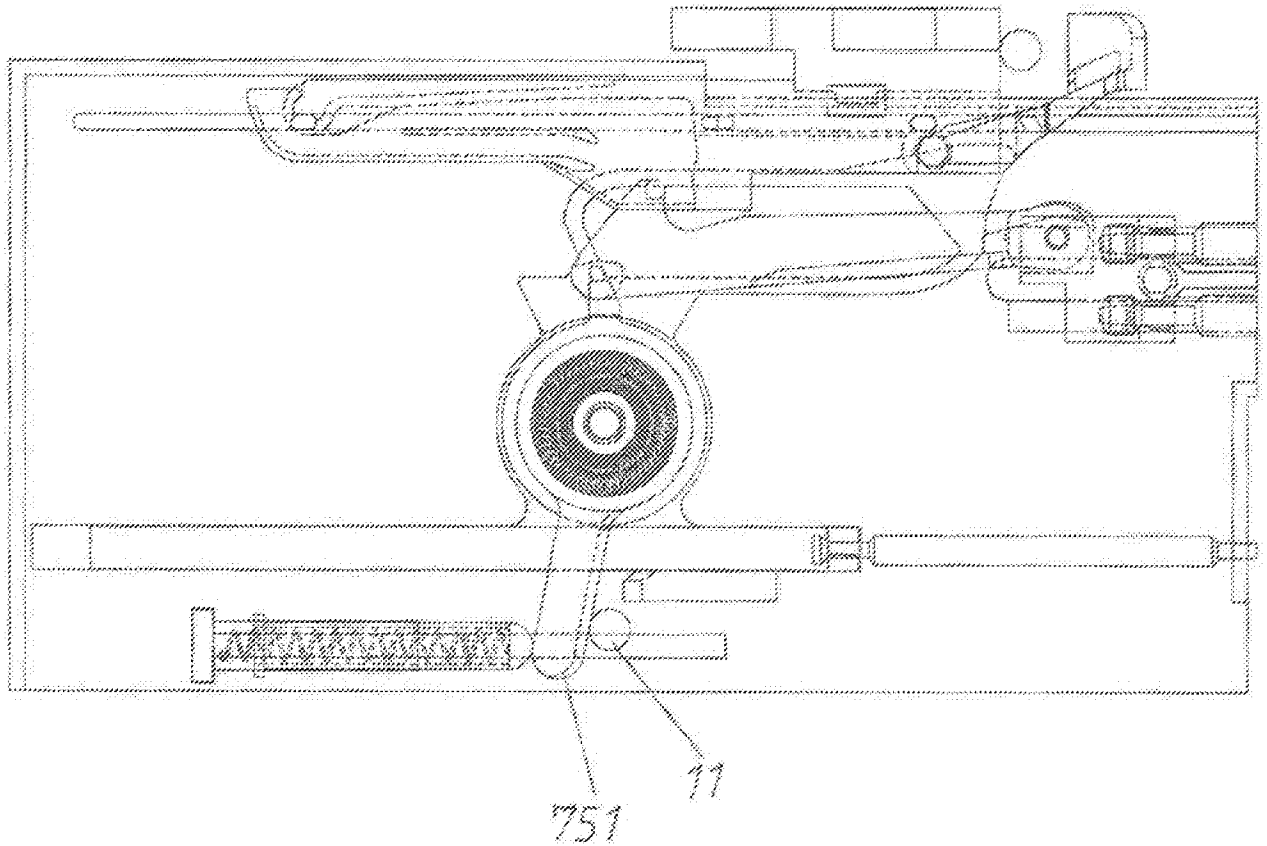

The FIGS. 33, 34 and 35 each show a closed position SS, wherein each relative position between the entrainment member 11 and the carrier 3 is different.

In FIG. 33, accordingly, a minimum position is given. This means, the transmission lever 751 has just been moved thus far that the transmission lever 751 is no longer lifted by the repositioning lever 258.

In FIG. 34 there is an approximately central position.

FIG. 35 shows another extreme position. As a consequence, a tolerance range of about 5 mm between the two extreme positions of the closed position SS is covered.

Concerning the second variant it shall be generally noted that the teeth on the crown gears 65 and 75 block the movement of the two crown gears 65 and 75 to each other independent of the exact position in the closed position SS. Thus, this is a mechanical construction which as a whole can be triggered on each position. The maximum possible "inaccuracy" which can occur (by the size of the teeth) is negligible, as the front buffer 13 always guarantees a triggering stroke of about 2 mm and, thereby, also in the case of a maximum "inaccuracy" there is enough effective overpressing stroke in order to trigger the drive device 1.

Figure 36:
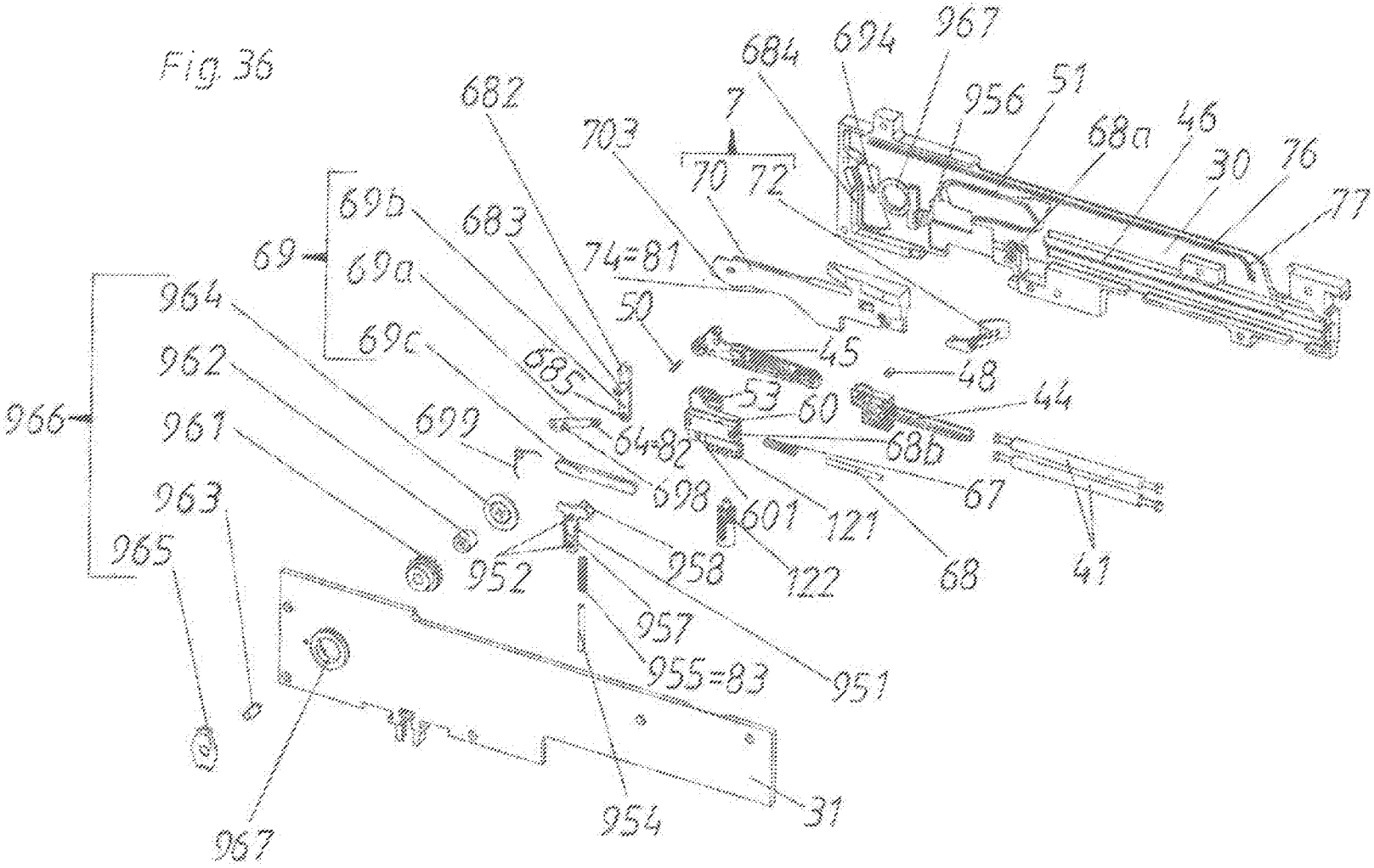
FIGS. 36 & 37 are exploded views of a third variant of the drive device.
Figure 37:
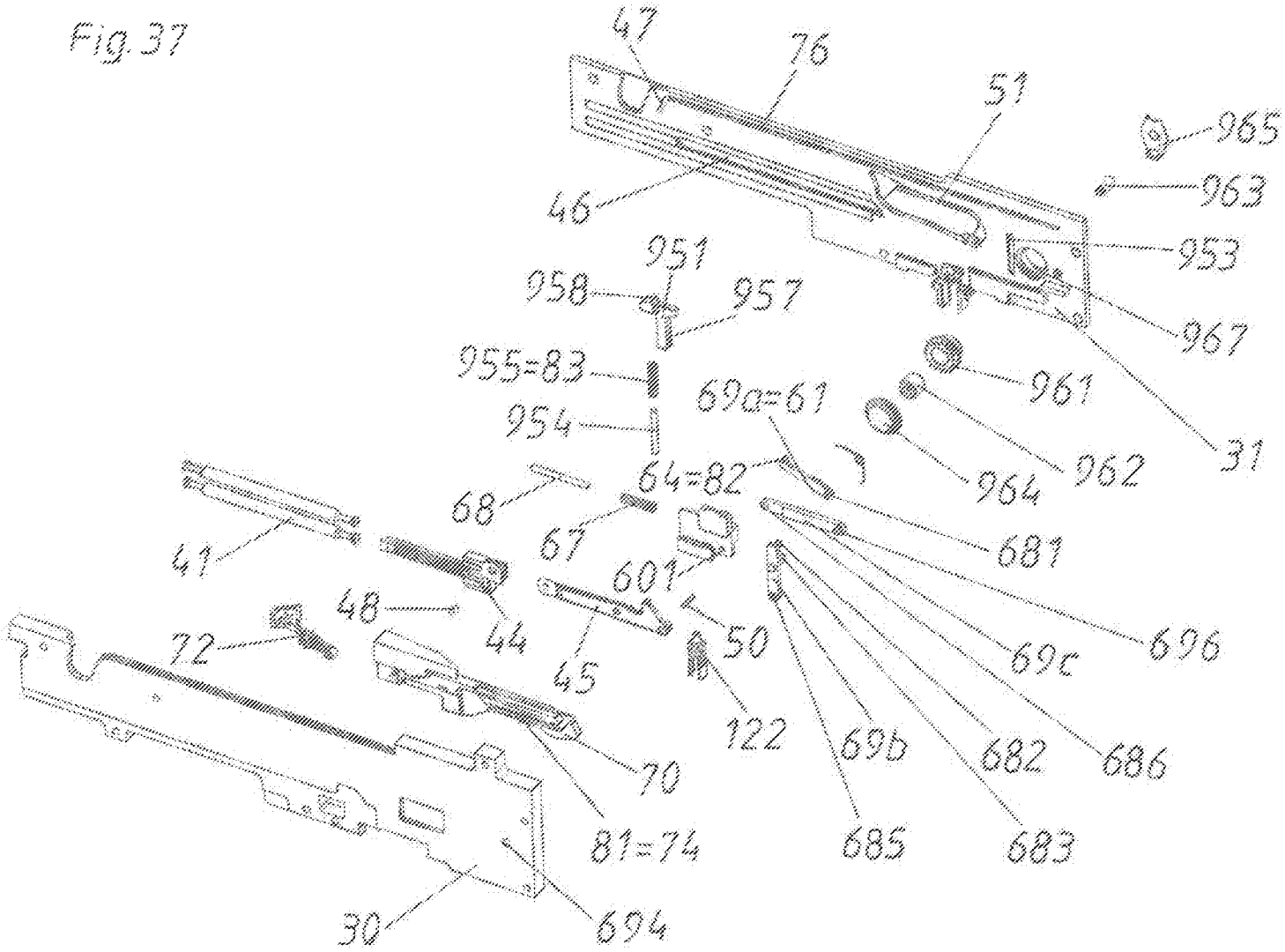

A third variant of the drive device 1 according to the invention is illustrated starting from FIG. 36. In particular, FIGS. 36 and 37 again show exploded views of the drive device 1, once seen from the front and once seen from the back. This third variant is—concerning the basic structure—again more similar to the first variant as the triggering mechanism 6 and the retardation device 9 are arranged in similar regions as in the case of the first variant and as the whole movement sequence is effective in a similar manner. In the case of this variant, again, only one entrainment member 11 is necessary. Therefore, the structural unit denoted as coupling mechanism in the second variant is again applied for the function of the transmission device 7 in this third variant. This transmission device 7 especially comprises the transmission element 70 and the catching lever 72 which are guided in the guide track 76. The basic operating mode of this second variant is again the same as in the first variant, wherefore details are not fully explained. The same applies for the ejection device 4 which comprises the control lever 45, the slider base 44 and the ejection force storage member 41. The slider base 44 and the control lever 45 of the ejection slider 40 are connected to each other in a swiveling manner by means of the swivel joint 48.

In this third embodiment the triggering mechanism 6 again comprises a triggering leverage 69. The triggering leverage 69 comprises the first leverage part 69*a*, the second leverage part 69*b* and the third leverage part 69*c*. In this variant the leverage part 69*a* simultaneously forms the triggering lever 61. This first leverage part 69*a* comprises a tapered latching tooth 64 formed on an end facing towards the transmission element 70. This latching tooth 64 forms the second coupling element 82 of the coupling device 8. This latching tooth 64 corresponds with latching recesses 74 formed on the transmission element 70. These latching recesses 74 form the first coupling element 81 of the coupling device 8. A spring holding protrusion 698 is attached to the first leverage part 69*a*. A leg of the leg spring 699 abuts this spring holding protrusion 698. A bearing recess 681 is formed on an end of the first leverage part 69*a* which is remote from the second coupling element 82. The bearing protrusion 682 formed on the upper end of the second leverage part 69*b* engages in this bearing recess 681. The helically coiled central part of the leg spring 699 surrounds the bearing protrusion 682. One leg of the leg spring 699 abuts the rotary bearing 683 of the second leverage part 69*b*. This rotary bearing 683 is rotatably supported in the recess 694 formed in the housing base plate 30. The rotary movement of the second leverage part 69*b* is limited by the rotation limiting abutting surface 684 formed in the housing base plate 30. A bearing recess 685 is formed on the lower end of the second leverage part 69*b*. A bearing protrusion 686 of the third leverage part 69*c* engages into this bearing recess 685. On the other the third leverage part 69*c* comprises the holding pin 696. The third leverage part 69*c* and, thus, the whole triggering leverage 69 is connected to the holding hole 601 formed in the triggering element 60 by means of said holding pin 696.

A braked movement of the second coupling element 82 formed on the first leverage part 69*a* in the direction of the first coupling element 81 is initiated by the retardation device 9. This retardation device 9, thus, forms a timing element by way of which the movement of the coupling device 8 from the uncoupling position EK into the coupling position KS triggered by the coupling force storage member 83 is carried out in a time-delayed manner. In the case of this third variant the retardation device 9 comprises a damped slider 951. This damped slider 951 is supported linearly movable—in a limited manner—in the damping guide track 953 formed in the housing cover 31 by means of the guiding protrusions 952. The spring guiding mandrel 954 engages in a head region of the damped slider 951. The pressure spring 955 forming the coupling force storage member 83 surrounds the spring guiding mandrel 954. The spring guiding mandrel 954 is kept in the holding bracket 956 of the carrier 3. A toothed rack section 957 is formed on the damped slider 951. The toothed wheel 961 corresponds with this toothed rack section 957. The toothed wheel 961—together with the two bearing elements 962 and 963 and the end covers 964 and 965—forms the rotational damper 966 of the retardation device 9. This rotational damper 966 is kept in the circular recesses 967 of the carrier 3. The rotational damper 966 is acting onto the damped slider 951 in a braked manner by means of the toothed-rack-toothed-wheel-pair and damps—because of its geometry—the upward movement triggered by the pressure spring 955 (coupling force storage member 83) more strongly than the downward movement.

The triggering element 60 is formed in the mandrel support 68*b* in which the guiding mandrel 68 is kept. On the other end, the guiding mandrel 68 is kept in the mandrel support 68*a* on the carrier 3. The guiding mandrel 68 is surrounded by the spring 67 which is formed as a pressure spring. This spring 67 actuates the triggering element 60 the direction which is leading away from the ejection force storage member 41. A toothed rack 121 is also formed on the triggering element 60. This toothed rack 121 corresponds with the toothed wheel 122 which, in turn, is arranged on the synchronizing rod 123 (not illustrated here). Thus, this toothed rack 121 and the toothed wheel 122 form a part of the synchronizing device 12.

Figure 38:
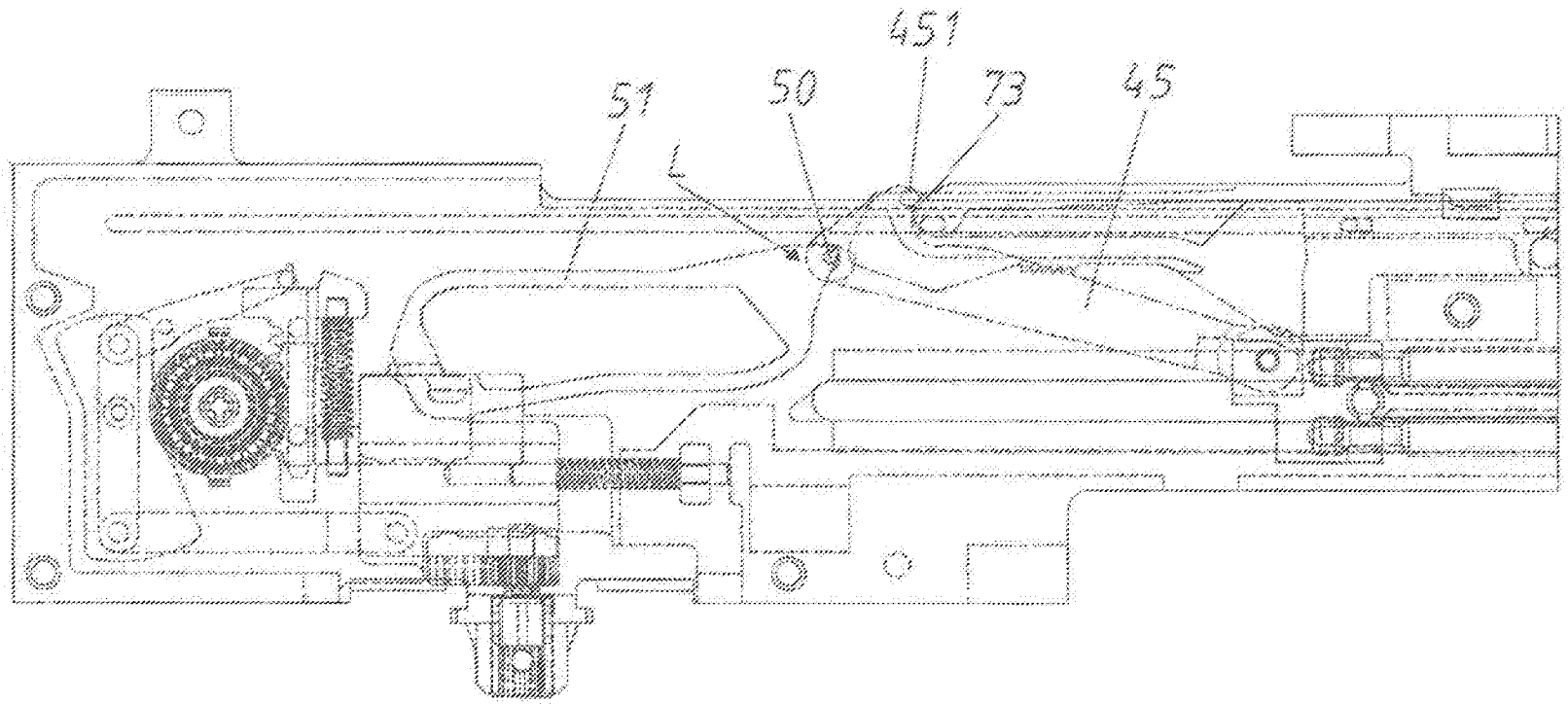
FIGS. 38-47 are top views onto the drive devices according to the third variant in different positions during the movement of the movable furniture part.

FIG. 38 shows in a top view a starting position for explaining the movement sequence of the drive device 1 according to the third variant. In FIG. 38 the locking pin 50 is located in the bearing section L of the guide track 51. The movable furniture part 2 is situated in the open position OS. The abutting surface 73 of the transmission element 70 abuts the control lever 45 in the region of the contact element 451.

Figure 39:
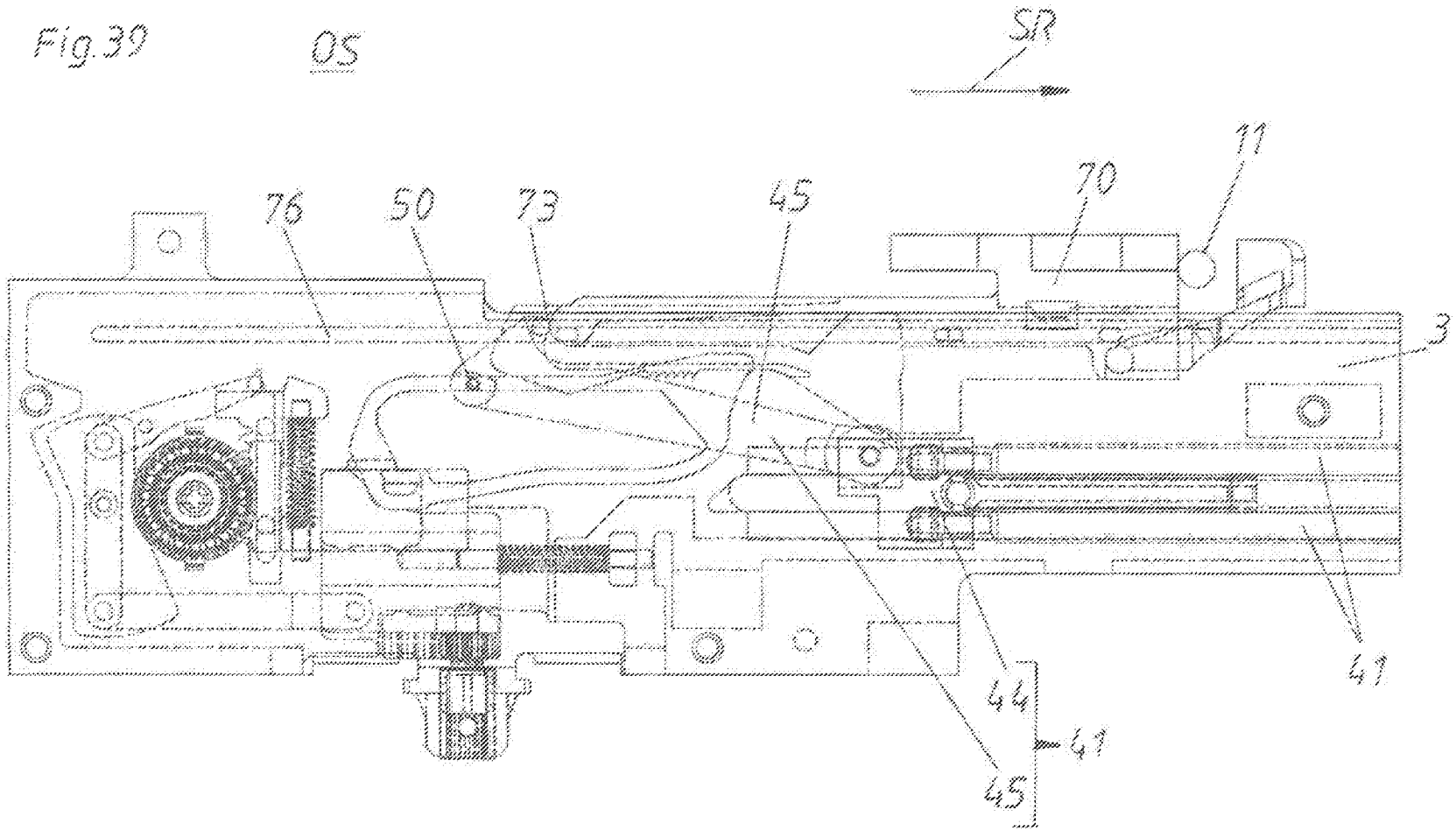

In FIG. 39 the movable furniture part 2 is still situated in an open position OS, wherein the movable furniture part 2 has been moved in closing direction SR by a user. As a consequence, the transmission element 70 is moved relative to the carrier 3 along the guide track 76 by means of the contact of the transmission element 70 with the entrainment member 11 fixed to the furniture carcass 10. The abutting surface 73 still contacts the control lever 45. The locking pin 50 is moving through the tensioning section S of the guide track 51. The ejection force storage member 41 is loaded during this movement.

Figure 40:
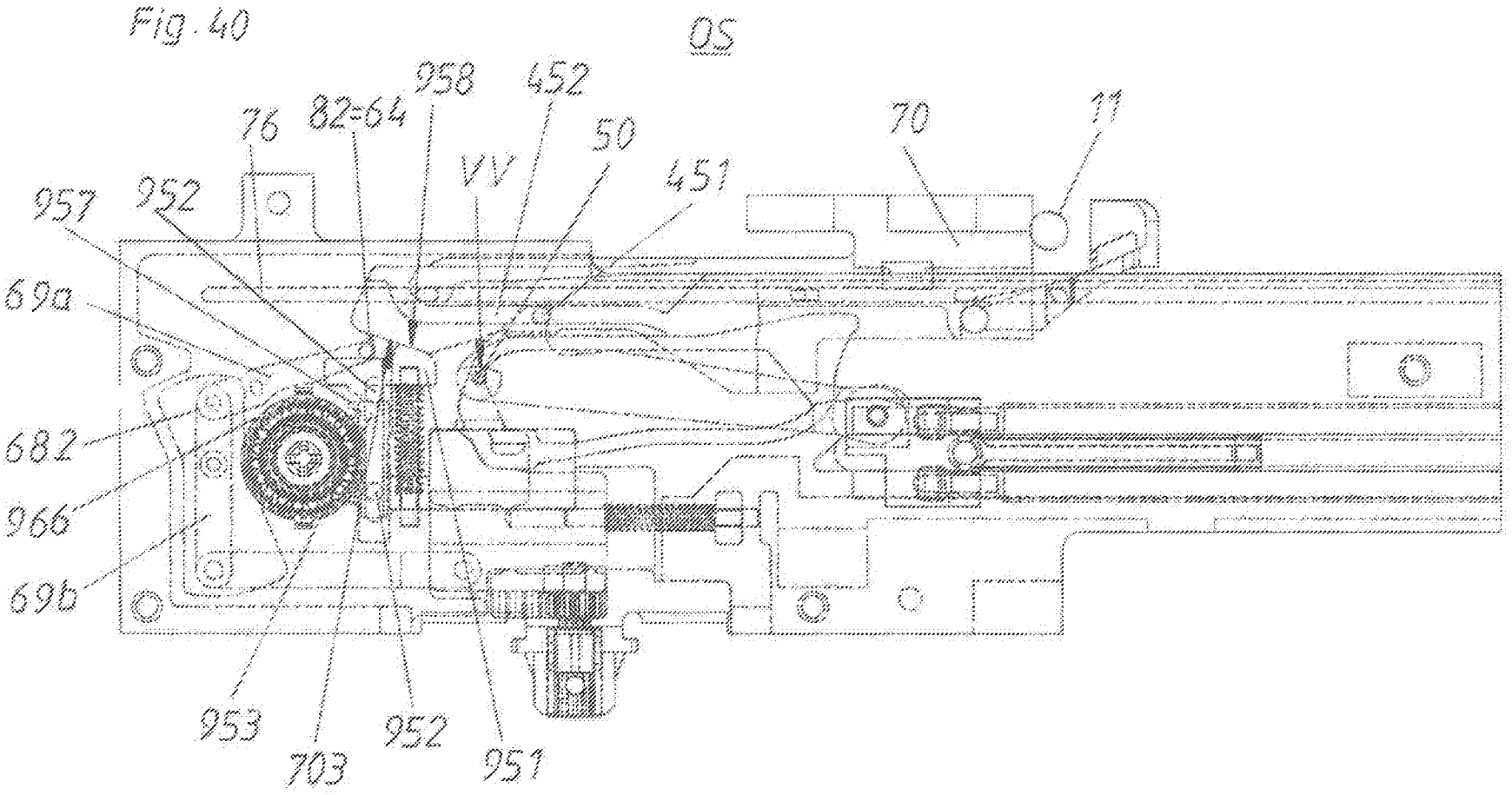

In FIG. 40 the movable furniture part 2 is still situated in the open position OS. Because of the control lever track 452 formed in the transmission element 70, the control lever 45 is swiveled counterclockwise via the contact element 451. The locking pin 50 is located in the pre-locking position VV of the guide track 51. The guiding surface 958 of the damped slider 951 is abutting the contact surface 703 of the transmission element 70. As these two surfaces are oriented transverse to the movement direction of the transmission element 70 along the guide track 76, the damping slider 951 is pushed away by the transmission element 70. Simultaneously, the damping slider 951 is moved against the force of the coupling force storage member 83 via the guiding protrusion 952 along the damping guide track 953. As the toothed rack section 957 meshes with the toothed wheel 961 of the rotational damper 966, the rotational damper 966 is rotated clockwise. Also the latching tooth 64 forming the second coupling element 82 is reaching contact with the contact surface 703 of the transmission element 70. As a consequence, the first leverage part 69*a* is swiveled clockwise about the bearing protrusion 682 of the second leverage part 69*b*. The back part of the latching tooth 64 forming the second coupling element 82 abuts a head region of the damped slider 951.

Figure 41:
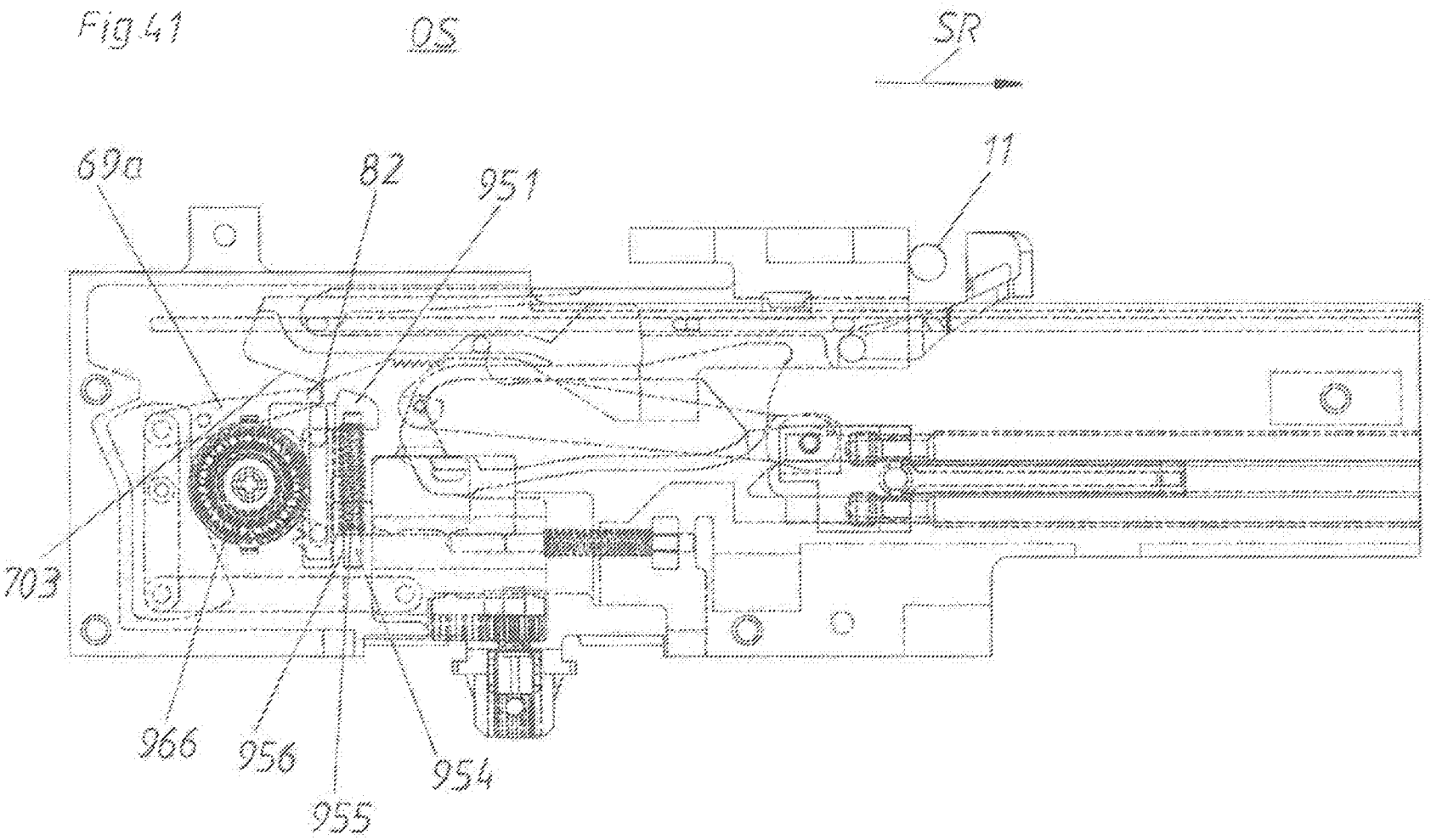

In FIG. 41 the movable furniture part 2 is still situated in an open position OS. The transmission element 70 has been further moved in closing direction SR by means of a retraction device (not illustrated here). In the position shown in FIG. 41, the latching tooth 64 of the first leverage part 69*a* just passes the most elevated spot of the contact surface 703 of the transmission element 70. Also the damped slider 951 is still further pushed downward indirectly by way of this latching tooth 64. Simultaneously, the pressure spring 955 surrounding the spring guiding mandrel 954 is compressed. Also the rotational damper 966 is further rotated clockwise.

Figure 42:
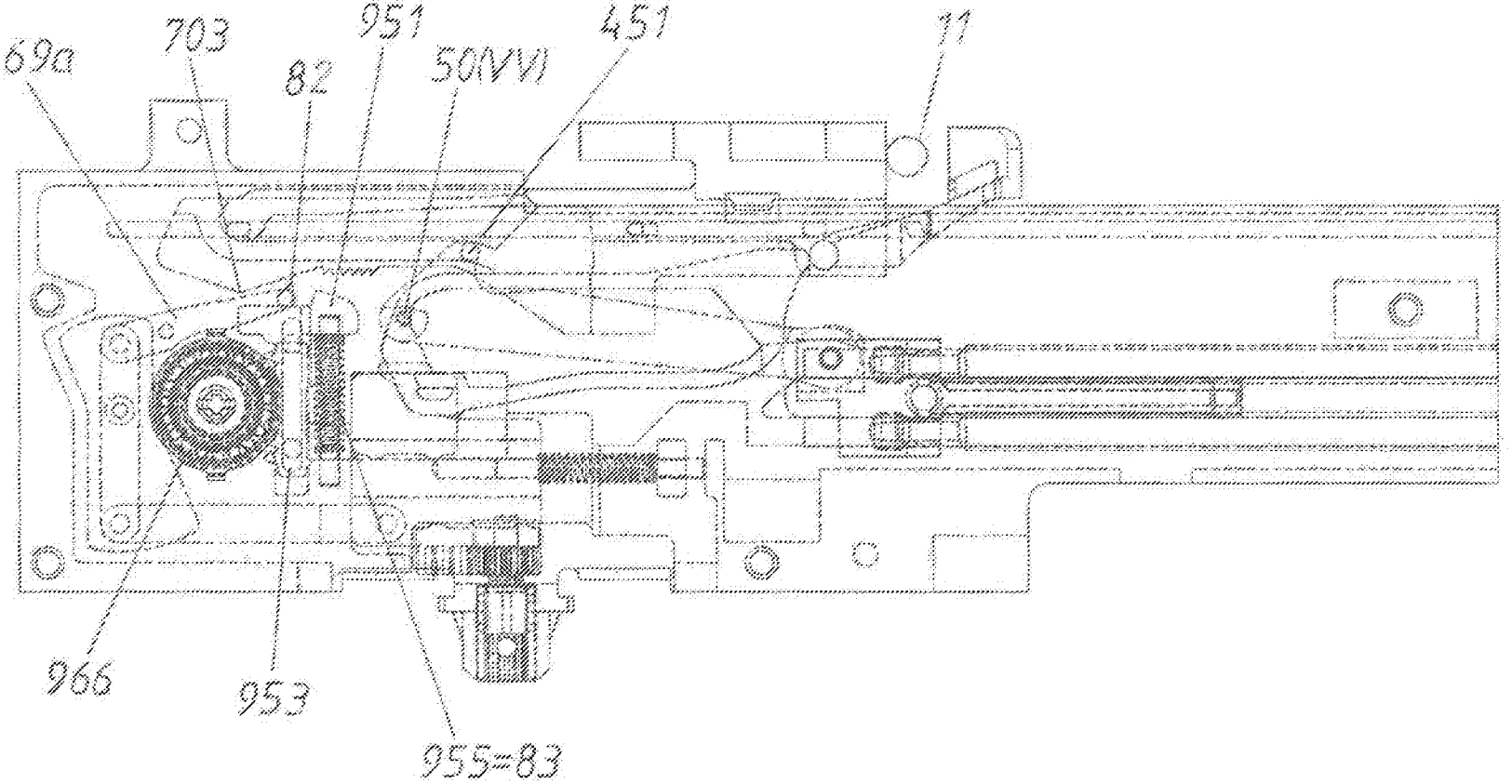

In FIG. 42 the movable furniture part 2 is barely in an open position OS. The contact element 451 has already reached the slanted region of the control lever track 452 in the transmission element 70. The locking pin 50 is, however, still located on the pre-locking position VV. The latching tooth 64 forming the second coupling element 82 has already overcome the most elevated point of the contact surface 703. As a consequence, this latching tooth 64 no longer abuts the contact surface 703. The first leverage part 69*a*, thus, is no longer pushed away by the transmission element 70, but the first leverage part 69*a* is pressed to the damped slider 951 by means of the leg spring 699. The (stronger) spring 955 can relax and pushes the damped slider 951 upwardly along the damping guide track 953. This movement is damped by the rotational damper 966 of the retardation device 9. Based on this situation in can be explained why the second coupling element 82 is still distanced from the transmission element 70.

Figure 43:
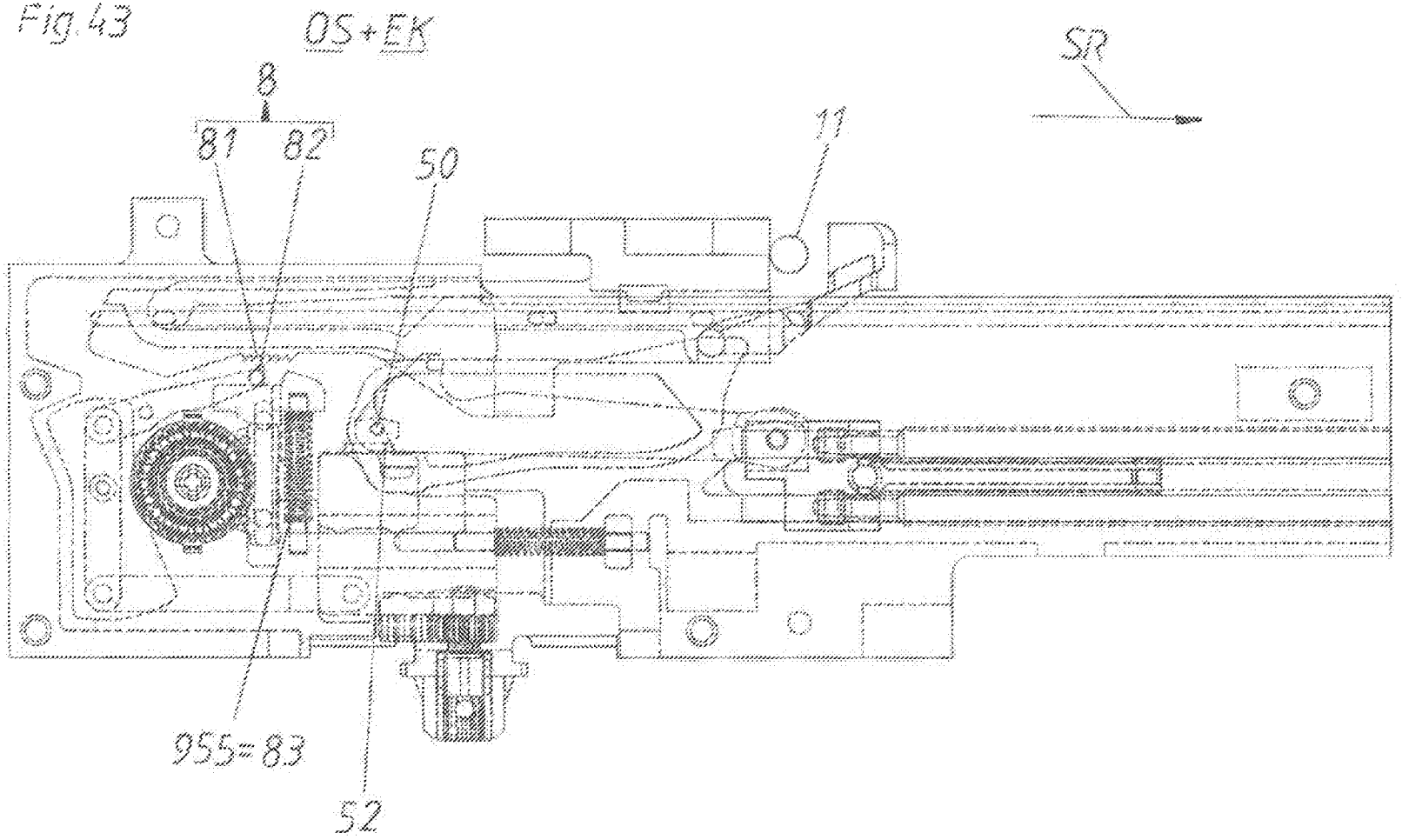

By a further movement of the movable furniture part 2 in closing direction SR, the locking pin 50 is disengaged from the pre-locking position VV in FIG. 43 and the locking pin 50 moves through the latching movement section E towards the latch recess 52. The pressure spring 955 (coupling force storage member 83) has still not been able to relax further. The latching tooth 64 forming the second coupling element 82, however, is still distanced from the transmission element 70, in particular from the latching recesses 74 formed on the transmission element 70 and forming the first coupling element 81.

Next is a position (not shown) in which the locking pin 50 is locked in the latch recess 52. Therefore, the locking device 5 is situated in the locking position VS. The two coupling elements 81 and 82, however, are still slightly distanced from each other, for what reason the coupling elements 81 and 82 are situated in the uncoupling position EK.

Figure 44:
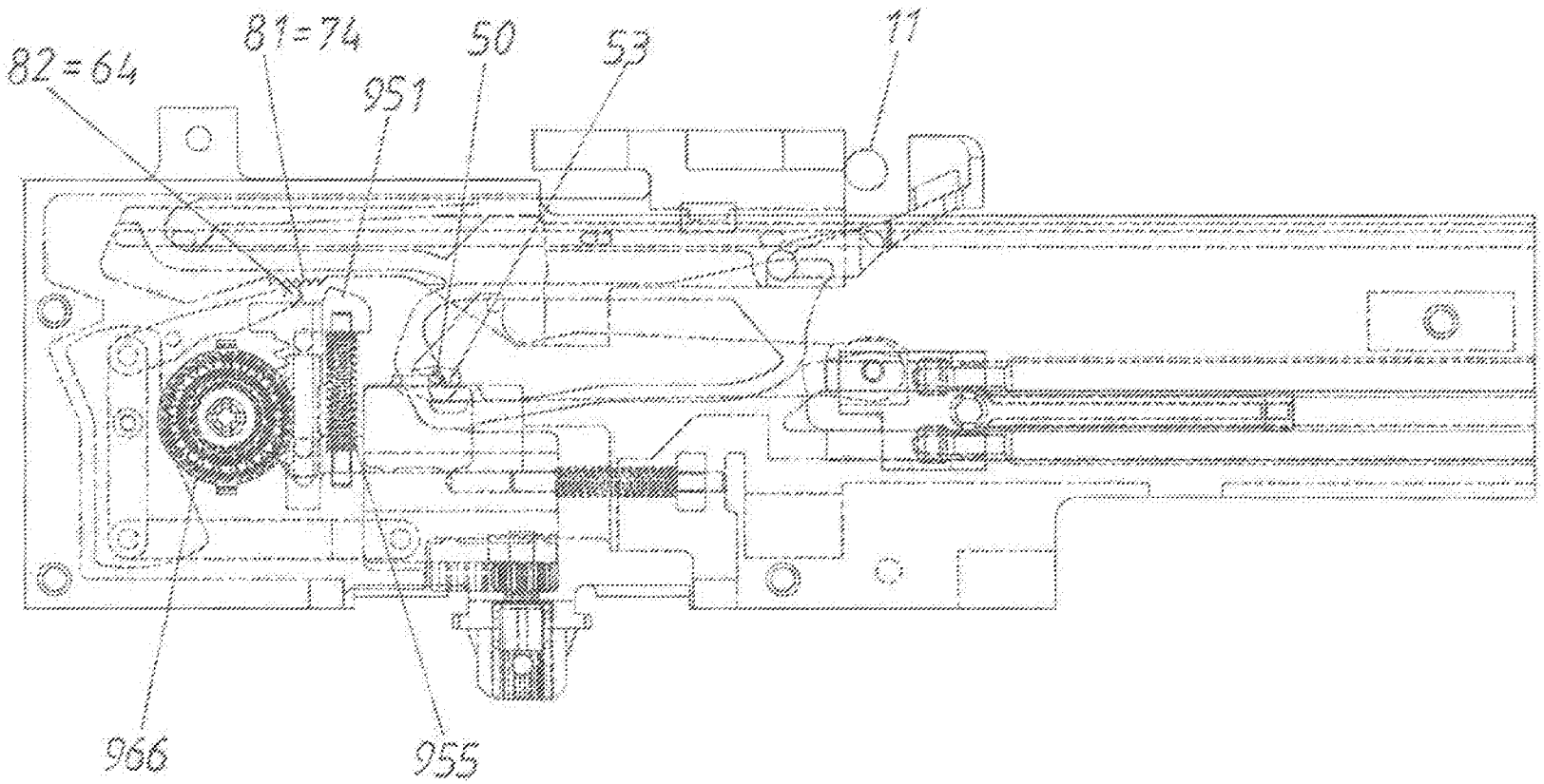

When the locking device 4 is situated in the locking position VS, the coupling device 8 can be moved from the uncoupling position EK into the coupling position KS. As a consequence, the position according to FIG. 44 is reached, wherein the latching tooth 64 of the second coupling element 82 contacts a corresponding recess of the latching recesses 74 of the first coupling element 81. This means, the damped slider 51—despite the braking by the rotational damper 966—has finally been moved upwardly thus far by means of the pressure spring 955 (coupling force storage member 83) till the coupling position KS of the coupling device 8 is given. The movable furniture part 2 is situated in the closed position SS.

Figure 45:
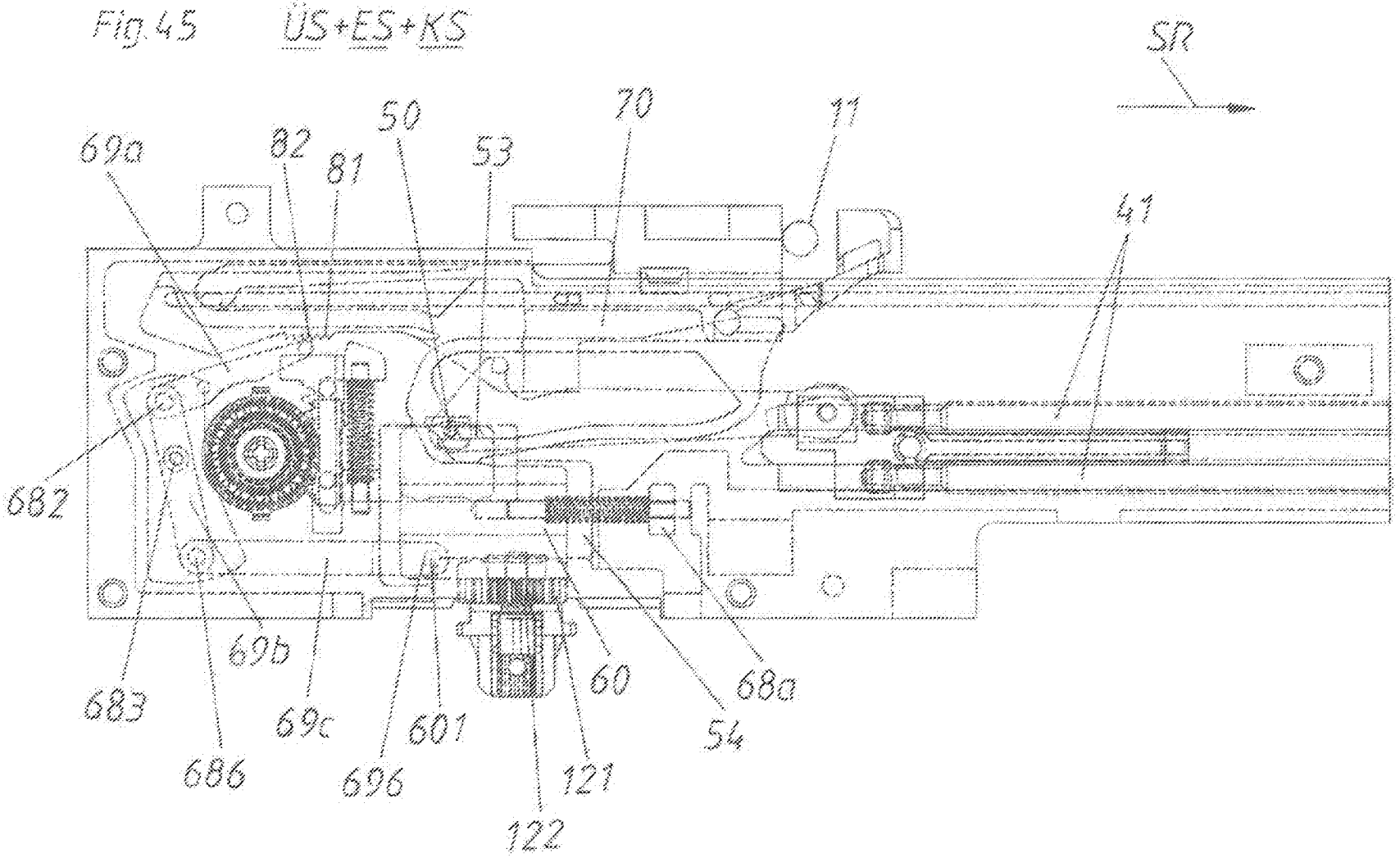

By pushing in closing direction SR onto the movable furniture part 2 situated in the closed position SS, the overpressing position ÜS of the movable furniture part 2 is reached in FIG. 45. As in the given coupling position KS the transmission device 7 is motion-coupled with the triggering mechanism 6 by way of the coupling device 8, the unlocking of the locking device 5 is triggered by the overpressing movement and the ejection device 4 is able to eject the movable furniture part 2 in opening direction OR. In detail this movement is carried out in that—by means of the first coupling element 81—the second coupling element 82 abutting the first coupling element 81 is jointly moved. As a consequence, also the triggering leverage 69 is moved correspondingly. The first leverage part 69*a* which forms the triggering lever 61 is moved together with the transmission element 70, wherein the second leverage part 69*b*—via the bearing recess 681 of the first leverage part 69*a* and the bearing protrusion 682 of the second leverage part 69*b*—is swiveled counterclockwise about the rotary bearing 683. Simultaneously, the third leverage part 69*c* is shifted via the bearing recess 685 and the bearing protrusion 686. As the third leverage part 69*c* engages in the holding hole 601 of the triggering element 60 by means of the holding pin 696, the triggering element 60 is shifted against the force of the spring 67 in the recess 54. The locking element 53 is formed on the triggering element 60. The locking device 5 is unlocked by the shifting of the triggering element 60 and the locking device 5 together with the ejection device 4 reaches the unlocking position ES according to FIG. 45. As a consequence, the locking pin 50 is no longer locked on the locking element 53 jointly forming the latch recess 52, as it has been explained already. The ejection force storage member 41 is able to unfold its force and the drive device 1 reaches the position according to FIG. 46. During this movement the toothed rack 121 meshes with the toothed wheel which meshing causes—via the synchronizing rod 123—a corresponding synchronization with the opposing drive device 1.

Figure 46:
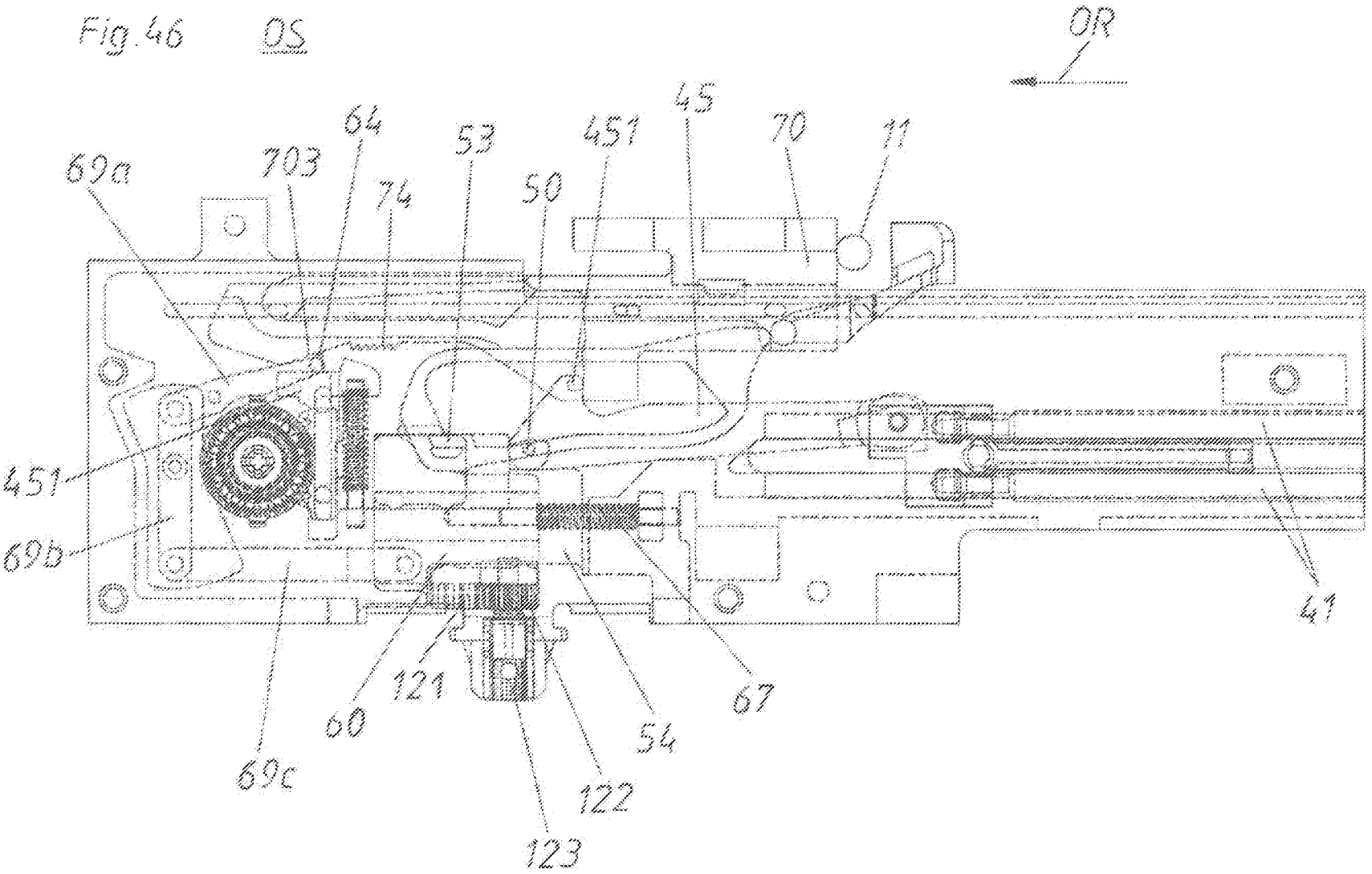

In FIG. 46, accordingly, an open position OS of the movable furniture part 2 is shown again, wherein the locking pin 50 is located in the ejection section A of the guide track 51. As this locking pin 50, thus, is no longer contacting the locking element 52, also the spring 67 is able to relax again and is moving the triggering element 60 till the opposing lateral edge of the recess 54. With this movement of the triggering element 60, also the triggering leverage 69 is moved again in the reverse direction. In particular, the second leverage part 69*b* is swiveling clockwise. In the case of the ejection movement the transmission element 70 is moved relative to the carrier 3 along the guide track 76 by means of the contact element 451 of the control lever 45. Thus, also a relative movement between the two coupling elements 81 and 82 is carried out. As the latching recesses 74 on the transmission element 70 comprise slanted edges, the latching tooth 64 is able to slide along the latching recesses 74 according to the ratchet principle, whereby the coupling position KS is deactivated. In FIG. 46 the latching tooth 64 again contacts the contact surface 703 of the transmission element 70, whereby the first leverage part 69*a* is again pushed downward. Also the damped slider 451 is moved again. This movement, however, only serves for the passing of the latching tooth 64 beyond the most elevated spot of the contact surface 703. Said movement has no other effects.

Figure 47:
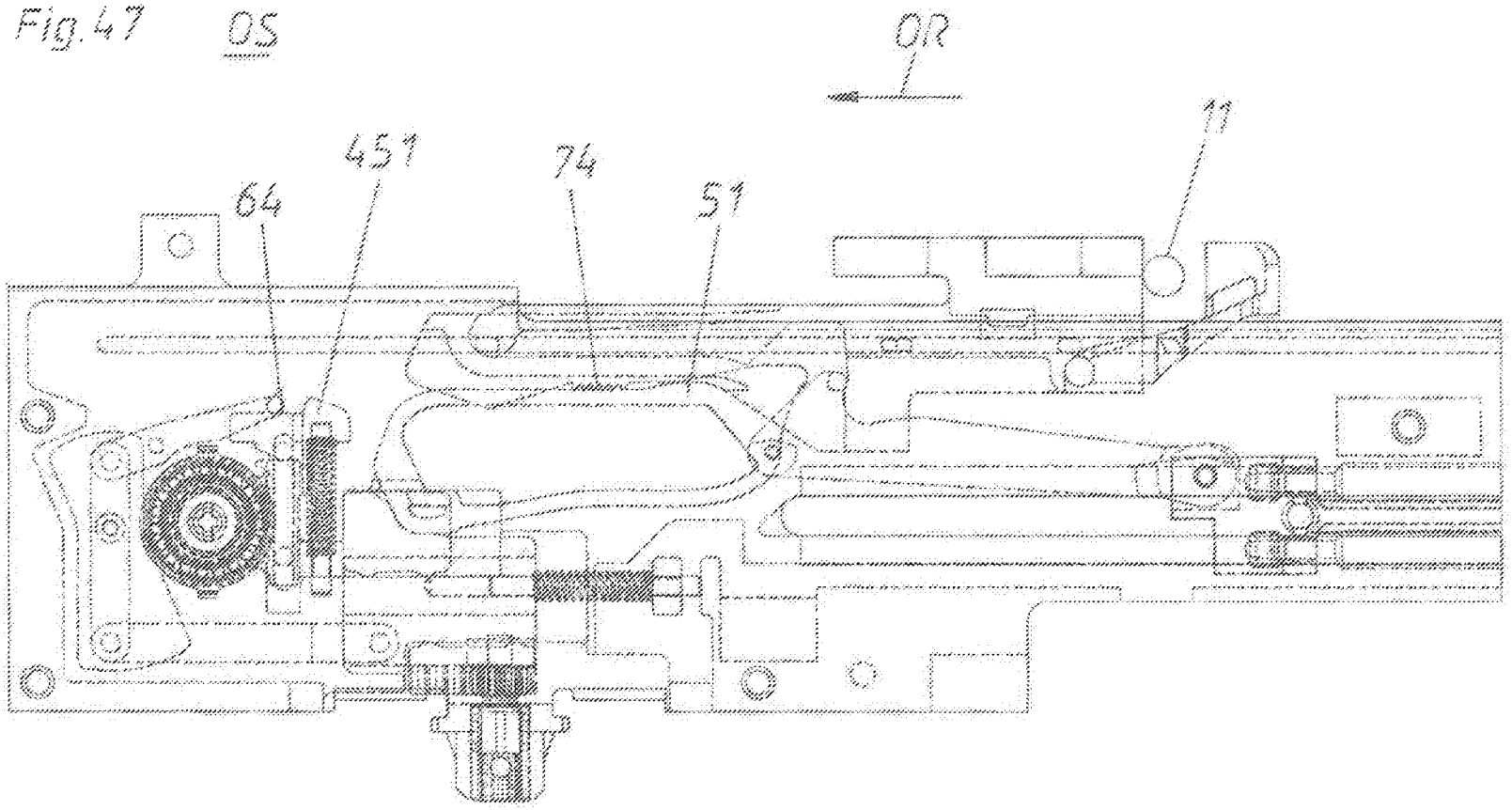

In FIG. 47 the movable furniture part 2 has been moving still further in opening direction OR. The ejection force storage member 41 is fully relaxed. The damped slider 451 has not yet been moved fully upward because of the rotational damper 966 of the retardation device 9.

When the further opening movement and subsequent closing movement is proceeded, the starting position according to FIG. 38 is finally reached again. In this position the locking pin 50 is arranged in the bearing section L of the guide track 51.

Figure 48:
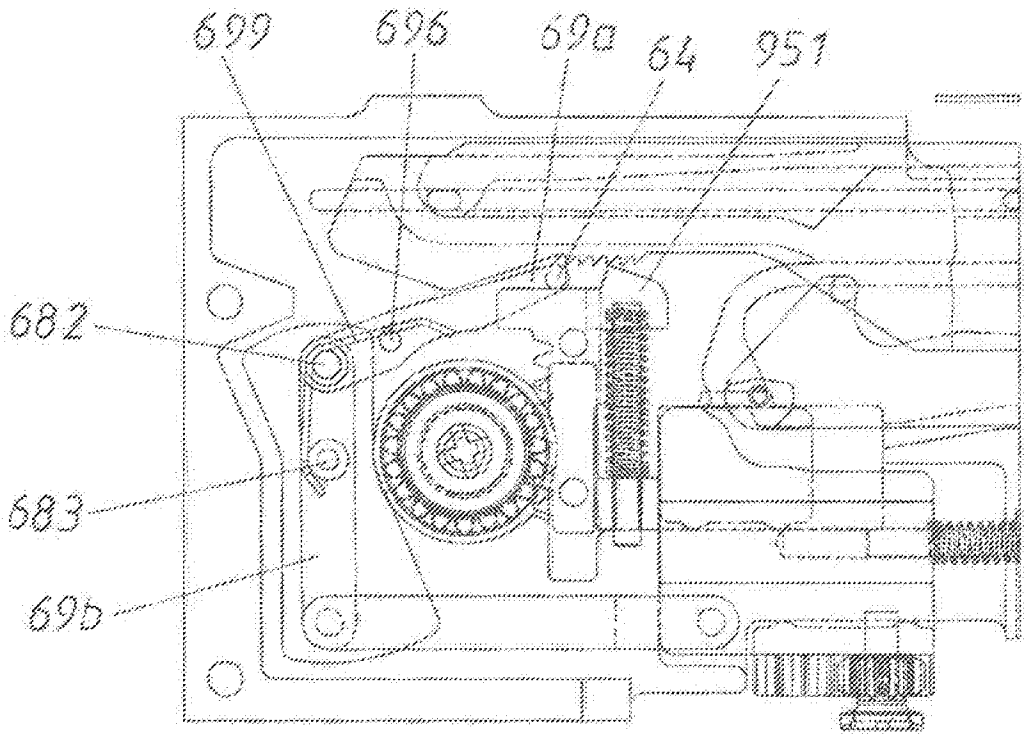
FIGS. 48-50 are top views onto different (extreme) positions of the coupling device according to the third variant.
Figure 49:
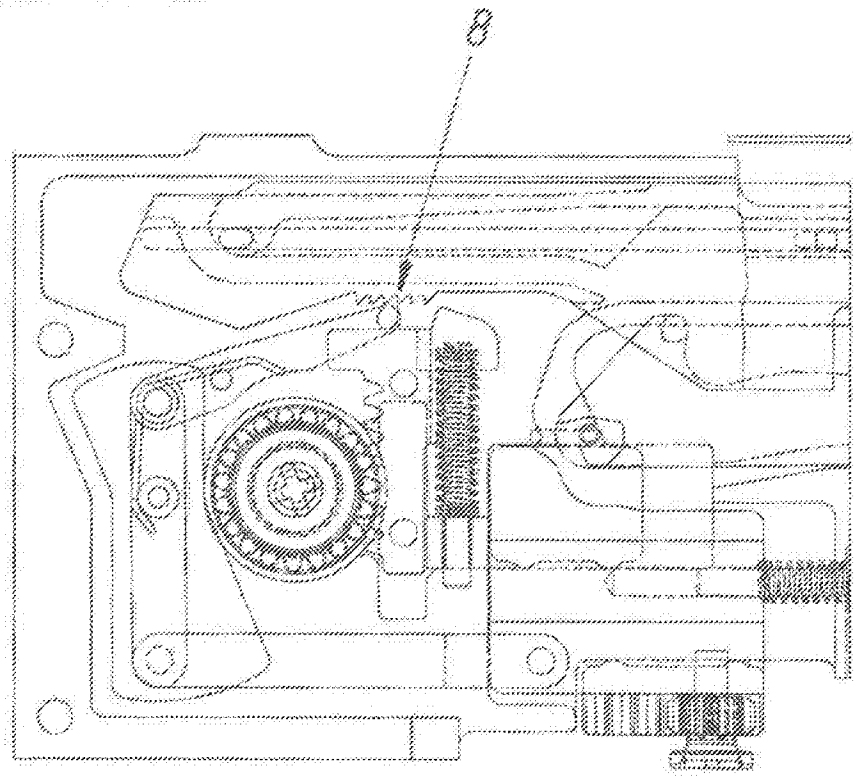
Figure 50:
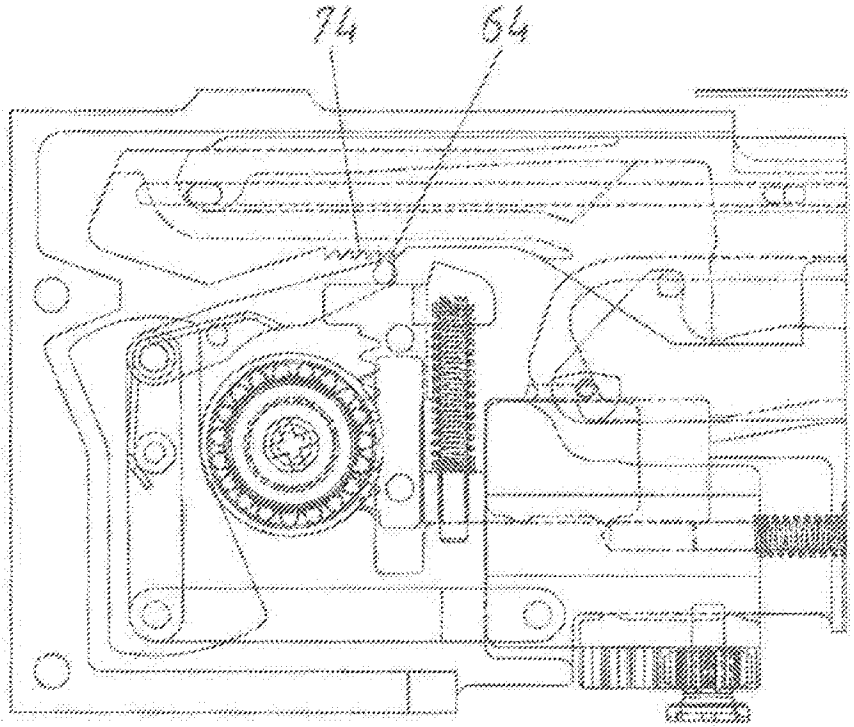

Each of the FIGS. 48 to 50, again, show closed positions SS of the movable furniture part 2, wherein the latching tooth 64 is latched in different recesses of the latching recesses 74. The coupling position KS, however, is still given in each position, for what reason an overpressing in closing direction SR correspondingly triggers an unlocking from the locking position VS. It is also visible in these FIGS. 48 to 50 that the leg spring 699 via the spring holding protrusion 698 and the rotary bearing 683 always tries to rotate the first leverage part 69*a* clockwise relative to the second leverage part 69*b*. As a consequence, it is guaranteed that the end of the latching tooth 64 which is remote from the tapered end is always abutting the damped slider 951.

Generally it shall be emphasized that there are certainly other possibilities for the movement transmission or movement coupling for all embodiment and for all mechanical connections. In particular, this applies for the various protrusions and recesses. It is always possible that these protrusions and recesses, however, are formed exactly inverted. It only has to be ensured that the corresponding movement transmission—for example between leverage parts—is guaranteed. The specific configurations according to the three variants, therefore, mainly serve for providing examples which indeed can be recreated by a person skilled in the art. Only the basic functions, however, are actually important for the present invention. For the ejection device 4, accordingly, it is important that an ejecting of the movable furniture part 2 from the closed position SS in an open position OS can be initiated. In the case of the locking device 5, a locking of the ejection device 4 has to be possible (and of course a respective unlocking). A movement of the locking device 5 from the locking position VS into the unlocking position ES by overpressing has to be possible by the triggering mechanism 6. The transmission device 7 helps to transmit the position of the movable furniture part 2 onto said triggering mechanism 6. Finally, the coupling device 8 helps for motion-coupling the drive device 7 with the triggering mechanism 6. This, however, should be configured in such a way that the coupling device 8 can be moved from the uncoupling position EK into the coupling position KS only when the ejection device 4 is situated in the locking position VS.

With the first aspect of the present invention, thus, it is enabled that—independent from the exact position of the locking pin 50 relative to the front side of the movable furniture part 2—a triggering is guaranteed during overpressing without the necessity of an adjustment of the relative position by means of a depth adjusting wheel. By the present invention it is reached that there is a tolerance range of about 5 mm. According to the invention, in particular, a gap in the movement transmission chain is closed because the coupling device 8 just moves into the coupling position KS. This, however, is only carried out (preferably time-delayed or braked) when the movable furniture part 2 has indeed reached the closed position SS independent from the exact position of the locking pin 50 relative to the item of furniture 100.

The second aspect of the invention on the one hand is already enclosed in the first embodiment (FIGS. 5 to 22) and in the third embodiment (FIGS. 36 to 50), as in these embodiments the respective locking element 53 is supported linearly movable on the carrier 3. On the other hand, the second aspect of the invention is explained in more detail in the following (fourth) embodiment. This embodiment is different from the first and third embodiment in particular in that the components of the triggering mechanism 6, the transmission mechanism 7 and the coupling device 8 are missing, as these components are negligible for the second aspect of the invention. However, hybrid forms are still possible.

Referring to the FIGS. 51 to 62 it shall be noted that all of the components denoted with reference signs have the same properties and same functions as the components with the same references signs in the first and in the third embodiment. Thus, if in the following an individual component is mentioned only short or is only shown in the drawings, the operating principle as described in said embodiments applies for each component.

Figure 51:
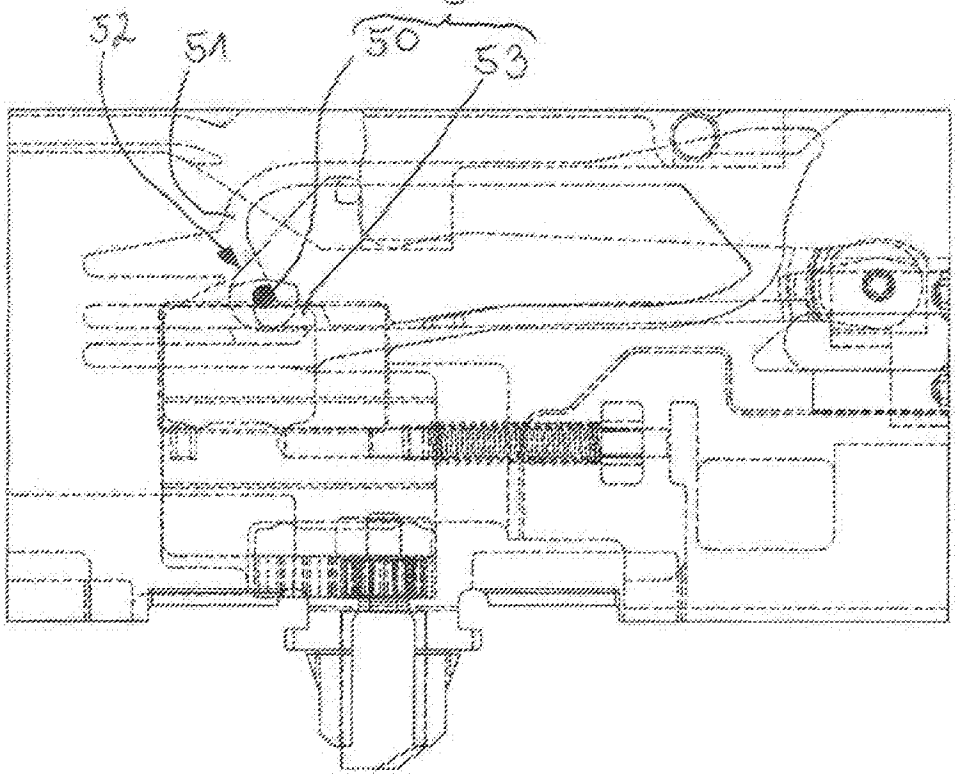
FIGS. 51-55 are top views onto a fourth embodiment of a drive device in different positions and FIGS. 56-62 are top views onto an arrangement comprising two drive devices according to the fourth embodiment and a synchronizing device in different positions.

FIG. 51 shows a top view of a drive device 1, wherein the components located in the background are illustrated by a dashed line. The position of the drive device 1 in FIG. 51 corresponds to the position according to FIG. 44. Accordingly, the movable furniture part 2 is situated in the closed position SS. The locking device 5—which comprises the locking pin 50 and the locking element 53—is situated in the locking position VS. The locking element 53 together with the guide track 53 formed in the carrier 3 forms the latch recess 51 for the locking pin 50.

Figure 52:
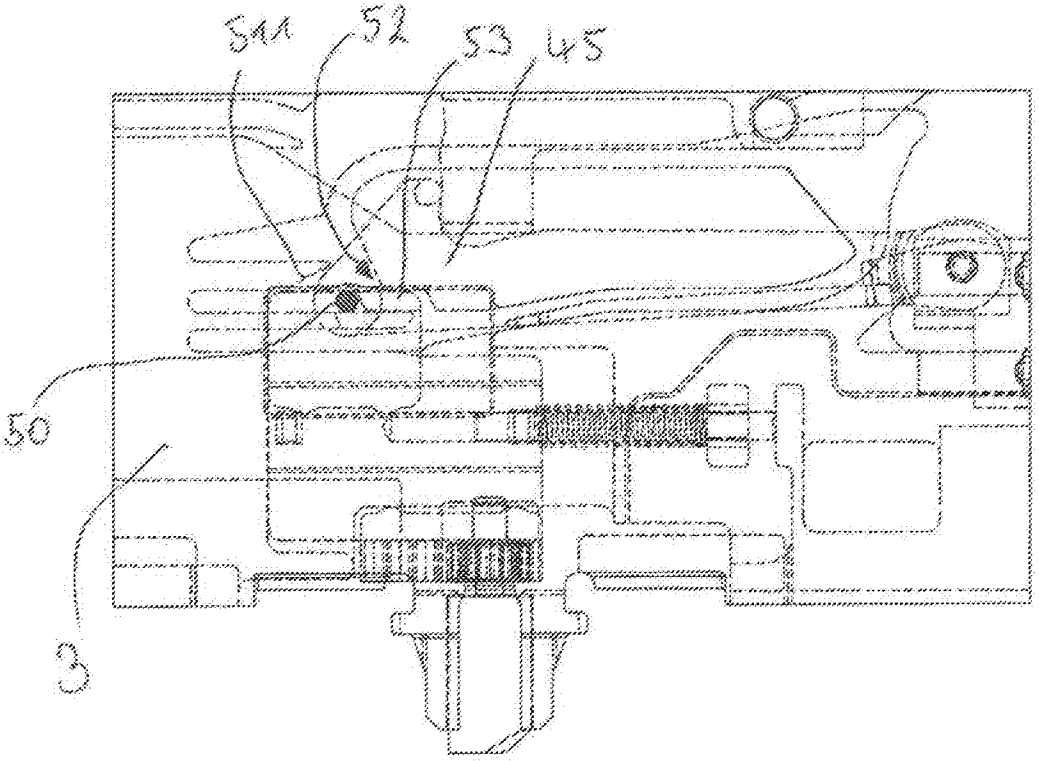
Figure 53:
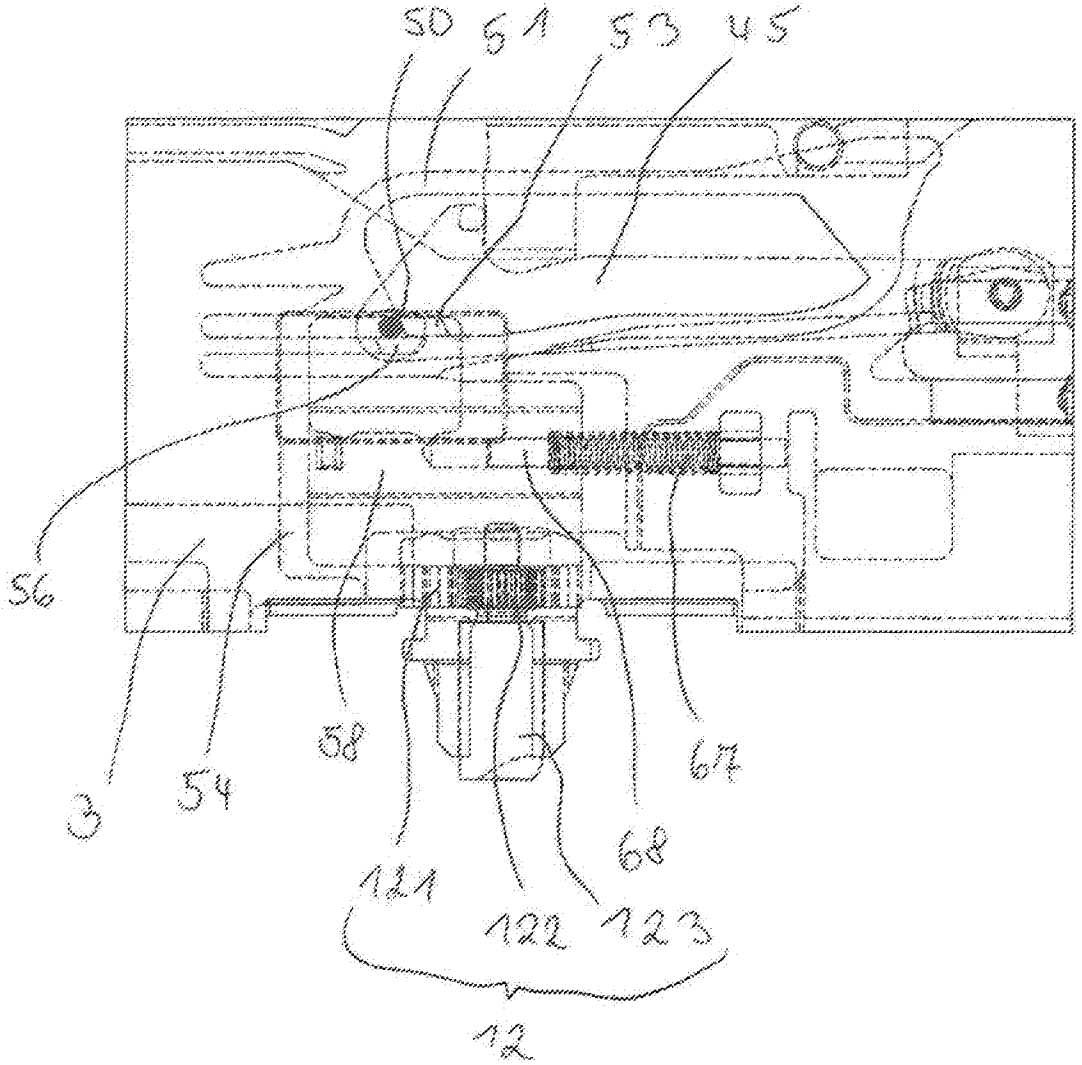

The drive device 1 arrives in the overpressing position ÜS by overpressing the movable furniture part 2 in closing direction SR, which is illustrated in FIG. 52. In addition, FIG. 52 shows the unlocking position ES of the locking device 5. The control lever 45 together with the locking pin 50 attached on the control lever 45 is released from the latch recess 52 by the movement of the movable furniture part 2 in closing direction SR (to the right side relative to the entrainment member 11). As a consequence, the locking pin 50 reaches an abutting position with the face side (corresponds to the slightly slanted surface 532) of the locking element 53. Optionally, the unlocking slant 511 and/or the swiveling movement of the control lever 45 can be used for the movement of the locking pin 50 into this position.

As soon as the user is no longer pushing the movable furniture part 2 starting from FIG. 52—thus, is no longer overpressing—the ejection force storage member 41 is able to unload. As a consequence, the control lever 45 of the ejection device 4 together with the locking pin 50 arranged on the control lever 45 is moving relative to the carrier 3 towards the ejection section A of the guide track 51—thus, contrary to the direction in which the locking pin 50 is moved during the overpressing movement. As the locking pin 50 abuts the front side of the locking element 53, the linear movement of the locking element 50 is triggered. The locking element 53 is arranged on a base element 58. Preferably, the locking element 53 is formed integrally with the base element 58 (In the first and third embodiment the triggering element 60 is forming this base element 58). This base element 58 is movably supported in a limited manner in or on the carrier 3. Particularly preferred, this base element 58 is guided linearly movable in a recess 54 or on corresponding guiding elements of the carrier 3. The locking element 53 is force-actuated (indirectly via the base element 58) by a force storage member, preferably in form of the spring 67. The locking element 53, thus, is movable by the locking pin 50 against the force of the force storage member towards the ejection section A of the guide track 51. Correspondingly, it is apparent from FIG. 53 how the base element 58 has already been distanced from the left-sided edge of the recess 54. Simultaneously, the force storage member (preferably guided on the guiding mandrel 68) is compressed. A synchronizing element of the synchronizing device 12 is also formed on the base element 58. This synchronizing element is connected to the synchronizing counterpart of the synchronizing rod 123 in a motion-transmitting manner. Preferably, this synchronizing element is formed as a toothed wheel 121 which meshes with the synchronizing counterpart formed as a toothed wheel 122.

Figure 54:
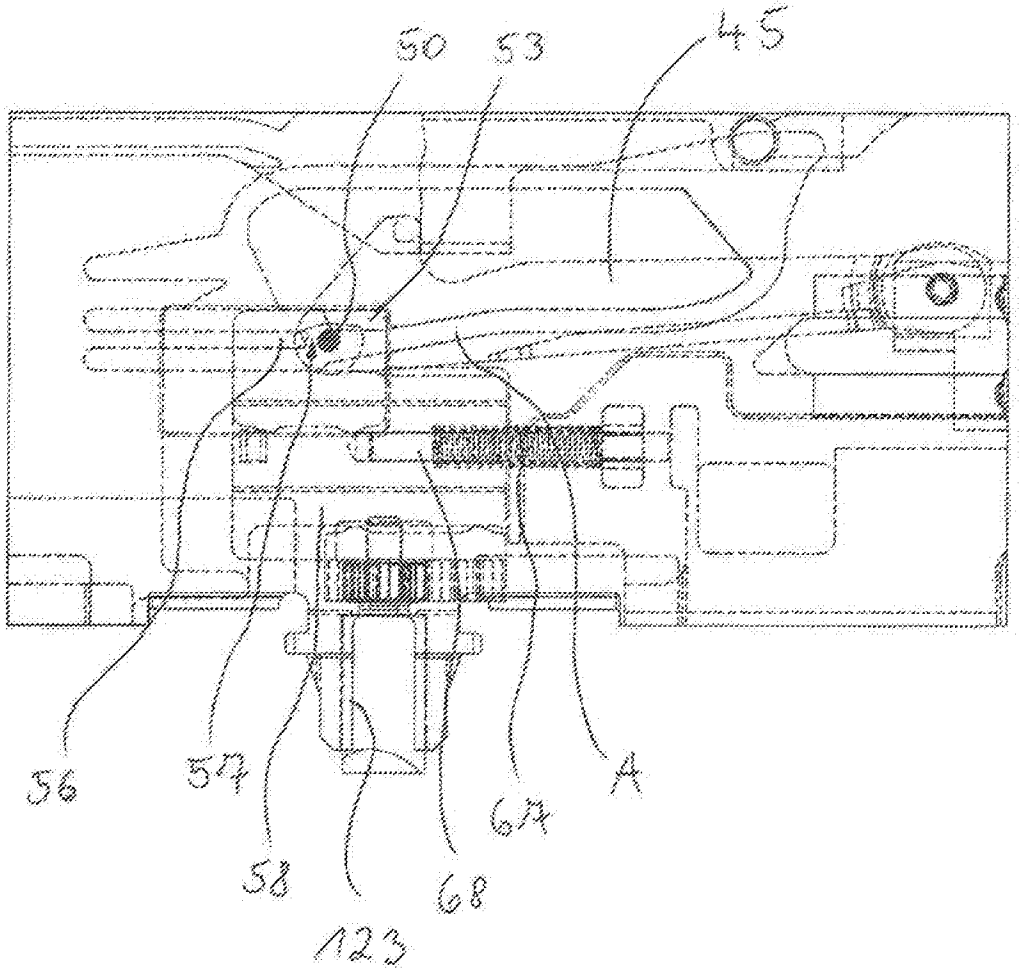

In FIG. 54 already a slight open position OS of the movable furniture part 2 is reached. A gap 57 between the locking element 53 and a limit stop 56 of the guide track 51 is being opened or released because of the further movement (which is still triggered by the ejection force storage member 41) of the locking element 53 by the locking pin 50. In FIG. 54 the locking pin 50 has been moved already for a large part through the gap 57 towards the ejection section A of the guide track 51. This movement is initiated by a surface 532 formed on the front side of the locking element 53, which surface 532 is oriented transverse to the linear movement direction of the locking element 53. Hence, the locking pin 50 is deflected into the gap 57 by the surface 532. In FIG. 54, however, the locking pin 50 is still abutting the locking element 53. The base element 58 is abutting the right-sided edge of the recess 54. The force storage member (spring 67) is compressed even further. Corresponding to the movement of the base element 58 the synchronizing rod 123 has been rotated further.

As soon as the locking pin 50 has moved completely through the gap 57, the locking pin 50 is disengaged from the locking element 53 (and thus, is released from the surface 532). As a consequence, the base element 58 and the corresponding force storage member are no longer indirectly actuated by the ejection force storage member 41. The force storage member is able to relax and is moving the base element 58 together with the locking element 53 into the position according to FIG. 55. Specifically, the locking element 53 is moved by the force storage member in that direction in which the locking pin 50 is moved during the overpressing movement. The locking element 53 together with the guide track 51 again forms the latch recess 52. The locking pin 50 has been already moved halfway through the ejection section A of the guide track 51.

Each of the FIGS. 56 to 62 show a top view of an arrangement comprising a first drive device 1', a second drive device 1" and a synchronizing device 12 which synchronizes both drive devices 1' and 1". The two drive devices 1' and 1" are formed mirror-symmetrically to each other.

Figure 56:
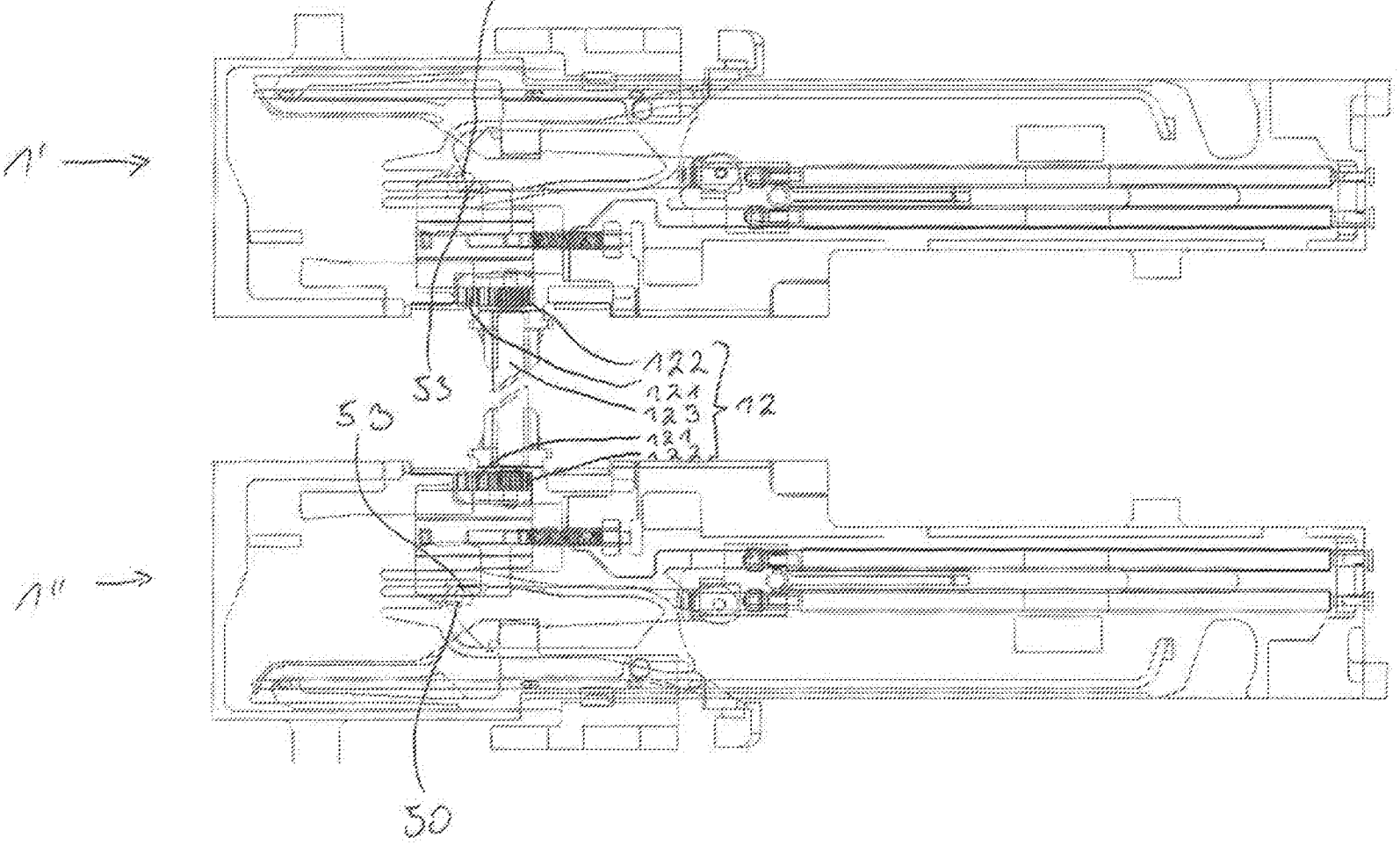

In FIG. 56 the two drive devices 1' and 1" are each situated in the position according to FIG. 51. This means, both locking pins 60 are located in the latch recess 52 and are laterally abutting the locking element 53.

Figure 57:
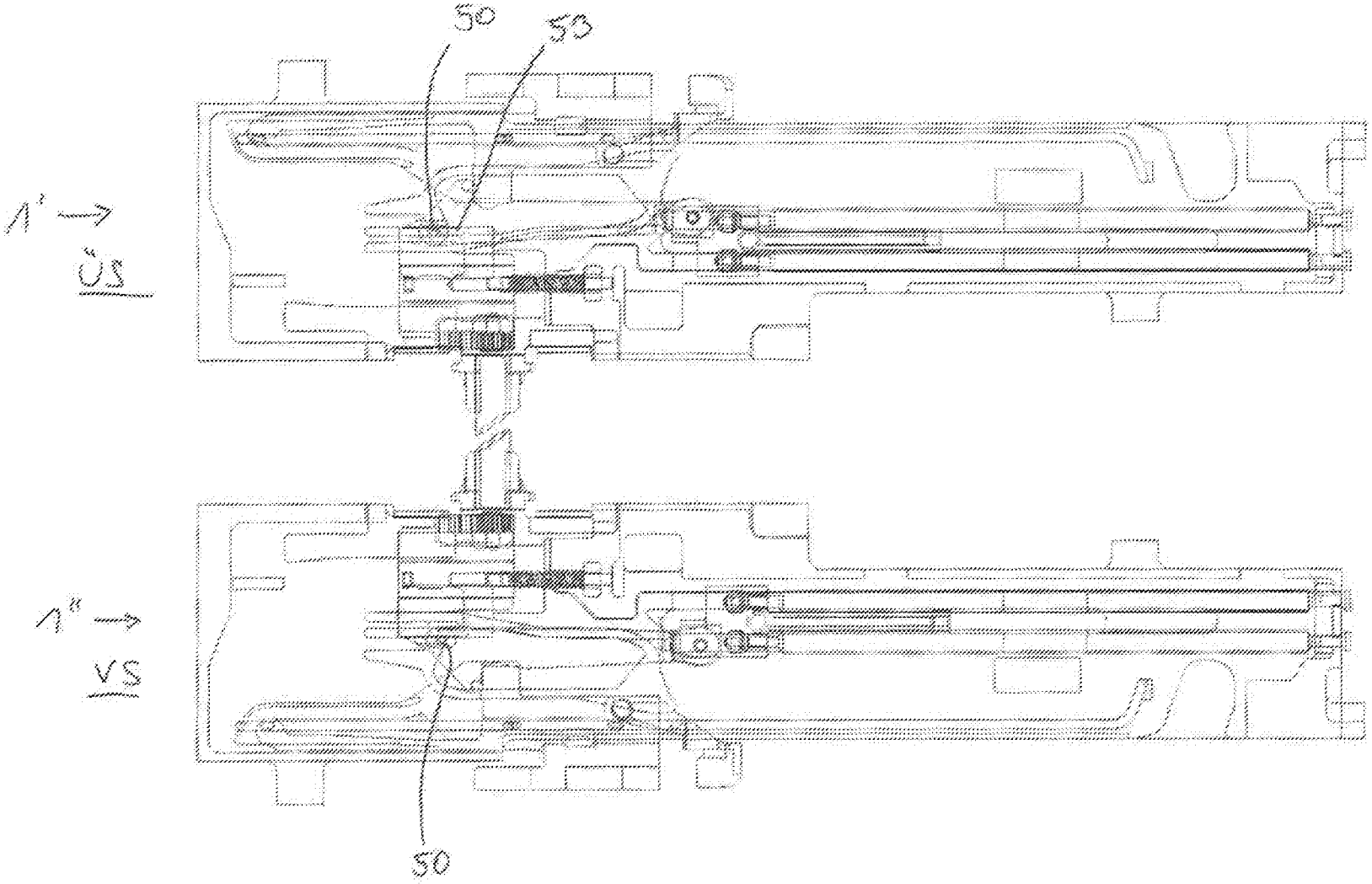

In FIG. 57 a user has pushed the movable furniture part 2 only on one side in the region of the first drive device 1'. As a consequence, only the locking pin 50 of the first drive device 1' has been unlocked and is abutting the front side of the locking elements 53. This corresponds to the position according to FIG. 52. The locking pin 50 of the second drive device 1", in contrary, is still in the locking position VS because of the actuation only on one side.

Figure 58:
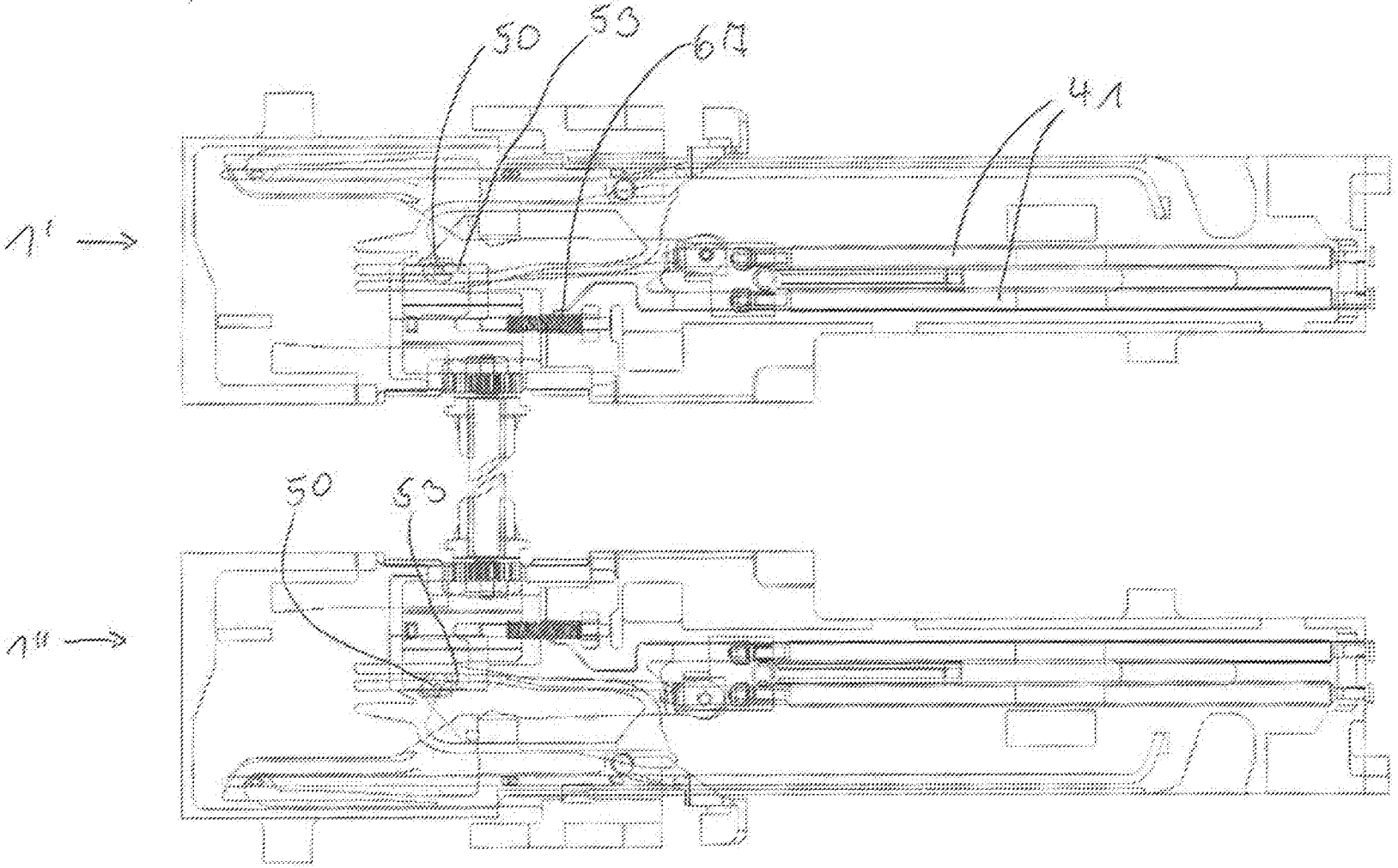

In FIG. 58 the user has released the movable furniture part 2. As a consequence, the ejection force storage member 41 of the first drive device 1' is able to relax. The locking pin 50 moves the locking element 53 via its front side, whereby also the base element 58 is being moved against the force of the force storage member (spring 67). The position of the first drive device 1' corresponds to the position shown in FIG. 53. A movement transmission by means of the synchronizing device 12 is carried out because of the movement of the base element 58 and the synchronizing element (toothed rack 122) arranged on this base element 58. Specifically, the linear movement of the synchronizing element (toothed rack 122) of the first drive device 1' is converted into a rotary movement of the synchronizing counterpart (toothed wheel 121) of the synchronizing rod 123. This rotary movement of the synchronizing rod 123 is converted into a linear movement of the base element 58 of the second drive device 1" by means of the rod-sided synchronizing counterpart and the synchronizing element in the region of the second drive device 1". As soon as the front side of the locking element 53 of the second drive device 1" is located in one line with the guide track 51 in the region of the latch recess 52, also the locking pin 50 of the second drive device 1" is able to move towards the front side of the locking element 53 of the second drive device 1" as it is illustrated in FIG. 58. The locking pin 50, so to speak, is gliding along the slanted surface of the guide track 51 to the front side of the locking element 53. Thus, according to FIG. 57 the overpressing movement starts free from a movement transmission between the first drive device 1' and the synchronizing device 12. During a movement of the movable furniture part 2 in opening direction OR the synchronizing device 12 is movable by the first drive device 1'. In other words, a movement transmission from the first drive device 1' to the synchronizing device 12 is carried out only after the unlocking.

Figure 59:
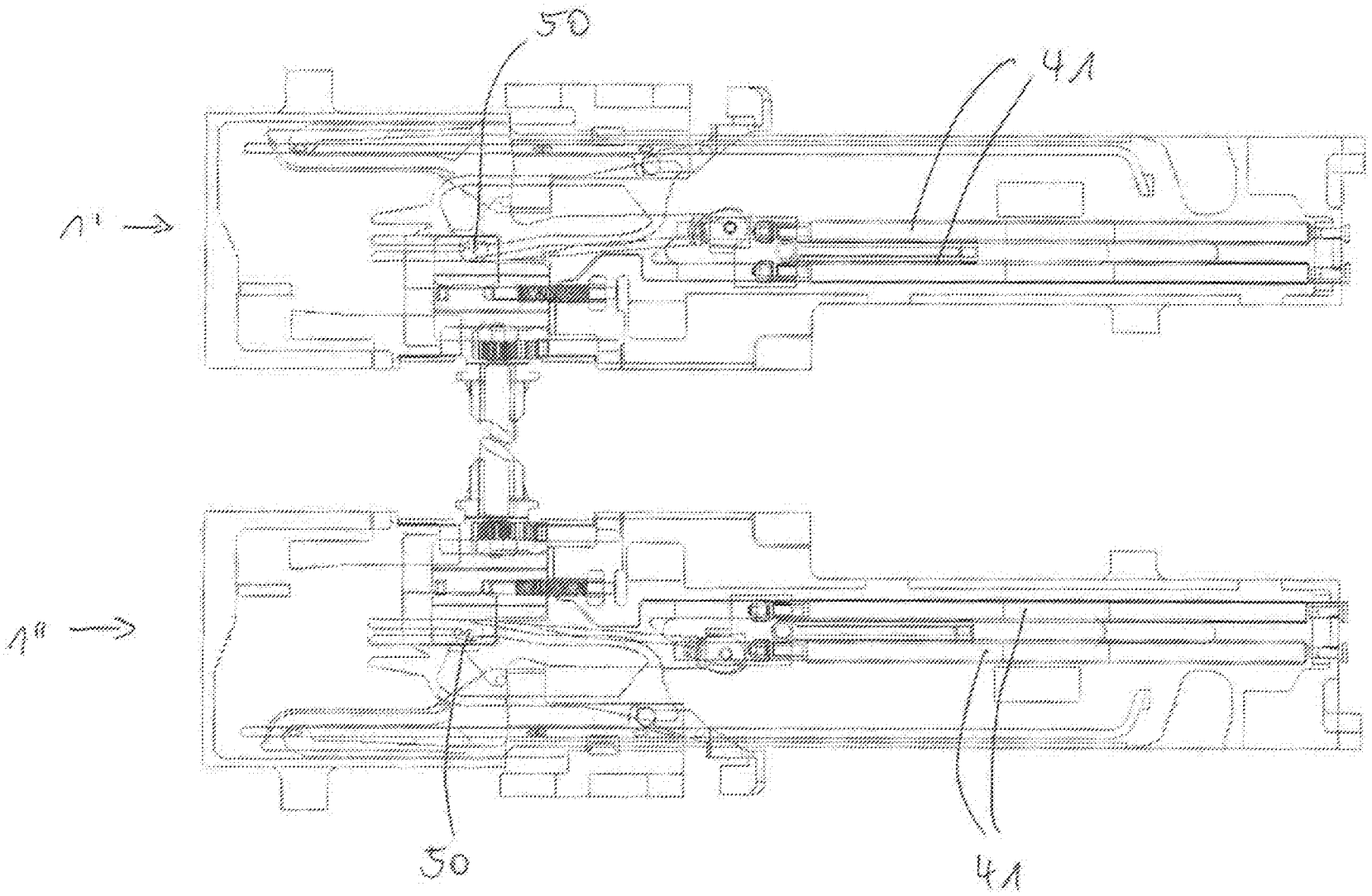

Thereupon, the ejection force storage members 41 of both drive devices 1' and 1" are able to relax (quasi synchronously), wherein according to FIG. 59 the two locking pins 50 are located in the region of the respective gap 57. This corresponds to FIG. 54.

Figure 55:
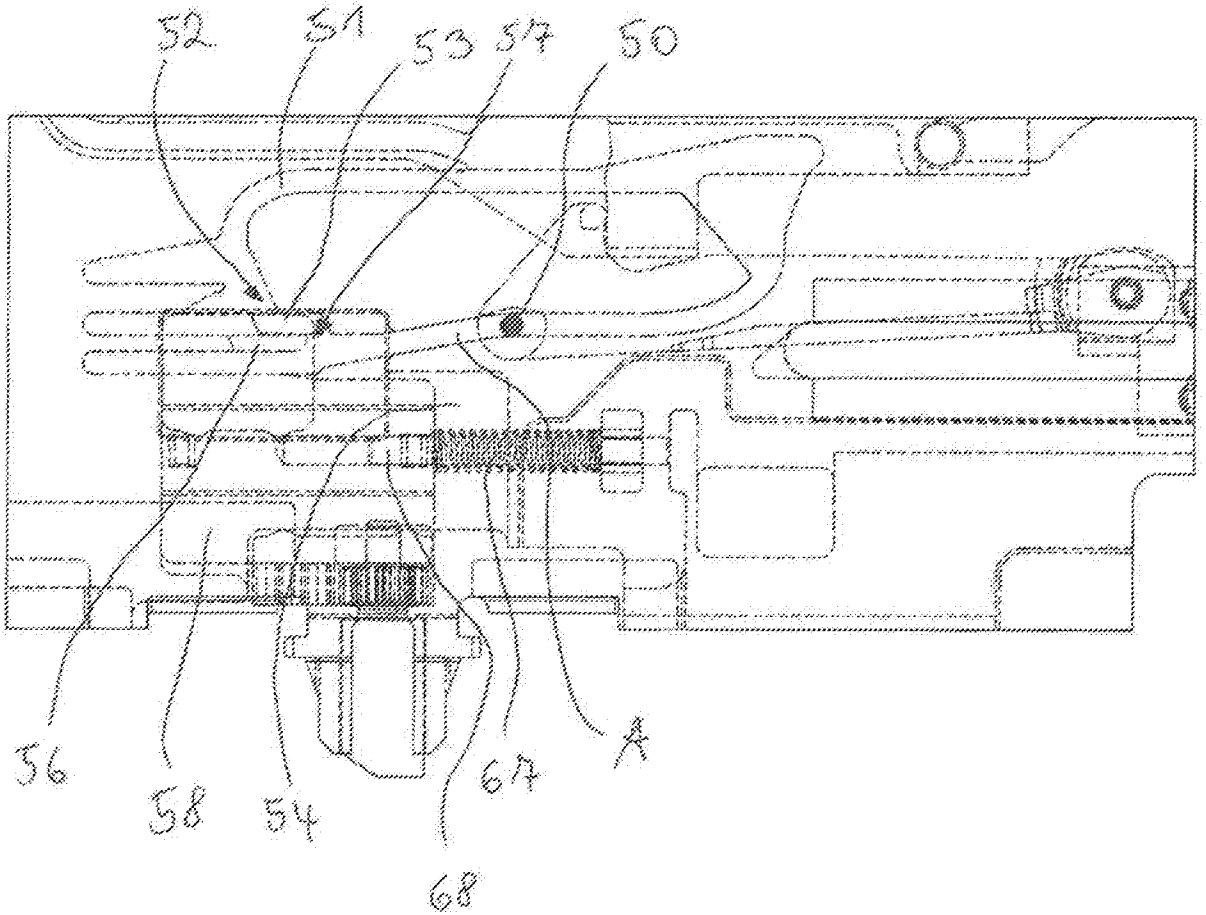
Figure 60:
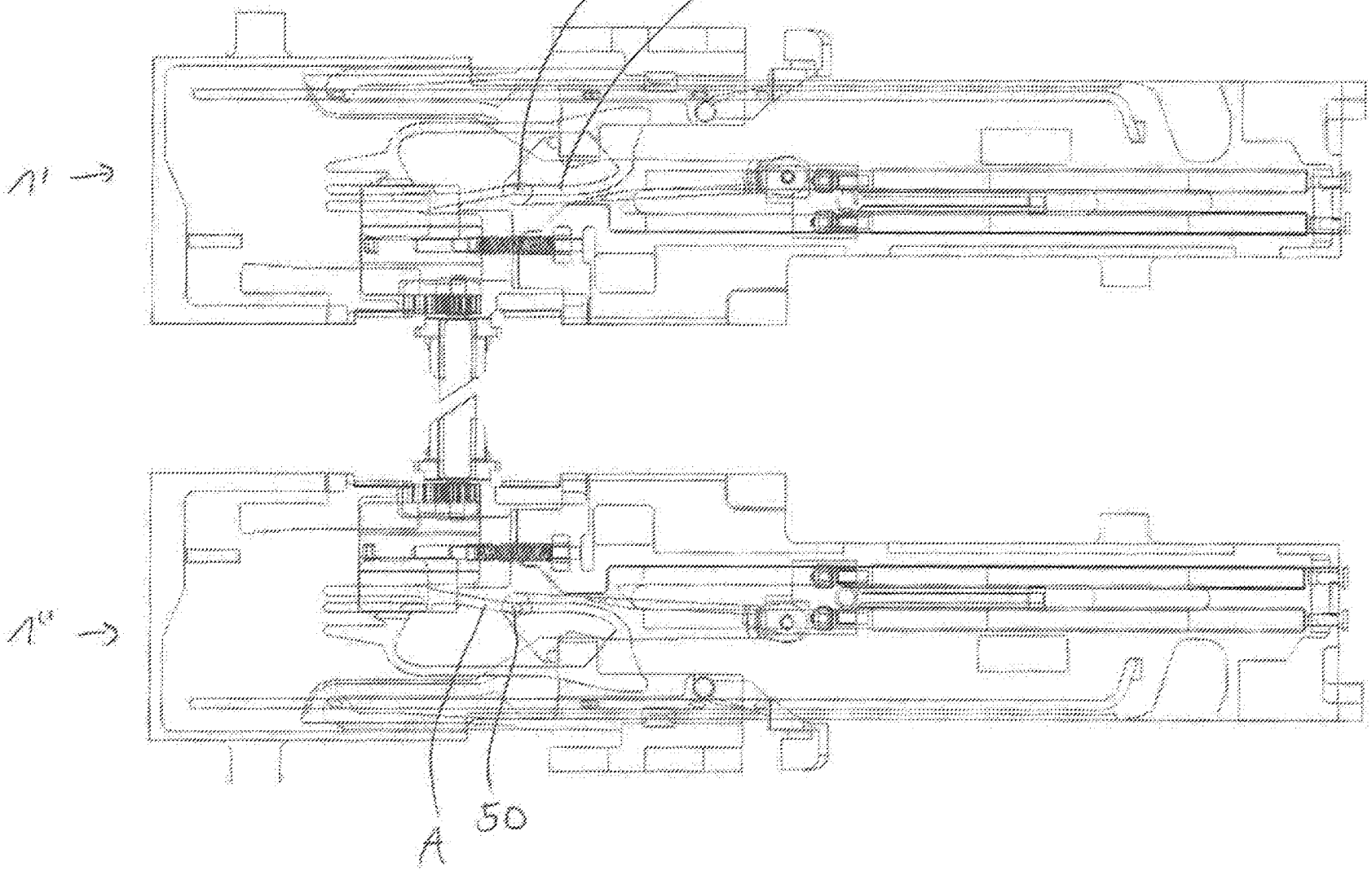

The positions according to FIG. 60 correspond to FIG. 55.

Figure 61:
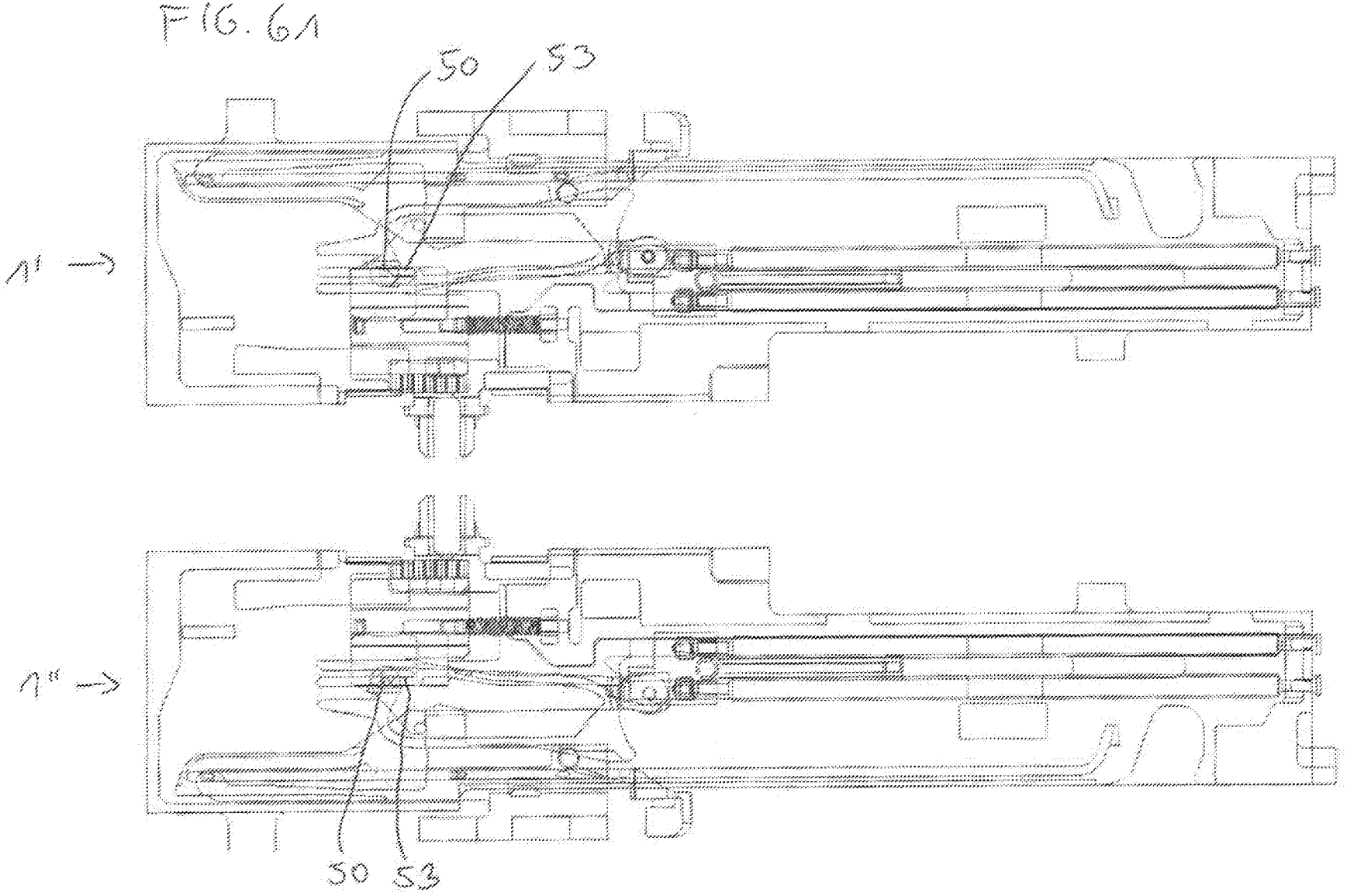

In FIG. 61, in contrary, it is illustrated when an unlocking is carried out simultaneously on both sides, thus, when the movable furniture part 2 is being pushed centrally. As a consequence, the two locking pins 50 are both abutting the front side of the respective locking element 54.

Figure 62:
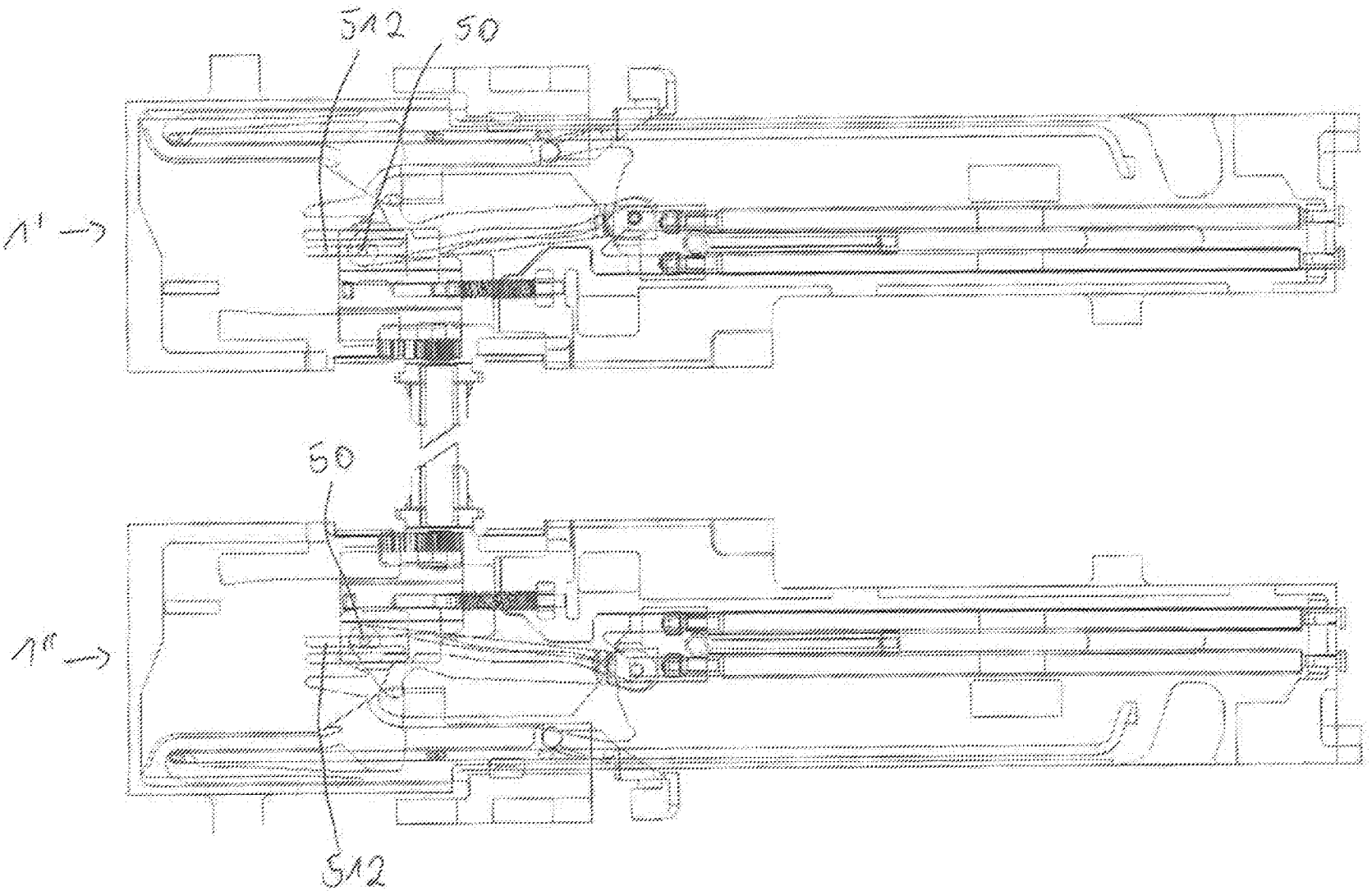

In FIG. 62, finally, still another situation is illustrated when the movable furniture part 2 is pushed in closing direction SR starting from the position according to FIG. 60. In this case, both locking pins 50 arrive in the respective overload channel 512 of the guide track 51.

All of the components, functions and movements which are explicitly described based on the FIGS. 51 to 62 are carried out in the same way as in the first three embodiments, as long as technically possible. Examples for this purpose are the entrainment member 11, the movable furniture part 2, the angled end section 24, the design of the whole guide track 51, the function and design of the ejection device 4, the design of the carrier 3, the function and design of the coupling mechanism 20 etc.

LIST OF REFERENCE SIGNS

1 drive device
1' first drive device
1" second drive device
2 movable furniture part
3 carrier

4 ejection device
5 locking device
6 triggering mechanism
7 transmission device
8 coupling device
9 retardation device
10 furniture carcass
11 entrainment member
12 synchronizing device
121 toothed rack
122 toothed wheel
123 synchronizing rod
124 guide track
125 tension spring
13 front buffer
130 buffer sleeve
131 buffer force storage member
132 plunger
14 front panel
15 drawer container
16 extension guide
17 carcass rail
18 drawer rail
19 mounting plate
20 coupling mechanism
21 coupling slider
22 coupling lever
23 coupling track
24 angled end section
26 coupling entrainment member
25 repositioning device
251 holding mandrel
252 base
253 recess
254 pressure spring
255 repositioning sleeve
256 guide track
257 sleeve limit stop
258 repositioning protrusion
30 housing base plate
31 housing cover
40 ejection slider
41 ejection force storage member
42 first force storage member base
43 second force storage member base
44 slider base
45 control lever
451 contact element
452 control lever track
453 angled section
46 guide track
47 control lever axis
48 swivel joint
50 locking pin
51 guide track for the locking pin
511 unlocking slant
512 overload channel
52 latch recess
53 locking element
531 locking surface
532 surface
54 recess
55 guiding groove
56 limit stop
57 gap
58 base element
60 triggering element
601 holding hole
61 triggering lever
611 bearing element
62 compensating chock
63 bent surface
64 latching tooth
65 crown gear
651 bearing element
652 recess
66 guiding protrusions
67 spring
68 guiding mandrel
**68*a*** mandrel support on carrier
**68*b*** mandrel support on triggering element
681 bearing recess
682 bearing protrusion
683 rotary bearing
684 rotation limiting abutting surface
685 bearing recess
686 bearing protrusion
687 bearing protrusion
688 holding pin recess
69 triggering leverage
**69*a*** first leverage part
**69*b*** second leverage part
**69*c*** third leverage part
691 protrusions
692 linear guide track
693 bearing element
694 recess
695 elongated hole
696 holding pin
697 elongated hole
698 spring holding protrusion
699 leg spring
70 transmission element
701 ejection limit stop
702 deflection slant
703 contact surface
71 limit stop
72 catching lever
721 protrusion
722 rotary bearing
73 abutting surface
74 latching recesses
75 rotatable crown gear (first coupling element)
751 transmission lever
752 central recess
76 guide track
77 angled end section
79 damping limit stop
81 first coupling element
82 second coupling element
83 coupling force storage member
90 compensating bracket
901 bearing element
902 recess
903 bearing recess
904 bearing recess
91 toothed wheel
911 bearing element
912 recess
913 holding recess
92 tension washer
921 recess
922 spring protrusion
923 spring protrusion

93 first tensioning lever
931 protrusion
932 protrusion
94 second tensioning lever
941 upper protrusion
942 lower protrusion
95 return spring
951 damped slider
952 guiding protrusions
953 damping guide track
954 spring guiding mandrel
955 pressure spring
956 holding bracket
957 toothed rack section
958 guiding surface
96 recess
961 toothed wheel
962 bearing element
963 bearing element
964 end cover
965 end cover
966 rotational damper
967 circular recesses
97 recess
98 guide track
99 resilient element
100 item of furniture
SS closed position
OS open position
VS locking position
ES unlocking position
ÜS overpressing position
OR opening direction
SR closing direction
EK uncoupling position
KS coupling position
D rotary axis
S tensioning section
VV pre-locking position
A ejection section
L bearing section
E latching movement section

The invention claimed is:

1. A drive device for a movable furniture part, comprising:

a carrier, an ejection device for ejecting the movable furniture part from a closed position into an open position, the ejection device being movable relative to the carrier, a locking device for locking the ejection device in a locking position, a triggering mechanism for moving the locking device out of the locking position into an unlocking position, wherein the triggering mechanism can be activated by overpressing the movable furniture part into an overpressing position situated beyond the closed position and wherein the movable furniture part can be moved by the ejection device in an opening direction when the unlocking position is reached, a transmission device for transmitting the position of the movable furniture part to the triggering mechanism, the transmission device being separate from the movable furniture part, wherein a movement of the movable furniture part can be transmitted to the triggering mechanism by the transmission device, and a coupling device effective and being arranged between the transmission device and the triggering mechanism, wherein the coupling device can be moved from an uncoupling position into a coupling position when the ejection device is in the locking position, wherein, in the coupling position, the transmission device is motion-coupled with the triggering mechanism by the coupling device.

2. The drive device according to claim 1, wherein the coupling device comprises a first coupling element, a second coupling element, and a coupling force storage member, wherein the first and second coupling elements are movable relative to each other by the coupling force storage member, wherein, in the uncoupling position, the two coupling elements are distanced from each other, and in the coupling position the first and second coupling elements are in direct contact to each other.

3. The drive device according to claim 2, comprising a damping device for delaying or braking the movement of the coupling elements from the uncoupling position into the coupling position, the movement being triggered by the coupling force storage member.

4. The drive device according to claim 1, wherein the carrier is formed as a housing to be arranged on the movable furniture part.

5. The drive device according to claim 1, wherein the ejection device comprises an ejection slider movable relative to the carrier, and an ejection force storage member attached to the carrier by a first force storage member base and to the ejection slider by a second force storage member base.

6. The drive device according to claim 5, wherein the ejection slider comprises a slider base and a control lever rotatably supported on the slider base.

7. The drive device according to claim 1, wherein the transmission device comprises a transmission element movable relative to the carrier, and a limit stop on the transmission element for engaging an entrainment member.

8. The drive device according to claim 7, wherein the transmission device comprises a catching lever for the entrainment member, the catching lever being movably supported on the transmission element.

9. The drive device according to claim 1, wherein the transmission device is configured to be contacted during ejecting by the ejection device, and the transmission device is movable relative to the carrier.

10. The drive device according to claim 1, wherein the locking device comprises a locking pin arranged on the ejection device and a guide track for guiding the locking pin, wherein the locking pin is locked in a latch recess of the guide track in the locking position.

11. The drive device according to claim 10, wherein the latch recess is at least partly formed by a locking element movable relative to the carrier, wherein the locking pin is held on the locking element in the locking position.

12. The drive device according to claim 1, wherein the triggering mechanism comprises a triggering element supported movably on the carrier and a triggering lever which is movably supported on the carrier.

13. The drive device according to claim 12, wherein the latch recess is at least partly formed by a locking element movable relative to the carrier, the locking element being connected to the triggering element.

14. The drive device according to claim 2, wherein the first coupling element is connected to or is formed integrally with the transmission element of the transmission device.

15. The drive device according to claim 2, wherein the triggering mechanism comprises a triggering element supported movably on the carrier, the second coupling element being connected to or formed integrally with the triggering lever of the triggering mechanism.

16. The drive device according to claim 2, wherein the first coupling element is formed as an abutting surface on the transmission element and the second coupling element is formed as a compensating chock.

17. The drive device according to claim 16, wherein the compensating chock comprises a bent surface configured such that, in the coupling position, the bent surface contacts the abutting surface on the transmission element.

18. The drive device according to claim 2, wherein the first coupling element is formed by latching recesses which are formed in the transmission element and the second coupling element comprises at least one latching tooth which can be latched in the latching recesses.

19. The drive device according to claim 18, wherein the first coupling element is a first crown gear rotatable around a rotary axis, said the first crown gear having thereon a plurality of radially-oriented latching recesses formed around the rotary axis, the second coupling element being formed as a second crown gear rotatable around the rotary axis, a plurality of radially oriented latching teeth corresponding to the latching recesses being formed on the second crown gear around the rotary axis, and the latching teeth abut the latching recesses in the coupling position during a rotary movement of the first crown gear and the second crown gear relative to each other in at least one rotary direction.

20. An arrangement comprising:

the drive device according to claim 1, and a front buffer to be attached to a furniture carcass for determining the closed position of the movable furniture part.

21. An arrangement comprising:

two drive devices, each of the two drive devices being configured according to claim 1 and a synchronizing device, wherein the two drive devices are motional coupled by the synchronizing device.

22. An item of furniture comprising:

a furniture carcass, a furniture part movable relative to the furniture carcass, and the drive device according to claim 1.

23. The item of furniture according to claim 22, wherein the drive device is mounted to the movable furniture part and an entrainment member corresponding to the transmission device is attached to the furniture carcass.

24. The item of furniture according to claim 22, wherein a front buffer is arranged on a front side of the furniture carcass, the movable furniture part abuts the front buffer in the closed position, and the front buffer can be pushed in by the movable furniture part during the overpressing of the movable furniture part in closing direction.

25. The item of furniture according to claim 24, wherein the front buffer protrudes from the furniture carcass a distance between 1.5 mm and 3.5 mm in an unloaded state.

26. A drive device for a movable furniture part, comprising:

a carrier, an ejection device for ejecting the movable furniture part from a closed position into an open position, the ejection device being movable relative to the carrier and being configured to be unlocked from a locking position by an overpressing movement of the movable furniture part into an overpressing position situated beyond the closed position, and a locking device for locking the ejection device in the locking position, wherein the locking device comprises a locking pin arranged on the ejection device and a guide track for guiding the locking pin, wherein the locking pin is configured to be locked in a latch recess of the guide track in the locking position, the latch recess being at least partly formed by a locking element movable relative to the carrier, and the locking pin being held on the locking element in the locking position, wherein the locking element is supported in a linearly movable manner on the carrier, and the locking element is configured to start at the locking position and be linearly movable in a direction opposite to a direction in which the locking pin is moved during the overpressing movement.

27. The drive device according to claim 26, wherein the locking element is connected to a synchronizing element for synchronizing the movement of the locking element with a locking element of a second locking device.

28. The drive device according to claim 27, wherein the locking element is formed integrally with the synchronizing element.

29. The drive device according to claim 26, wherein the synchronizing element is formed as a toothed rack.

30. The drive device according to claim 26, wherein the locking element is movably supported in a limited manner and is guided linearly slidable on the carrier.

31. The drive device according to claim 26, wherein the locking element is configured to be movable linearly in a direction of an ejection section of the guide track starting from the locking position.

32. The drive device according to claim 26, wherein the locking element is force-actuated by a force storage member.

33. The drive device according to claim 32, wherein the locking pin is configured to, after the unlocking, abut the locking element, and the locking element is movable by the locking pin against a force of the force storage member in a direction of the ejection section of the guide track.

34. The drive device according to claim 32, wherein the locking element is configured to be movable by the force storage member as soon as the locking pin is disengaged from the locking element in a direction in which the locking pin is moved during the overpressing movement.

35. The drive device according to claim 33, wherein the locking element and the guide track are configured such that, by a movement of the locking element initiated by the locking pin, a gap is released between the locking element and a limit stop of the guide track.

36. The drive device according to claim 35, wherein the locking pin is configured to be movable through the gap further into the ejection section of the guide track, and the locking pin is disengaged from the locking element.

37. The drive device according to claim 35, wherein the locking element has a surface oriented transverse to the linear movement direction of the locking element, the locking pin being configured to be deflected into the gap and released from the surface.

38. An arrangement comprising:

a first drive device and a second drive device, each of the first drive device and the second drive device being configured according to claim 26, and a synchronizing device for synchronizing the locking elements of the first drive device and the second drive device.

39. The arrangement according to claim 38, wherein the first drive device and the synchronizing device are configured such that the overpressing movement begins free from a movement transmission between the first drive device and the synchronizing device, and the synchronizing device is movable upon a movement of the movable furniture part in an opening direction by the first drive device.

40. The arrangement according to claim 39, wherein the first drive device and the synchronizing device are configured such that a movement transmission from the first drive device to the synchronizing device is carried out only after the unlocking.

41. The arrangement according to claim 38, wherein the synchronizing device comprises synchronizing elements each arranged on one of the first drive device and the second drive device.

42. The arrangement according to claim 38, wherein the synchronizing device comprises a synchronizing rod having synchronizing elements arranged on both ends.

43. The drive device according to claim 5, wherein the ejection force storage member is a tension spring.

44. The drive device according to claim 8, wherein the catching lever is rotatably supported on the transmission element.

45. The drive device according to claim 9, wherein a transmission element of the transmission device is contacted by a control lever of the ejection device during ejecting.

46. The drive device according to claim 10, wherein the locking pin is arranged on a control lever of the ejection device, and the guide track is at least partly formed in the carrier.

47. The drive device according to claim 12, wherein the triggering lever is rotatably supported on the carrier, and the triggering element is formed separate from the triggering lever.

48. The drive device according to claim 13, wherein the locking element is integrally formed with the triggering element.

49. The drive device according to claim 26, wherein the guide track is at least partly formed in or on the carrier.

50. The drive device according to claim 30, wherein the locking element is guided linearly slidable in a recess of a housing base plate of the carrier.

51. The drive device according to claim 32, wherein the force storage member is a spring.

52. The arrangement according to claim 41, wherein the synchronizing elements are toothed racks.

53. The arrangement according to claim 42, wherein the synchronizing rod is rotatable, and synchronizing elements, are toothed wheels.

* * * * *